United States Patent [19]

Winkler et al.

[11] 4,111,284

[45] Sep. 5, 1978

[54] ELEVATOR SYSTEM

[75] Inventors: Charles L. Winkler, Worthington; Kenneth M. Eichler, McKeesport, both of Pa.

[73] Assignee: Westinghouse Electric Corp., Pittsburgh, Pa.

[21] Appl. No.: 574,664

[22] Filed: May 5, 1975

Related U.S. Application Data

[63] Continuation-in-part of Ser. No. 503,212, Sep. 4, 1974, abandoned.

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,741,347 | 6/1973 | Kirsch | 187/29 |
| 3,828,892 | 8/1974 | Winkler et al. | 187/29 |
| 3,851,734 | 12/1974 | Sackin | 187/29 |
| 3,851,735 | 12/1974 | Winkler et al. | 187/29 |
| 3,903,499 | 9/1975 | Oliver | 187/29 X |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system with an asynchronous-synchronous interface between the system processor and each car controller. Each interface includes a serially accessed memory which intermittently receives command words from the system processor. The serially accessed memory repetitively reads out the commands to the car controller, and updates the commands in response to a new data word without interrupting the flow of data to the car controller. Each interface utilizes internal logic and timing for controlling its serially accessed memory, thus relaxing the memory capacity and processing speed requirements of the system processor.

10 Claims, 27 Drawing Figures

PKFL
DNIN
UPIN
SUT
SDT
DOPN
NEXT
242
240
256
258
260
262
264
244
234
232
12V
TRIG
RETRIG
R
AS
-TR
Q
246
248
250
252
254
RES
SET
D
C
230
238
236
274
276
278
280
28
272
270
S/R
MODE
REC
CL
210
220
212
266
218
222
224
226
214
228
216
J
K
STB
STA
INSC
COMO
KO8
STD
KO8
S300
S100
DECO
DEC1
DEC2
KO8S
SECO
STC
DEC3

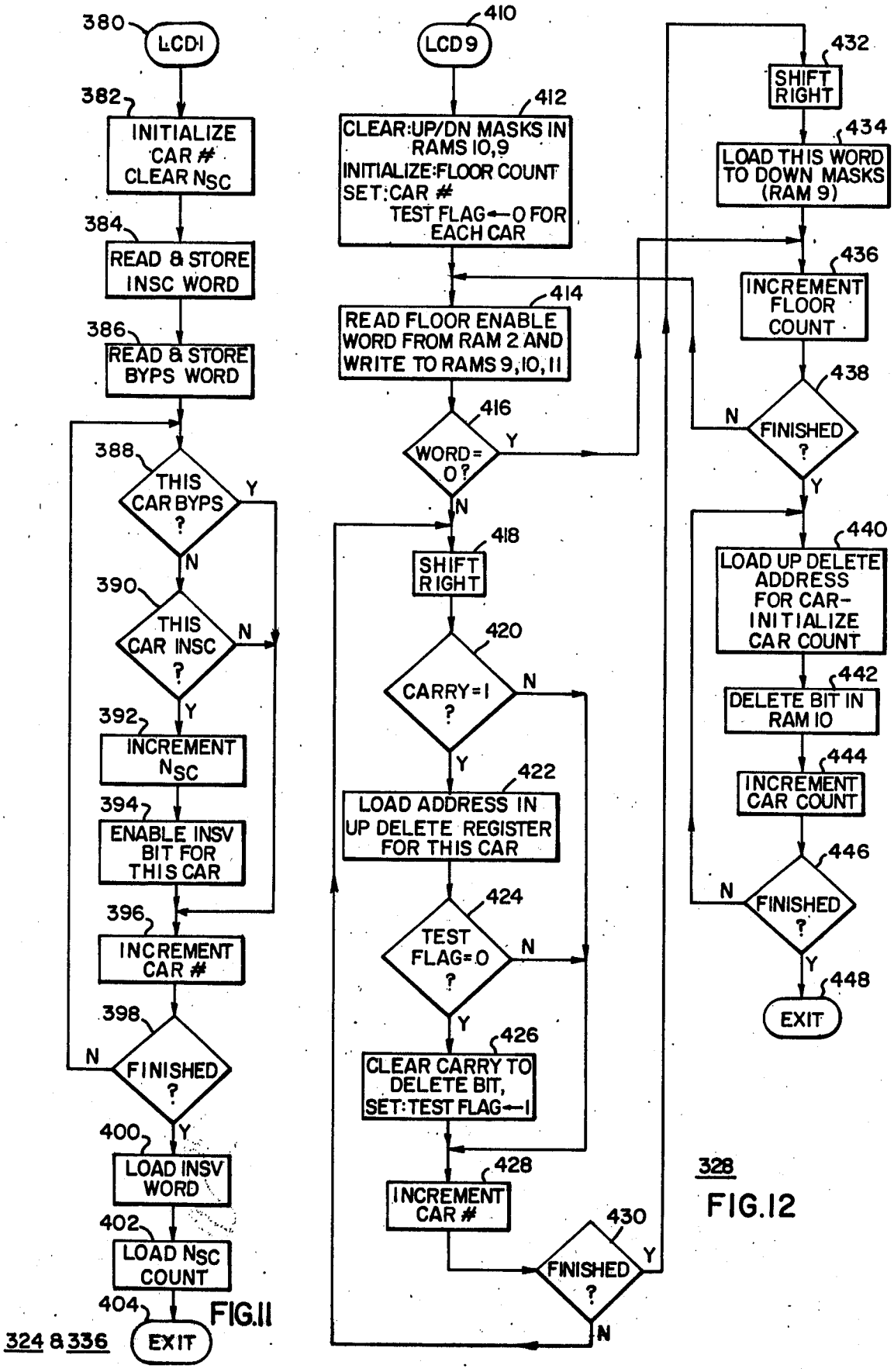
380
LCD1
382
INITIALIZE CAR # CLEAR NSC
384
READ & STORE INSC WORD
386
READ & STORE BYPS WORD
388
THIS CAR BYPS ?
390
THIS CAR INSC ?
392
INCREMENT NSC
394
ENABLE INSV BIT FOR THIS CAR
396
INCREMENT CAR #
398
FINISHED ?
400
LOAD INSV WORD
402
LOAD NSC COUNT
404
EXIT
324 & 336
FIG.11
410
LCD9
412
CLEAR:UP/DN MASKS IN RAMS 10,9
INITIALIZE:FLOOR COUNT
SET:CAR #
TEST FLAG←0 FOR EACH CAR
414
READ FLOOR ENABLE WORD FROM RAM 2 AND WRITE TO RAMS 9,10,11
416
WORD=0 ?
418
SHIFT RIGHT
420
CARRY=1 ?
422
LOAD ADDRESS IN UP DELETE REGISTER FOR THIS CAR
424
TEST FLAG=0 ?
426
CLEAR CARRY TO DELETE BIT, SET:TEST FLAG←1
428
INCREMENT CAR #
430
FINISHED ?
432
SHIFT RIGHT
434
LOAD THIS WORD TO DOWN MASKS (RAM 9)
436
INCREMENT FLOOR COUNT
438
FINISHED ?
440
LOAD UP DELETE ADDRESS FOR CAR-INITIALIZE CAR COUNT
442
DELETE BIT IN RAM 10
444
INCREMENT CAR COUNT
446
FINISHED ?
448
EXIT
328
FIG.12

| SCAN SLOTS | FLOOR POSITION | FLOOR FUNCTION | CARS 3 U | CARS 3 D | CARS 2 U | CARS 2 D | CARS 1 U | CARS 1 D | CARS 0 U | CARS 0 D | SCAN SLOTS | HALL CALLS (RAM 1) U | HALL CALLS (RAM 1) D | ASSIGNMENT TABLES UP (RAM 6) CARS 3 | UP 2 | UP 1 | UP 0 | DN (RAM 7) CARS 3 | DN 2 | DN 1 | DN 0 | SET ADDRESSES | | | | $A_{CI}$ (RAM 2) | $A_{SI}$ (RAM 8) | DN CALL MASKS (RAM 9) CARS 3 | 2 | 1 | 0 | UP CALL MASKS (RAM 10) CARS 3 | 2 | 1 | 0 |
|---|---|---|---|---|---|---|---|---|---|---|---|---|---|---|---|---|---|---|---|---|---|---|---|---|---|---|---|---|---|---|---|---|---|---|---|
| 15 | 16 | TE2 | | | | | | | | | 15 | | ▽ | | | | | | | | | 1 | 1 | 1 | 1 | $A_{CI}=1$ | $A_{SI}=6$ | 1 | 1 | 0 | 0 | 0 | 0 | 0 | 0 |
| 14 | 15 | TE1 | | | | | | | | | 14 | Δ | | | | | | | | | | 1 | 1 | 1 | 0 | | | 1 | 1 | 0 | 0 | 1 | 1 | 0 | 0 |
| 13 | 14 | 12 | CC | | | | | | | | 13 | | ▽ | | | | | | | | | 1 | 1 | 0 | 1 | | | 1 | 1 | 1 | 1 | 1 | 1 | 0 | 0 |
| 12 | 13 | 11 | ↑ | | | | | | | | 12 | | | | | | | | | | | 1 | 1 | 0 | 0 | $A_{CI}=2$ | $A_{SI}=2$ | 1 | 1 | 1 | 1 | 1 | 1 | 1 | 1 |
| 11 | 12 | 10 | | | | | | | | | 11 | | | | | | | | | | | 1 | 0 | 1 | 1 | | | 1 | 1 | 1 | 1 | 1 | 1 | 1 | 1 |
| 10 | 11 | 9 | | | | | CC | | | | 10 | Δ | | | | | | | | | | 1 | 0 | 1 | 0 | | | 1 | 1 | 1 | 1 | 1 | 1 | 1 | 1 |
| 09 | 10 | 8 | | | | | ↑ | | | | 09 | | ▽ | | | | | | | | | 1 | 0 | 0 | 1 | | | 1 | 1 | 1 | 1 | 1 | 1 | 1 | 1 |
| 08 | 9 | 7 | | | | | | | | | 08 | | ▽ | | | | | | | | | 1 | 0 | 0 | 0 | | | 1 | 1 | 1 | 1 | 1 | 1 | 1 | 1 |
| 07 | 8 | 6 | | | | | | | | | 07 | | | | | | | | | | | 0 | 1 | 1 | 1 | | | 1 | 1 | 1 | 1 | 1 | 1 | 1 | 1 |
| 06 | 7 | 5 | | | | | | | | | 06 | | | | | | | | | | | 0 | 1 | 1 | 0 | | | 1 | 1 | 1 | 1 | 1 | 1 | 1 | 1 |
| 05 | 6 | 4 | | | | | | | | | 05 | | | | | | | | | | | 0 | 1 | 0 | 1 | | | 1 | 1 | 1 | 1 | 1 | 1 | 1 | 1 |
| 04 | 5 | 3 | | | | | | | | ↓ | 04 | | | | | | | | | | | 0 | 1 | 0 | 0 | | | 1 | 1 | 1 | 1 | 1 | 1 | 1 | 1 |
| 03 | 4 | 2 | | | | | | | | | 03 | Δ | | | | | | | | | | 0 | 0 | 1 | 1 | $A_{CI}=0$ | $A_{SI}=1$ | 1 | 1 | 1 | 1 | 1 | 1 | 1 | 1 |
| 02 | 3 | 1 | | | N | | | | | CC | 02 | | | | | | | | | | | 0 | 0 | 1 | 0 | | | 0 | 0 | 1 | 1 | 1 | 1 | 1 | 1 |
| 01 | 2 | B1 | | | | | | | | | 01 | | | | | | | | | | | 0 | 0 | 0 | 1 | $A_{CI}=1$ | $A_{SI}=2$ | 0 | 0 | 0 | 1 | 0 | 0 | 1 | 1 |
| 00 | 1 | B2 | | | | | | | | | 00 | Δ | | | | | | | | | | 0 | 0 | 0 | 0 | | | 0 | 0 | 0 | 0 | 0 | 0 | 0 | 1 |
| | | | | | | | | | | | | | | | | | | | | | | | | | | $A_{CB}=2$ | $A_{SB}=8$ | | | | | | | | |

FIG. 24

ELEVATOR SYSTEM

This is a continuation-in-part of application Ser. No. 503,212 filed Sept. 4, 1974, now abandoned.

CROSS REFERENCE TO RELATED APPLICATIONS

Certain of the apparatus disclosed and described in this application is claimed in the concurrently filed applications which are assigned to the same assignee as the present application:

Ser. No. 574,662 filed May 5, 1975 in the names of A. Kirsch and C. L. Winkler, which application is a continuation-in-part of Ser. No. 503,146, filed Sept. 4, 1974, now abandoned.

Ser. No. 574,829, filed May 5, 1975 in the name of C. L. Winkler, which application is a continuation-in-part of Ser. No. 503,201, filed Sept. 4, 1974, now abandoned.

BACKGROUND OF THE INVENTION

1. Field of the Invention:

This invention relates in general to elevator systems, and more specifically to elevator systems in which a plurality of elevator cars are controlled by a system processor.

2. Description of the Prior Art:

Elevator systems of the prior art in which a plurality of elevator cars are controlled by a central control system, conventionally were relay implemented. The supervisory control of a relay implemented system receives input signals from the various elevator cars in parallel, the signals are processed in parallel, and parallel output signals are generated for controlling the various elevator cars. Replacement of relays by solid state switching devices and logic gates, as such devices became available, continued the parallel approach of the relay control systems.

Programmable system processors for controlling a group of elevator cars have many advantages over the nonprogrammable control systems, as the decision making and operating strategy may be confined to the software package, allowing the hardware to be substantially the same for each elevator installation. The programmable processor, which operates with a digital computer and a software package, does not have the large number of logic elements necessary to operate with parallel processing of signals, but takes advantage of its rapid processing ability to sequentially process the signals received from the cars, and to generate signals serially for control of the various cars. Powerful mini-computers have a memory capacity and operating speed sufficient to prepare, store and readout commands to a plurality of elevator cars, with the precise timing required to place the signals within the proper time or scan slots for use by the various car controllers. The mini-computer programmable processor is well suited for the larger banks of high speed elevators, but it is too costly for the smaller banks of medium speed elevators.

The microprocessors, such as Intel's MCS-4 and MCS-8, Rockwell's PPS, Signetic's PIP, National's GPC/P and AMI's 7300, offer an attractive cost package as well as flexibility due to the LSI circuitry and programmability. The central processing unit (CPU) is usually a single chip, with the typical software package stored in companion read-only-memories (ROMS). Data is stored in random access memories (RAMS).

While the microprocessor offers programming flexibility at a modest cost, it also imposes certain restrictions due to its relatively limited speed and memory capacity. The interface between the processor and each car controller becomes especially critical due to the memory and operating speed restrictions.

It would thus be desirable to provide a new and improved elevator system which utilizes a microprocessor, with new and improved processor-to-car interface circuits which work within the memory and operating speed restrictions of a typical microprocessor.

SUMMARY OF THE INVENTION

Briefly, the present invention is a new and improved elevator system having a plurality of elevator cars which may be controlled by a microprocessor. A new and improved asychronous to synchronous interface permits the processor to prepare and send a command word to a car and then go on to other tasks. The interface then controls the elevator car according to the commands provided by the processor, until the next command word is prepared and sent to the interface. The output circuit from the processor to each car controller requires only a single wire, over which the serial command word is sent. The processor does not have to store the command words and repetitively read the words out to the various cars in synchronism with the serial processing needs of the car controllers.

More specifically, each processor-to-car controller interface includes a constantly scanned serially accessed memory, such as a shift register, which automatically stores a command word responsive to the format of the word itself, and then recirculates the word until the next command word is received. The serially accessed memory outputs the commands in the proper scan slots for demultiplexing by demultiplexing circuitry connected to the output of the serially accessed memory.

Logic circuitry associated with each interface controls the mode of the serially accessed memory, operating the memory in the recirculate mode until a new data word is received, automatically switching the memory to the data input mode to read in the new data word, and then automatically switching the memory back to the recirculate mode, all without interrupting the timely flow of information to the demultiplexing circuitry.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIGS. 10 through 23 are detailed flow charts of subprograms which may be used to perform the various functions shown in block form in the flow chart of FIG. 9;

FIG. 24 is a graph which illustrates the assignment of scan slots to cars for a specific example.

DESCRIPTION OF PREFERRED EMBODIMENTS

FIG. 1

Figure 1:
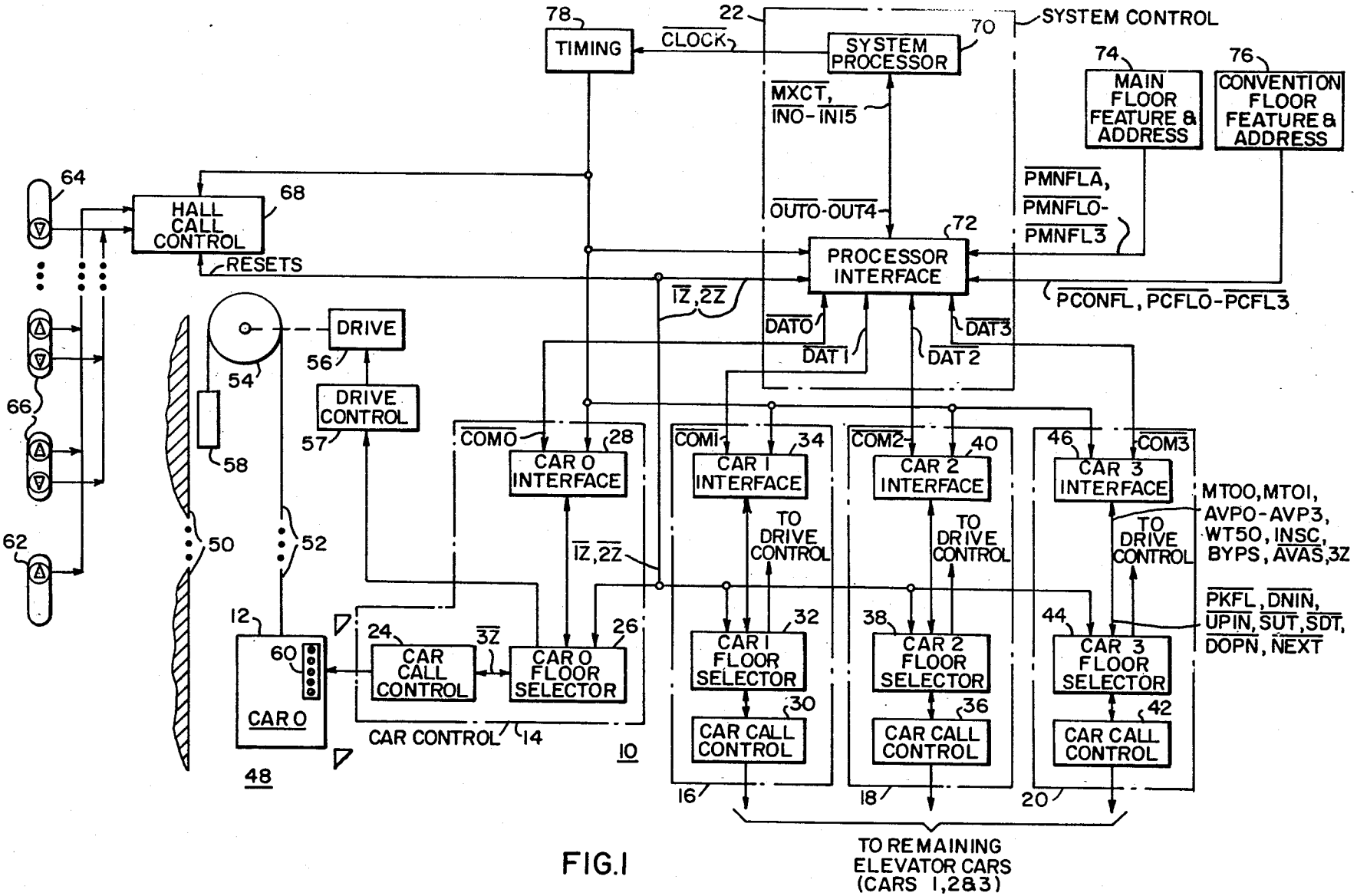
FIG. 1 is a partially schematic and partially block diagram of an elevator system, including supervisory system control, which may utilize the teachings of the invention.

Referring now to the drawings, and FIG. 1 in particular, there is shown an elevator system 10 which may utilize the teachings of the invention. Elevator system 10 includes a bank of elevator cars, with the controls 14, 16, 18 and 20 for four cars being illustrated for purposes of example. Only a single car 12 is illustrated, associated with car control 14, in order to simplify the drawing, since the remaining cars would be similar. Each car control includes a car call control function, a floor selector function, and an interface function for interfacing with supervisory system control 22. The supervisory system control 22 controls the operating strategy of the elevator system as the elevator cars go about the business of answering hall calls.

More specifically, car control 14 includes car call control 24, a floor selector 26, and an interface circuit 28. Car control 16 includes car call control 30, a floor selector 32, and an interface circuit 34. Car control 18 includes car call control 36, a floor selector 38, and an interface circuit 40. Car control 20 includes car call control 42, a floor selector 44, and an interface circuit 46. Since each of the cars of the bank of cars and their controls are similar in construction and operation, only the controls for car 12 will be described in detail.

Car 12 is mounted in a hatchway 48 for movement relative to a building 50 having a plurality of floors or landings, with only a few landings being illustrated in order to simplify the drawing. The car 12 is supported by a rope 52 which is reeved over a traction sheave 54 mounted on the shaft of a suitable drive motor 56. Drive motor 56 is controlled by drive control 57. A counterweight 58 is connected to the other end of the rope 52.

Car calls, as registered by pushbutton array 60 mounted in the car 12, are recorded and seralized in the car call control 24, and the resulting serialized car call information is directed to the floor selector 26.

Hall calls, as registered by pushbuttons mounted in the halls, such as the up pushbutton 62 located at the bottom landing, the down pushbutton 64 located at the uppermost landing, and the up and down pushbuttons 66 located at the intermediate landings, are recorded and serialized in hall call control 68. The resulting serialized hall call information is directed to the floor selectors of all of the elevator cars, as well as to the supervisory system control 22.

The floor selector 26 keeps track of the car 12 and the calls for service for the car, and provides signals for the drive control 57. The floor selector 26 also provides signals for controlling such auxiliary devices as the door operator and hall lanterns, and it controls the resetting of the car call and hall call controls when a car or hall call has been serviced.

The present invention relates to new and improved group supervisory control for controlling a plurality of elevator cars as they go about the task of answering calls for elevator service, and any suitable floor selector may be used. For purposes of example, it will be assumed that the floor selector disclosed in U.S. Pat. No. 3,750,850, issued Aug. 7, 1973, will be used, which patent is assigned to the same assignee as the present application. This patent describes a floor selector for operating a single car, without regard to operation of the car in a bank of cars. U.S. Pat. No. 3,804,209, issued Apr. 16, 1974, discloses modifications to the floor selector of U.S. Pat. No. 3,750,850 to adapt it for control by a programmable system processor. In order to avoid duplication and limit the complexity of the present application, these patents, which are assigned to the same assignee as the present application, are hereby incorporated into this application by reference.

The supervisory system control 22 includes a processing function 70 and an interface function 72. The processing function 70 receives car status signals from each of the car controllers, via the interface function 72, as well as the up and down hall calls, and provides assignment words for each car controller, which cause the elevator cars to serve the calls for elevator service according to a predetermined strategy. The car status signals provide information for the processing function 70 relative to what each car can do in the way of serving the various floors, and the processing function 70 makes assignments based on this car supplied information.

Main floor and convention floor features, shown generally at 74 and 76, respectively, may be activated to provide special optional strategies, as will be hereinafter explained.

The supervisory system control 22 provides a timing signal $\overline{\text{CLOCK}}$ for synchronizing a system timing function 78. The system timing function 78 provides timing signals for controlling the flow of data between the various functions of the elevator system.

FIG. 2

Figure 2:
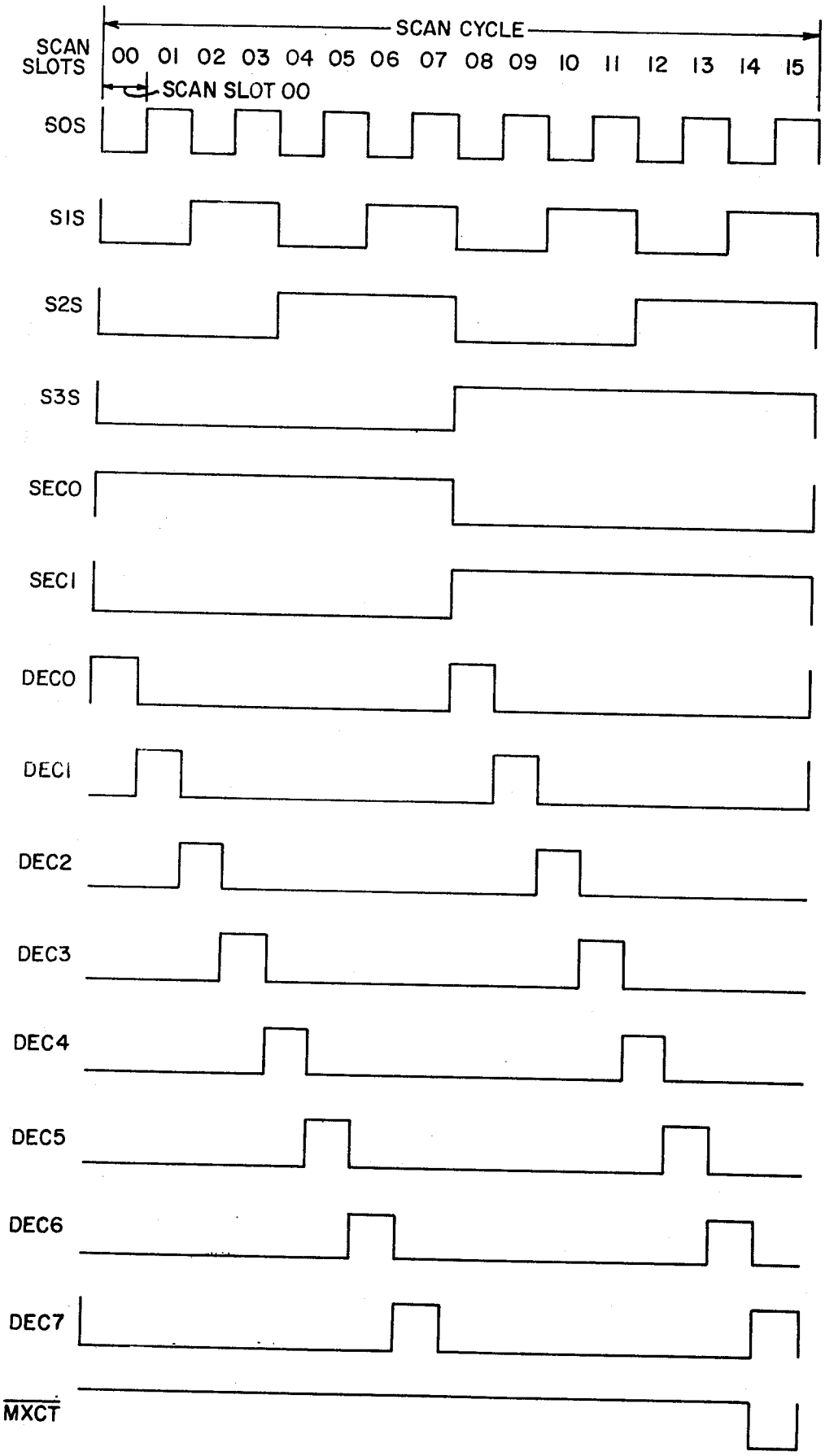
FIG. 2 is a timing diagram which illustrates the timing signals generated for one complete cycle of scan slots.

FIG. 2 illustrates certain timing signals provided by the timing function 78, with the timing signals in FIG. 2 relating to a complete scan cycle. The elevator system 10 is basically a serial, time multiplexed system, and as such precise timing must be generated in order to present data in the proper timed relationship. Each floor of the building to be serviced is assigned its own time or scan slot in each time cycle, and thus the number of time slots in a cycle is dictated by the number of floors in the associated building. Each floor has a different timing scan slot associated therewith, but it is not necessary that every scan slot be assigned to a floor level. Scan slots are generated in cycles of 16, 32, 64 or 128, so the specific cycle is selected such that there will be at least as many scan slots available as there are floor levels. For purposes of example, it will be assumed that there are 16 floors in the building described herein, so the cycle with 16 scan slots will be sufficient.

The 16 scan slot cycle is generated by a binary counter having outputs S0S, S1S, S2S and S3S, as illustrated in FIG. 2. The binary address of scan slot 00 is 0000, responsive to S3S, S2S, S1S and S0S, respectively, the binary address of scan slot 01 is 0001, etc.

The scan slot cycle is divided into two equal parts i.e., 8 scan slots each, by timing signals SEC0 and SEC1. Signal SEC0 is true for the first one-half of the scan cycle, while signal SEC1 is true for the last one-half of the scan cycle. Timing signals DEC0–DEC7 are each true for a different scan slot during each one-half scan cycle, with the true scan slots being separated by seven scan slots. Thus, any one of the 16 scan slots may be selected by logically combining one of the signals DEC-0–DEC7 with one of the signals SEC0 or SEC1. Timing signal $\overline{\text{MXCT}}$, for example, is true only during the last scan slot, i.e., scan slot 15, during each scan cycle, and is produced by the logical combination of signals DEC7 and SEC1.

FIG. 3

Figure 3:
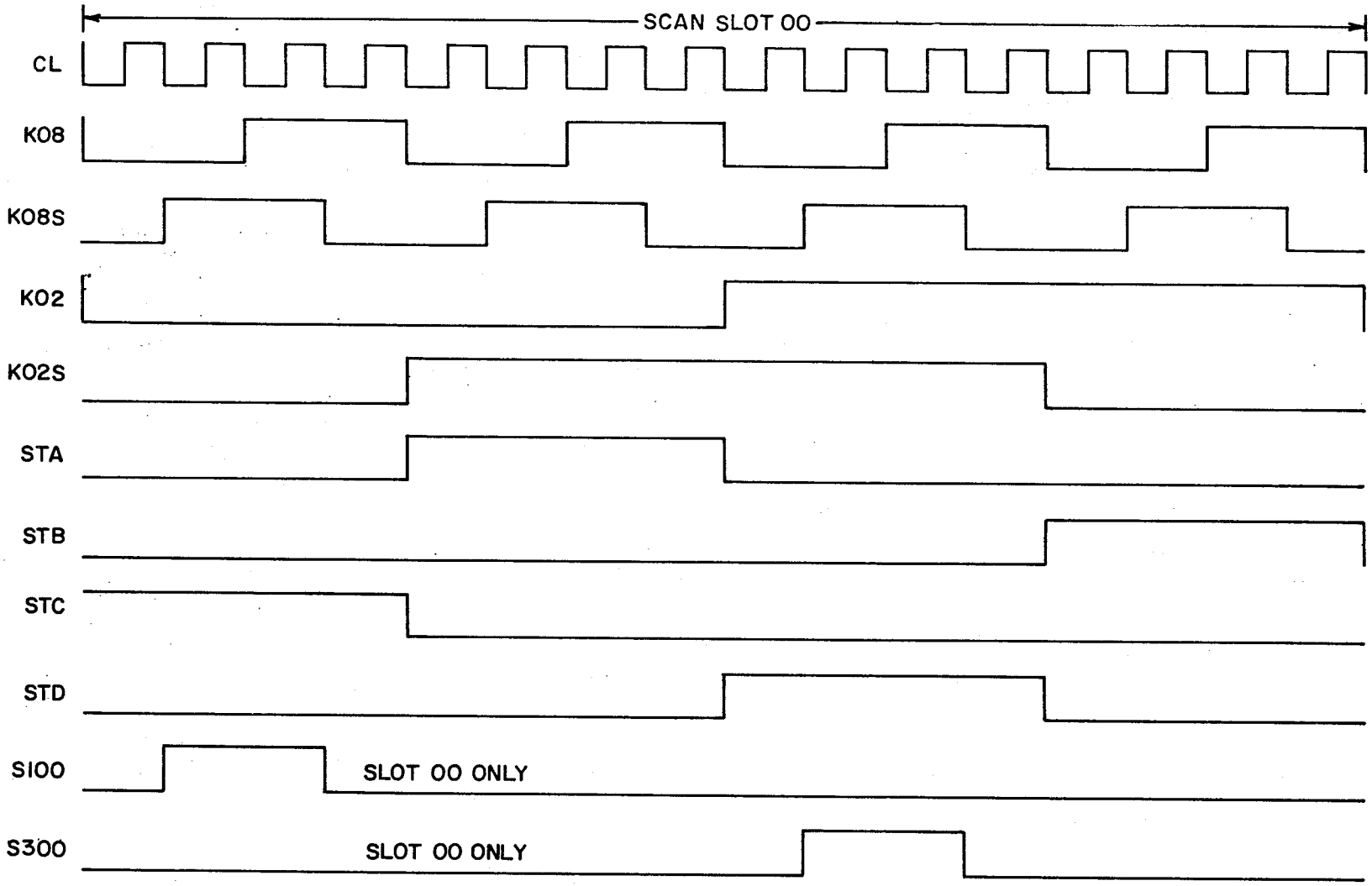
FIG. 3 is a timing diagram which illustrates the timing signals associated with a single scan slot.

FIG. 3 illustrates timing signals, also provided by timing function 78, with the timing signals of FIG. 3 relating to those associated with a scan slot. The timing signals of FIG. 3 are generated during each scan slot, with the exception of signals S100 and S300, which only occur during scan slot 00.

The basic clock CL is used to derive a signal KO8 which divides the scan slot into 8 equal parts, and signal KO8 is shifted forward by 90° to provide KO8S. Signal KO2 divides the scan slot into two equal parts, and signal KO2 is shifted forward by 90° to provide KO2S. Strobe signals STA, STB, STC and STD are each true for a different quarter of a scan slot, i.e., the second, fourth, first and the third quarters, respectively. Signals S100 and S300 occur during central portions of the first and third quarters, respectively, of scan slot 00.

In describing the elevator system 10 shown in FIG. 1 in more detail it will be helpful to set forth the various signals and their functions which will be hereinafter referred to, as well as symbols used as program identifiers and program variables in the flow charts.

| SYMBOL | FUNCTION |
|---|---|
| ACCU | Accumulator register in CPU |
| $A_{CB}$ | Average number of calls in the building per in-service elevator car |
| $A_{CI}$ | Average number of calls in a set per in-service elevator car |
| $A_{SB}$ | Average number of scan slots in the building per in-service car |
| $A_{SI}$ | Average number of scan slots in a set per in-service car enabled to serve the set |
| AVAS | Car is available according to the floor selector |
| AVPO-AVP3 | Advanced car floor position in binary |
| BYPS | True when the car is by-passing hall calls |
| CALL | True when a car has car call or hall call in an assigned scan slot |
| $\overline{\text{CLOCK}}$ | Timing signal initiated by the system processor |
| CM-RAM 1 | Command control line from CPU to up to 4 RAMS |
| CM-RAM 2 | Command control line from CPU to up to 4 RAMS |
| CM-ROM | Command control line from CPU to up |

-continued

| SYMBOL | FUNCTION |
|---|---|
| | to 16 ROMS |
| $\overline{\text{COMO}}$ - $\overline{\text{COM3}}$ | Serial control signals from system processor interface to 4 elevator cars |
| CONV | True when a car has a convention floor assignment |
| CY | Carry link flip-flop in CPU |
| $\overline{\text{DAT0}}$ - $\overline{\text{DAT3}}$ | Serial signal from 4 elevator cars to system processor interface |
| DNAC | Actual number of cars set for down travel |
| DNDES | Desired number of cars set for down travel |
| DNIN | Down hall call inhibit, true when a car is inhibited from answering a down hall call at the associated floor |
| $\overline{\text{DOPN}}$ | Command from system processor to open car doors |
| DO-D3 | 4-bit data bus in system processor |
| D89T | True when motor generator set is shut down |
| FEN | Floor enable-true for floors car is enabled to see hall calls in at least one service direction |
| HRT | Half of a round trip |
| IDLE | True when car is in-service, not NEXT, and available according to floor selector |
| INSC | True when the car is in-service with the system processor |
| INSV | True when the car is in-service with the system processor and is not bypassing hall calls |
| $\overline{\text{IN0}}$ - $\overline{\text{IN15}}$ | 16 inputs to the system processor |
| MDCL | A door signal which is true when the doors are closed |
| MTOO | Memory track signals which is true for floors for which car is enabled to see up hall calls |
| MTO1 | Memory track signal which is true for floors car is enabled to see down hall calls |
| $\overline{\text{MXCT}}$ | Timing signal which is true during the last scan slot of the scan cycle |
| $N_{HCI}$ | Number of hall calls assigned to a car from a 1 car set |
| $N_{HCT}$ | Total number of hall calls assigned to car so far |
| $N_{CI}$ | Number of hall calls assigned to a car so far in the set being considered |
| $N_{CP}$ | A counter which is initialized to a count responsive to the position of the car |
| $N_{DIST}$ | Number of valid scan slots from the car so far in the assignment routine (used to determine when the half round trip limitation is met) |
| $\overline{\text{NEXT}}$ | Signal from system processor which is true when a car is designated as the next car to leave the main floor |
| $N_{POS}$ | The scan slot number which corresponds to the position of the car |
| $N_{RCC}$ | Number of registered hall calls assigned to a car in a set served by more than one car |
| $N_{SC}$ | Number of cars in-service in the bank |
| $N_{SCI}$ | Number of cars enabled to serve a set |
| $N_{SCF}$ | Number of cars enabled to serve the convention floor |
| $N_{SI}$ | Number of scan slots assigned to a car so far in the set being considered |
| $N_{SMF}$ | Number of cars which can serve the main floor |
| $N_{SS}$ | Total number of scan slots assigned to car so far |
| $\overline{\text{OUTO}}$ - $\overline{\text{OUT4}}$ | Serial signals from system processor to system processor interface |
| $\overline{\text{PCONFL}}$ | A signal which is true when the convention floor feature is activated |
| $\overline{\text{PCFL0}}$ - $\overline{\text{PCFL3}}$ | The binary address of the convention floor |
| PKFL | Parking signal from the system processor |
| PMNFL | A signal which is true when the main floor feature is activated |
| $\overline{\text{PMNF0}}$-$\overline{\text{PMNFL3}}$ | The binary address of the main floor |
| $Q_{MNF}$ | Quota of cars to be maintained at the main floor |
| RAM | Random access memory |
| RES | Reset signal used to start up the supervisory system control |
| ROM | Read only memory |
| SDT | A command from the system processor to set the floor selector for down travel |
| $\overline{\text{SUT}}$ | A command from the system processor to set the floor selector for up travel |
| SYNC | Synchronizing signal generated by the system processor at the start of an instruction cycle |
| UPAC | Actual number of cars set for up travel |
| UPDES | Desired number of cars set for up travel |
| UPIN | The up call inhibit signal from the system |

-continued

| SYMBOL | FUNCTION |
|---|---|
| | processor |
| UPSCAN | Scanning direction for assigning a scan slots to a car, 1 = UP 0 = DOWN |
| WT50 | Indicates car load, 1 = greater than 50%, 0 = less than 50% |
| 1Z | Serial up hall calls |
| 2Z | Serial down hall calls |
| 3Z | Serial car calls |
| $\phi 1$ | Phase 1 of two non-overlapping clocks in the system processor |
| $\phi 2$ | Phase 2 of two non-overlapping clocks in the system processor |

FIG. 4

Figure 4:
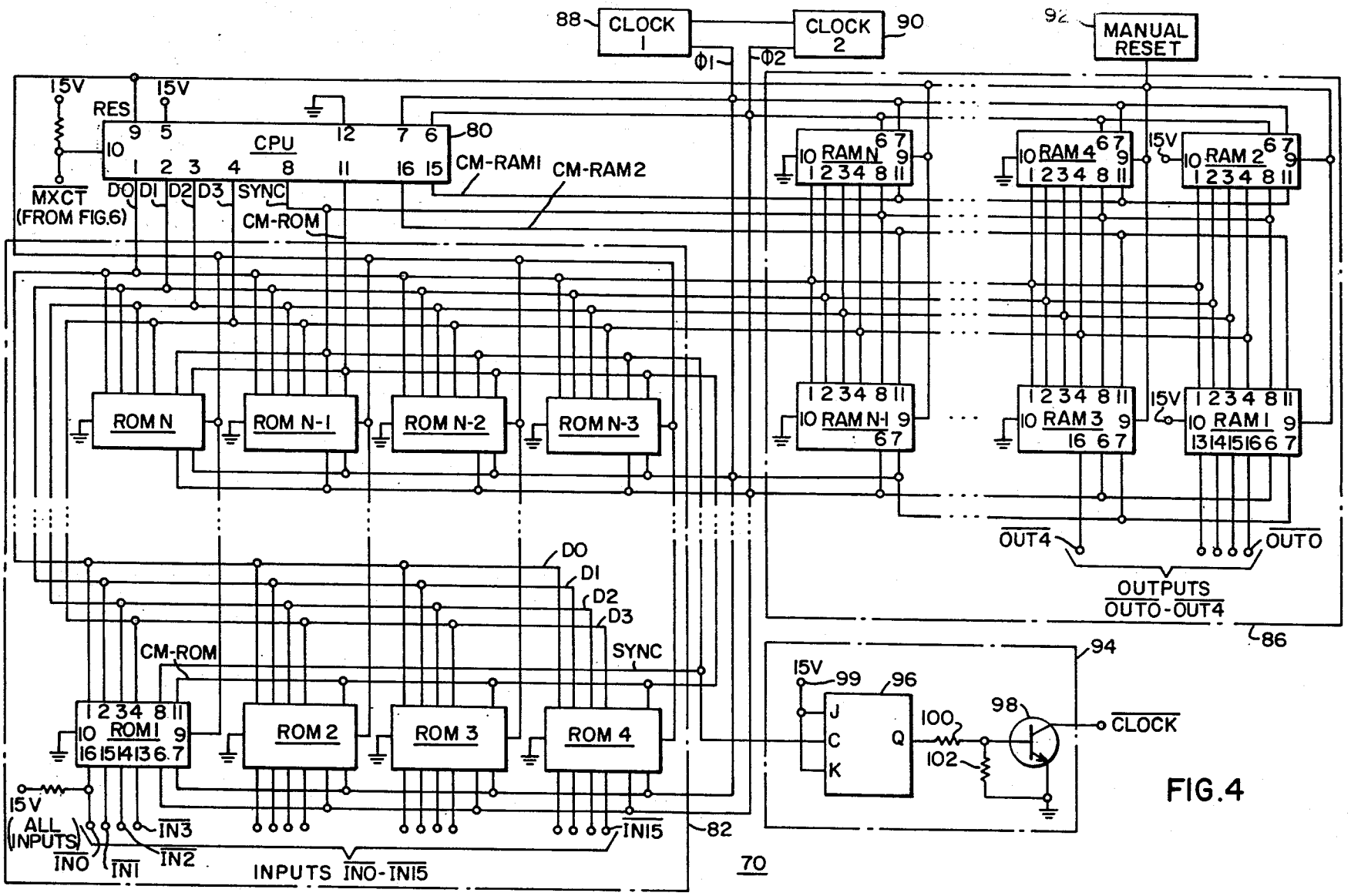
FIG. 4 is a schematic diagram of a system processor, including a central processing unit and companion ROMS and RAMS, which may be used for the system processor shown in block form in FIG. 1.

FIG. 4 is a schematic diagram of a system processor 70 which may be used for the processing function 70 of the supervisory system control 22 shown in block form in FIG. 1. Any suitable microprocessor may be used for the system processor 70, such as one of the hereinbefore mentioned microprocessors. For purposes of example, Intel Corporations' MSC-4 micro computer set will be described.

More specifically, the MCS-4 microprocessor includes a 4-bit parallel control and arithmetic unit 80 (Intel's 4004), hereinafter referred to as CPU 80, a control memory 82 which includes a plurality of programmable read only memories (ROMS) such as ROM 1 through ROM N (Intel's 4001), a data storage memory 86 which includes a plurality of random access memories (RAMS), such as RAM 1 through RAM N (Intel's 4002), clocks 88 and 90 which generate the basic system timing (750 KHZ) in the form of two non-overlapping clock phases $\phi 1$ and $\phi 2$, a manual reset 92, and a clock 94 which provides timing signals $\overline{\text{CLOCK}}$ for external devices responsive to the timing produced by CPU 80.

CPU 80 communicates with the control memory 82 and the data storage memory 86 via a four line data bus D0, D1, D2 and D3, and with the peripheral portion of the elevator system through input and output ports in the control and data memories 82 and 86, respectively. CPU 80 includes a control line for each set of four RAMS, such as control lines CM-RAM 1 and CM-RAM 2, and a control line CM-ROM which is used to control a bank of up to 16 ROMS. CPU 80 is connected to clocks 88 and 90, and responsive thereto, i.e., every 8 clock periods, issues a synchronizing signal SYNC. Signal SYNC is sent to the control and data memories 82 and 86, and to clock 94, to indicate the start of a 10.8 microsecond instruction cycle.

CPU 80 is connected to the manual reset 92, and it has a test pin connected to receive signal $\overline{\text{MXCT}}$. Signal $\overline{\text{MXCT}}$ is generated in the apparatus shown in FIG. 6, and, as shown in the timing diagram of FIG. 2 it is true during the last scan slot of each scan cycle.

Each of the ROMS are connected to the data bus D0, D1, D2 and D3, to the clock phases $\phi 1$ and $\phi 2$, to ROM control line CM-ROM, to the synchronizing line SYNC, and to the reset 92. ROMS 1, 2, 3 and 4 each have 4 inputs for receiving input information from the elevator system, with these 16 inputs being referenced $\overline{\text{IN0}}$ through $\overline{\text{IN15}}$.

Each of the RAMS are connected to the data bus D0, D1, D2 and D3, to the clock phases $\phi 1$ and $\phi 2$, to one of the RAM control lines CM-RAM 1 or CM-RAM 2, to the synchronizing line SYNC, and to the reset 92. RAMS 1 and 3 each have outputs for sending information to the elevator system, with these outputs being referenced $\overline{\text{OUT0}}$ through $\overline{\text{OUT4}}$.

Reset 92 is manually actuated during start-up of the elevator system. A low reset signal clears the memories and registers in CPU 80, it sets the data bus to zero, it clears static flip-flops in the control memory 82 as well as inhibiting data out, and it clears the data memory 86.

Clock 94 may include a JK flip-flop 96 and an NPN transistor 98. The J and K inputs of flip-flop 96 are connected to a unidirectional supply voltage, at terminal 99, and its clock input C is connected to the synchronizing line SYNC. Its Q output is connected to the base of transistor 98 via resistor 100. The base of transistor 98 is also connected to ground via resistor 102, its emitter is connected to ground, and its collector is connected to output terminal $\overline{\text{CLOCK}}$. Signal SYNC is low during the last subcycle (1.35 microsecond) of the 10.8 microsecond instruction cycle and the flip-flop 96 changes its output state on the positive going transition of SYNC. Thus, the signal $\overline{\text{CLOCK}}$ is a square wave, with each half cycle being one complete intruction cycle (10.8 microseconds).

CPU 80 includes an address register, an index register, a 4-bit adder, and an instruction register. The index register is a random access memory of 16 × 4 bits. The 16 4-bit locations, referenced R0–R15, may be directly addressed for computation and control, and they may also be addressed as 8 pairs of storage locations, referenced P0–P7 for addressing RAMS or ROMS, or storing data from the ROMS.

Each of the ROMS of the control memory 82 stores 256 × 8 words of program or data tables, and is provided with 4 I/O pins and control for performing input and output operations. CPU 80 sends an address to the control memory, along with a ROM number, during the first three instruction subcycles, and the selected ROM sends an instruction to CPU 80 during the next two instruction subcycles. The instruction is executed, i.e., data is operated on in CPU 80, or data or address is sent to or from CPU 80, during the last three subcycles of the instruction cycle. When an I/O instruction is received from the control memory 82, data is transferred to or from the accumulator of CPU 80 on the 4 data lines connected to the control memory 82.

Each of the RAMS of the data memory 86 stores 320 bits arranged in 4 registers of twenty 4-bit characters each, 16 of which are addressable by one instruction, and 4 of which are addressable by another instruction. The 16 bits of each register form a main memory, while the 4 bits form a status character memory. The address of one of the RAMS, register and character is stored in two index registers in CPU 80 and is transferred to the selected RAM during two subcycles of the instruction cycle when a RAM instruction is executed. When the RAM output instruction is received by CPU 80, the content of the accumulator of CPU 80 is transferred to the four RAM output lines.

FIG. 5

Figure 5:
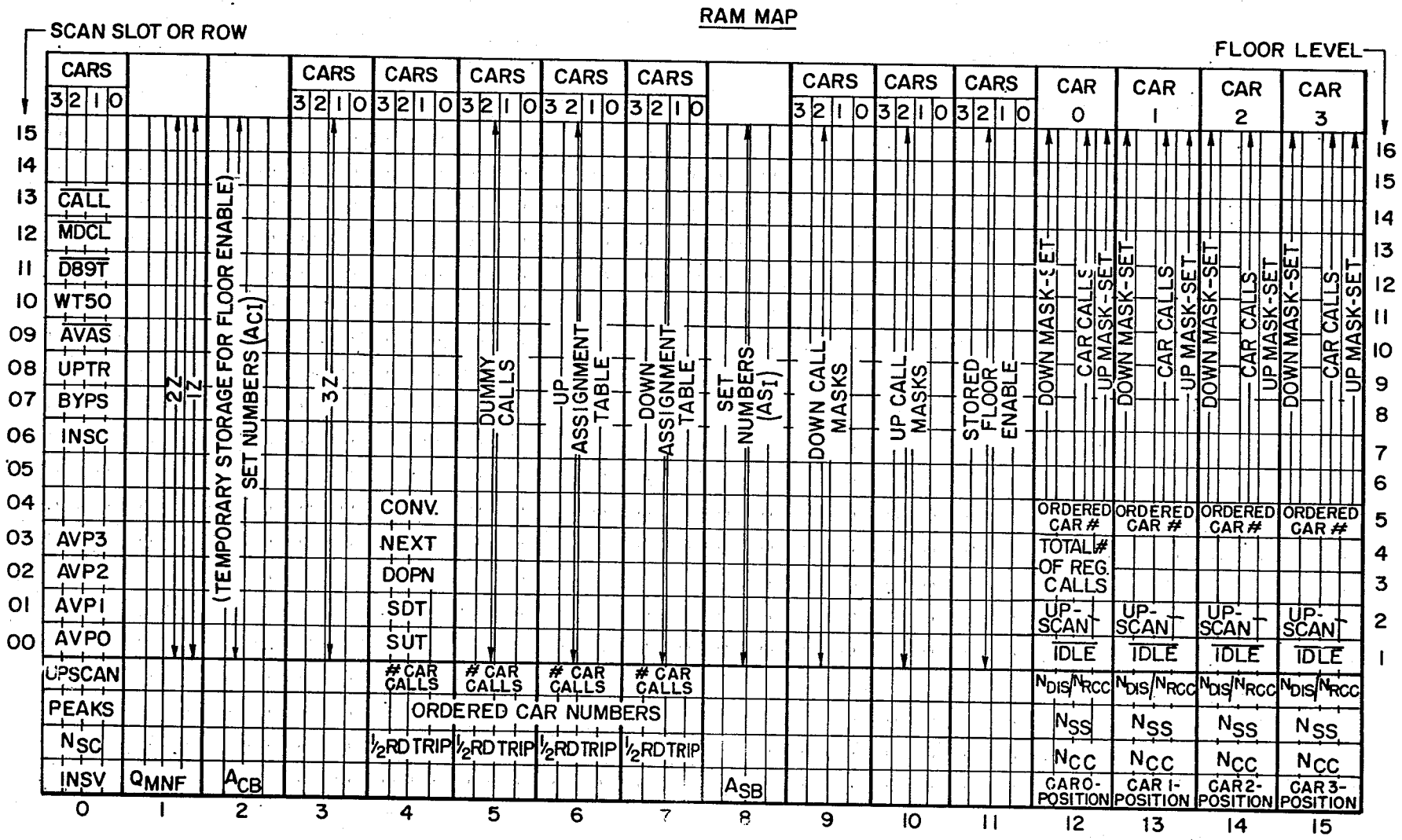
FIG. 5 is a map illustrating the format of sixteen 20-bit registers provided by the RAMS shown in FIG. 4.

FIG. 5 is a RAM map, which diagrammatically illustrates 16 of the registers, 0–15 in the data memory 86. The lower four rows form the status character memories of the registers, while the upper 16 rows, labeled 00–15 form the main memories of the registers. The specific functions of the registers will be hereinafter described as the signals and data stored therein are referred to.

Figure 6:
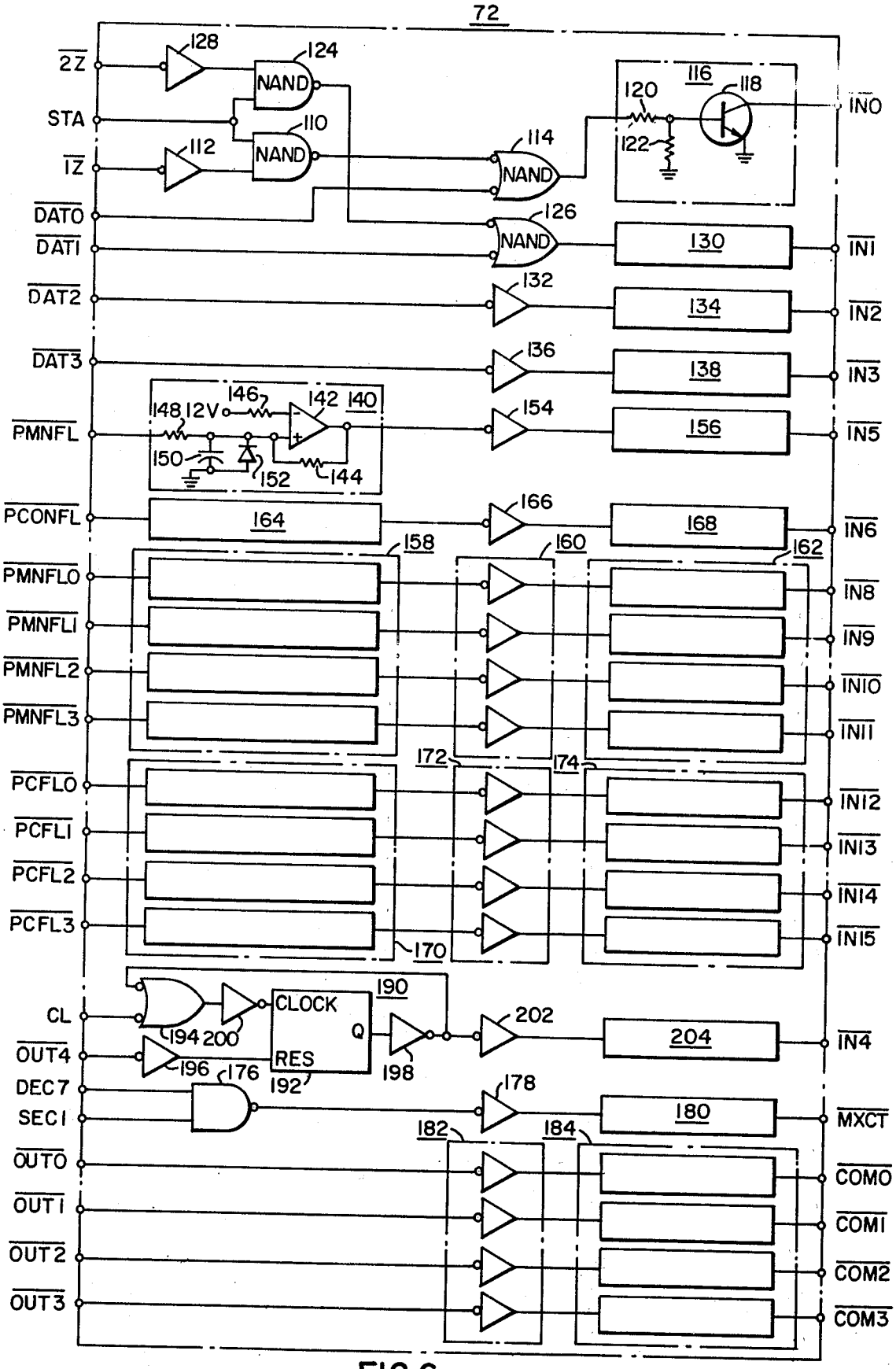
FIG. 6 is a schematic diagram of an interface circuit which may be used for the system processor interface shown in FIG. 1.
Figure 7:
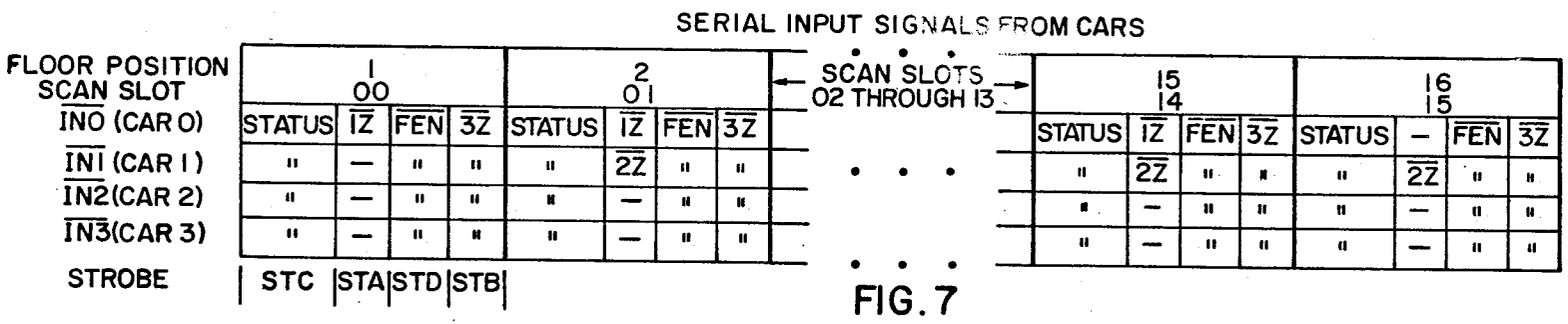
FIG. 7 is a chart illustrating the format of the serial signals from the elevator cars to the system processor, as they appear at the output of the system processor interface circuit shown in FIG. 6.

FIGS. 6 and 7

FIG. 6 is a schematic diagram of a processor interface 72 which may be used for function 72 shown in block form in FIG. 1. Each of the four elevator cars sends its status signals to the system processor 70 of the supervisory system control 22, via the interface 72. The status signals from each car are serialized by multiplexers, as will be hereinafter described relative to FIG. 8B, with these serial signals from elevator cars 0, 1, 2 and 3 being indicated by symbols $\overline{DAT0}$, $\overline{DAT1}$, $\overline{DAT2}$, and $\overline{DAT3}$, respectively.

The up and down hall calls are each serialized in the hall call control 68 shown in FIG. 1, with the serial up and down hall calls being referred to as $\overline{1Z}$ and $\overline{2Z}$, respectively. The serial signals $\overline{DAT0}$, $\overline{DAT1}$, $\overline{DAT2}$, $\overline{DAT3}$, $\overline{1Z}$ and $\overline{2Z}$ are all applied to interface 72. The up hall calls $\overline{1Z}$ and the down hall calls $\overline{2Z}$ are combined with the status signals $\overline{DAT0}$ and $\overline{DAT1}$, respectively, in interface 72. This is accomplished by dividing each of the scan slots 00 through 15 shown in FIG. 2 into 4 parts, using the strobes STC, STA, STD and STB shown in FIG. 3.

FIG. 7 illustrates the format of the signals from the interface 72 to the system processor 70, diagrammatically illustrating how each scan slot is divided into quarters by the strobe signals. Status signals from the cars appear in the first quarter of a scan slot, as strobed by STC. Up hall calls appear in the second quarter of the scan slots of the serial signal $\overline{IN0}$ from car 0, as strobed by STA. Down hall calls appear in the second quarter of the scan slots of the serial signal $\overline{IN1}$ from car 1, also strobed by STA. The second quarter of the scan slots relative to the serial signal from cars 2 and 3 are not used. The hall calls in serial signals $\overline{1Z}$ and $\overline{2Z}$ appear in the scan slot associated with the floors the calls are registered from.

The third quarter of each scan slot, strobed by STD, includes the floor enable signal $\overline{FEN}$. If the car is enabled to serve a floor, signal $\overline{FEN}$ will be true during the scan slot associated with this floor.

The fourth quarter of each scan slot, strobed by STB, includes the car calls $\overline{3Z}$. If a car has a car call for a specific floor, it will be indicated in the fourth quarter of the scan slot associated with this floor.

Referring again to FIG. 6, the serial signals appearing in signal $\overline{1Z}$ are synchronized with strobe STA in a dual input NAND gate 110, with strobe STA connected to one input of the NAND gate, and signal $\overline{1Z}$ connected to the other input via an inverter or NOT gate 112. The serial up calls $\overline{1Z}$ are introduced into serial signal $\overline{DAT0}$ from car 0 in a dual input NAND gate 114, with the output of NAND gate 110 being connected to one input of NAND gate 114 and signal $\overline{DAT0}$ connected the other input. The output of NAND gate 114 is connected to output terminal $\overline{IN0}$ via an inverting buffer 16. Buffer 116 may include an NPN transistor 118, and resistors 120 and 122. The output of NAND gate 114 is connected to the base of transistor 118 via reistor 120, and the base is connected to ground via resistor 122. The collector electrode is connected to output terminal $\overline{IN0}$, and the emitter electrode is connected to ground.

Signal $\overline{DAT0}$ will be high during the second quarter of each scan slot, enabling NAND gate 114. A serial UP call for a scan slot appearing in signal $\overline{1Z}$ will drive the output of NAND gate 110 low during the time of STA and the output of NAND gate 114 will be driven high during each second quarter of a scan slot having a up call present. The high output of NAND gate 114 switches transistor 118 to its conductive state and output terminal $\overline{IN0}$ is connected to ground. If there is no up hall call during a scan slot, the output of NAND gate 110 will be high and the output of NAND gate 114 will be low. Thus, transistor 118 will be in its nonconductive state and output terminal $\overline{IN0}$ will be at +15 volts, as shown in FIG. 4. During the first, third and fourth cycles, strobe STA will be low and the output of NAND gate 110 will be high, enabling NAND gate 114 to pass true signals during these three quarters of a scan slot, which signals appear in signal $\overline{DAT0}$.

In like manner, the down hall calls appearing in serial signal $\overline{2Z}$ are inserted into the second quarter of the scan slots they are associated with, using dual input NAND gates 124 and 126, inverter 128 and buffer 130. Strobe STA is connected to one input of NAND gate 124, and signal $\overline{2Z}$ is connected to the other input, via inverter 128. The output of NAND gate 124 is connected to one input of NAND gate 126, and the serial signal $\overline{DAT1}$ from car 1 is connected to the other input. The output of NAND gate 126 is connected to output terminal $\overline{IN1}$ via buffer 130. Buffer 130 is similar to buffer 116, as are the remaining output buffers in FIG. 6, and hence they are shown in block form.

The serial signal $\overline{DAT2}$ from car 2 is connected to output terminal $\overline{IN2}$ via an inverter 132 and an output buffer 134, and the serial signal $\overline{DAT3}$ is connected to output terminal $\overline{IN3}$ via an inverter 136 and an output buffer 138.

The elevator system 10 may be operated with or without a floor designated as the main floor, with the main floor feature being illustrated by block 74 in FIG. 1. Further, when it is operated with a main floor, any floor of the building may be selected as the main floor by means of a main floor binary number. If the elevator system is operating with a main floor, a predetermined quota is selected which indicates the desired number of cars to be maintained at the main floor, and this quota may be modified automatically by existing traffic conditions. For example, in a 4-car system the main floor quota may be selected to be one, which is modified to two during an up peak condition, and to zero during a down peak condition.

An up peak condition may be detected by a car leaving the main floor in the up direction with a predetermined load, and if the system is not on down peak, this occurrence starts a timer to place the system on up peak for a predetermined period of time. Each subsequent car leaving the main floor set for up travel, set to bypass hall calls, resets the timer to its maximum count, to extend the time the system is on up peak.

A down peak condition may be detected by a car above the main floor generating a bypass signal in the down direction. This occurrence also starts the peak timer, placing the system on down peak for a predetermined time period, overriding up peak if the system should happen to also be in an up peak condition. Each subsequent car which bypasses hall calls in the down direction resets the timer to its maximum count.

The main floor feature is selected by a switch (not shown) connected to input terminal $\overline{PMNFL}$, illustrated in FIG. 6. The switch applies a relatively high voltage to input terminal $\overline{PMNFL}$ when the main floor feature is not desired, and a low voltage or ground level signal when the feature is desired. Input terminal $\overline{PMNFL}$ is connected to a high level input interface 140. Interface 140 may include operational amplifier 142, resistors 144, 146 and 148, a capacitor 150, and a diode 152. Resistor 144 is connected from the output of amplifier 142 to its non-inverting input. Its inverting input is connected to a positive unidirectional voltage supply, such as 12 volts, via resistor 146. Its non-inverting input is connected to input terminal $\overline{PMNFL}$ via resistor 148, to ground via capacitor 150, and to ground via diode 152. Diode 152 is poled to conduct current from ground into the non-inverting terminal. When terminal $\overline{PMNFL}$ is high, indicating the main floor feature is not desired, the voltage at input terminal $\overline{PMNFL}$ exceeds the voltage applied to the inverting input and the output of the operational amplifier 142 will be positive, ie., at the logic one level, which is inverted by an inverter 154 to the logic zero level and applied to an output buffer 156. Buffer 156 inverts the logic zero to a logic one, and applies the logic one to output terminal $\overline{IN5}$. When signal $\overline{PMNFL}$ is true (low) the voltage applied to the inverting input exceeds that applied to the non-inverting input and the output of operational amplifier 142 goes to a logic zero level. Inverter 154 inverts this signal to a logic one, and buffer 156 inverts this to a logic zero, which is the true level for output terminal $\overline{IN5}$.

The binary address of the floor selected as the main floor is applied to input terminals $\overline{PMNFL0}$, $\overline{PMNFL1}$, $\overline{PMNFL2}$ and $\overline{PMNFL3}$. The signals applied to these input terminals are applied to output terminals $\overline{IN8}$, $\overline{IN9}$, $\overline{IN10}$ and $\overline{IN11}$, respectively, each via a high level interface, an inverter, and an output buffer, shown generally at 158, 160 and 162, respectively. The high level input interfaces shown generally at 158, as well as the remaining high level input interfaces shown in FIG. 6, are all similar to interface 140.

The elevator system 10 may be operated with or without a floor designated as a convention floor, as desired, with the convention floor feature being indicated at 76 in FIG. 1. The convention floor may be defined as any floor above the main floor at any time by a binary number. Whenever this feature is present, as initiated, for example, by a manual switch, and there is no car present at the designated floor, a dummy or false call is shown to every car until a car stops at the floor.

The convention floor feature is selected by a switch connected to an input terminal $\overline{PCONFL}$ in FIG. 6. Similar to the signal selecting the main floor feature, signal $\overline{PCONFL}$ is applied to a high level input interface 164, the output of which is inverted by inverter 166, and applied to output buffer 168. The output of buffer 168 is connected to output terminal $\overline{IN6}$.

The binary address of the floor selected as the convention floor is connected to input terminals $\overline{PCFL0}$, $\overline{PCFL1}$, $\overline{PCFL2}$ and $\overline{PCFL3}$. The signals applied to these input terminals are applied to output terminals $\overline{IN12}$, $\overline{IN13}$, $\overline{IN14}$ and $\overline{IN15}$, respectively, each via a high level input interface, an inverter, and an output buffer, shown generally at 170, 172 and 174, respectively.

The signal $\overline{MXCT}$ for CPU 80, hereinbefore referred to, is provided by connecting timing signals DEC7 and SEC1 to the two inputs of a dual input NAND gate 176. Signals DEC7 and SEC1 are both high during the last scan slot, as illustrated in FIG. 2, causing the output of NAND gate 176 to be driven low during this time. The low output of NAND gate 176 is inverted to a logic one by inverter 178 and buffer 180 inverts this to a logic zero. The output of buffer 180 is connected to output terminal $\overline{MXCT}$.

Output terminals $\overline{OUT0}$, $\overline{OUT1}$, $\overline{OUT2}$ and $\overline{OUT3}$ from the data memory 86 shown in FIG. 4 intermittently provide serial data words for the elevator cars 0, 1, 2 and 3, respectively. These data words contain the inhibits and commands which cause the elevator cars to answer calls for elevator service according to the operating strategy of the system processor 70. These output terminals, along with output terminal $\overline{OUT4}$, are connected to the processor interface 72, shown in FIGS. 1 and 6. Additional output terminals from the data memory 86 would be provided for elevator systems having more than 4 cars.

Terminals $\overline{OUT0}$, $\overline{OUT1}$, $\overline{OUT2}$ and $\overline{OUT3}$ are connected to output terminals $\overline{COM0}$, $\overline{COM1}$, $\overline{COM2}$ and $\overline{COM3}$, respectively, each through an inverter and an inverting output buffer, shown generally at 182 and 184, respectively.

Output terminal $\overline{OUT4}$, is used to start an external timer 190, with input terminal $\overline{IN4}$ going low when the timer times out. Timer 190 includes a counter 192, such as RCA's CD4024 binary counter, a dual input NAND gate 194, and inverters 196, 198 and 200. Terminal $\overline{OUT4}$ is connected to the reset input RES of counter 192 via inverter 196. An input terminal CL is connected to one input of NAND gate 194, and the output of NAND gate 194 is connected to the clock input CLOCK of counter 192 via inverter 200. An output Q of the counter 192 is connected to output terminal $\overline{IN4}$ via inverter 198, an inverter 202, and an inverting buffer 204. The output Q of counter 192 is also connected to the remaining input of NAND gate 194 via inverter 198. Input terminal CL is connected to receive a timing signal CL from the timing function 78. The frequency of the signal CL and output of the counter are selected such that the output will go high at the end of the desired time interval.

When the system control wishes to start timing something it provides a low signal at output terminal $\overline{OUT4}$ which resets the timer to zeros and the high output of inverter 198 unblocks NAND gate 194. NAND gate 194 thus applies clock pulses to the clock input of counter 192 via inverter 200. Counter 192 is advanced one count on the negative going transition of each input pulse. While the counter 192 is active, the selected output terminal of counter 192 will be low, and terminal $\overline{IN4}$ will be high. When timer 190 reaches the selected count the output of counter 192 will go high, and terminal $\overline{IN4}$ will go low. When this selected count is reached, the output of inverter 198 will go low, which blocks NAND gate 194 from passing any further pulses from the CL input terminal to the clock input of the counter 192, until the system control resets the counter by driving terminal OUT4 low.

FIG. 8

Each of the per car interfaces 28, 34, 40 and 46 shown in FIG. 1 are of like construction, and thus only the per car interface 28 for car 0 will be described. For convenience in describing interface 28, it is divided into the interface function shown in FIG. 8A, which function handles the flow of information from the supervisory system control 22 to the floor selector 26 and the interface function shown in FIG. 8B which handles the flow of information from the floor selector 26 to the supervisory system control.

The interface function from the supervisory system control to the floor selector of each car is critically important when using a microprocessor, as the floor selector operates in a synchronous or continuous mode, ie., requires continuous control signals from the supervisory system control, while the microprocessor operates in an asynchronous or batch type mode with limited memory capacity and operating speed. The microprocessor prepares the data words for each of the elevator cars, sends them to the various car controllers, and then goes about other tasks such as reading the status signals from the various cars and preparing new command words for the cars based on the latest information received from the cars.

The floor selector 26 operates in a serial mode, synchronized by the scan slots provided by timing signals S0S-S3S, and the commands from the supervisory system control 22 must appear in the proper scan slots each time the continuously counting counter S0S-S3S counts through the scan slots of the scan cycle. Failure to provide a command or inhibit signal from the supervisory system control 22 during a scan slot causes the supervisory system control to lose its overriding control and each car automatically operates on the strategy of its individual car control. The car control strategy is to answer all calls ahead of its travel direction, and when there are no further calls ahead, it will answer all calls in the opposite direction until there are no further calls in this direction. A hall call above or below an idle car sets it for the proper travel direction to answer the call.

Figure 8C:
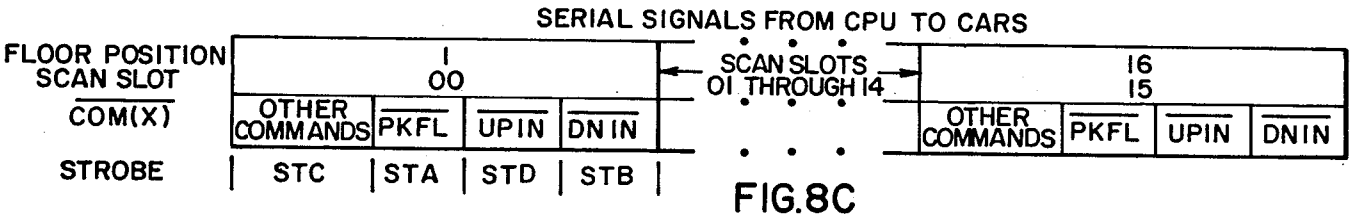
FIG. 8C is a chart illustrating the format of the serial signals from the supervisory system control to each of the elevator cars.
Figure 8A:
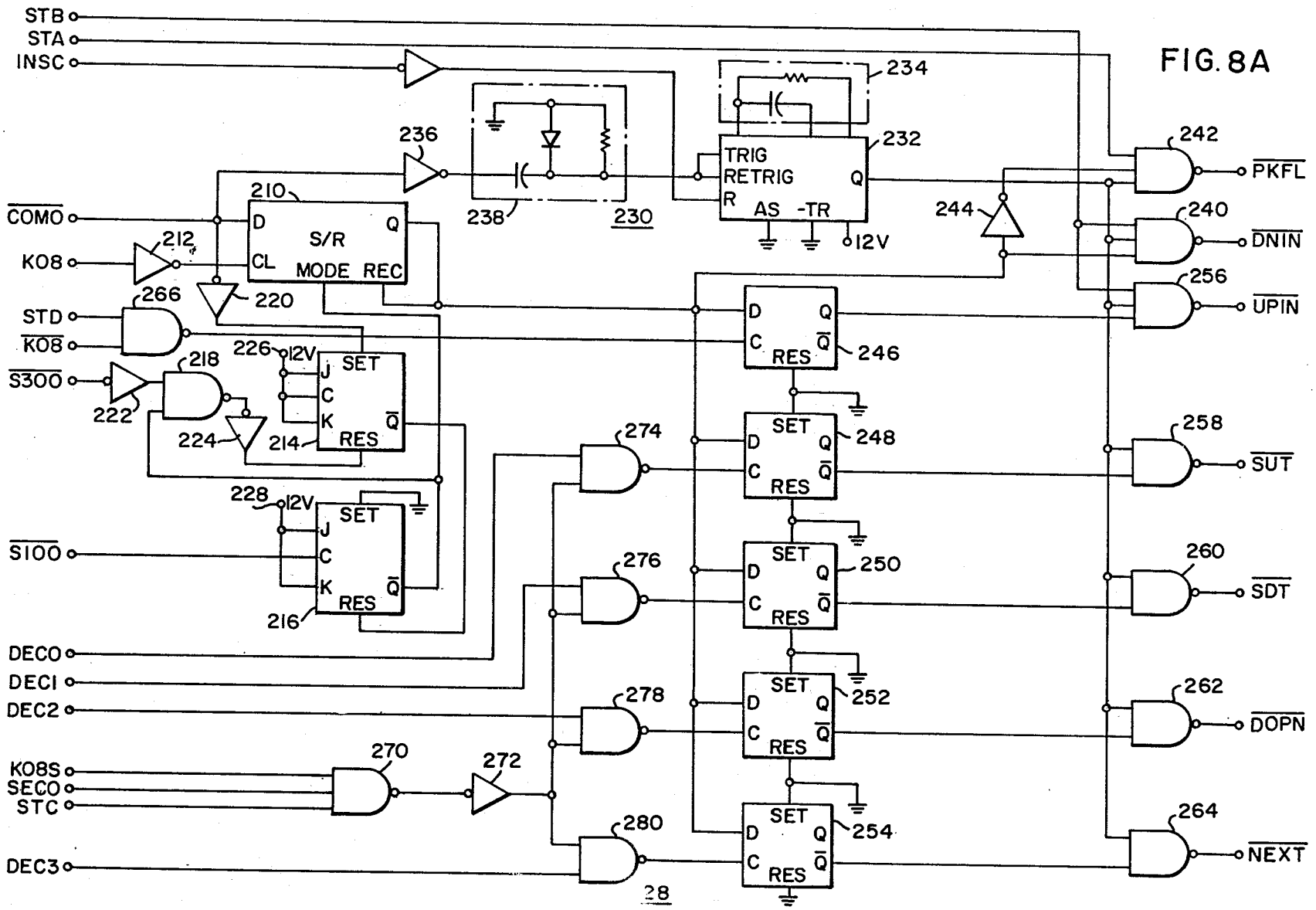
FIGS. 8A and 8B are schematic diagrams of interface circuits constructed according to the teachings of the invention which may be used for each elevator car interface circuit shown in block form in FIG. 1.

The interface 28 shown in FIG. 8A solves the interfacing problem between the supervisory system control 22 and the car call control by storing the serial data word received from the supervisory system control and repetitively and serially reading out the stored data word to its associated car control means. The serial data word is stored in a constantly scanned, serially accessed memory which reads out and recirculates the data until a new data word is received. When the new data word is received the mode of the serially accessed memory is changed from the recirculation mode to allow the new data word to enter the memory. This is accomplished without a separate read line from the supervisory system control, and without interrupting the serial timed flow of commands from the serially accessed memory to the floor selector. When the new data word is completely within the serially accessed memory, the memory mode automatically switches back to the recirculation mode to retain this new word until the next data word is received.

More specifically, the serially accessed memory may be in the form of a shift register 210, such as RCA's CD4031, which has a data input D, a clock input CL, a mode input MODE, a recirculating input REC and an output Q. The serial command word $\overline{COM0}$, which is intermittently sent from the system control 22 is applied to input terminal $\overline{COM0}$, and input terminal $\overline{COM0}$ is connected to the data input D of the shift register 210. Timing signal KO8 is connected to the clock input CL of the shift register 210 via an inverter 212. As illustrated in FIG. 3, signal KO8, inverted, has a positive going transition at the start of each quarter of a scan slot. When the input terminal MODE of shift register 210 is low, the logic level at the data input D is transferred into the first stage of the shift register at each positive going transition of $\overline{KO8}$. Thus, shift register 210 is clocked four times during each scan slot, enabling 4 bits of information to be contained in each scan slot similar to the serial input signal from each car to the supervisory system control shown in FIG. 7. FIG. 8C illustrates the format of the serial signals from the supervisory system control 22 to each of the cars. The command words which are not floor related are contained in the first quarter of each scan slot. For example, the command signal $\overline{SUT}$, which requests that the floor selector of the car be set for up travel, may be sent in scan slot 00; the command $\overline{SDT}$, which requests that the floor selector of the car be set for down travel, may be sent in scan slot 01; the command $\overline{DOPN}$ which requests a car to open its doors, may be sent in scan slot 02; and the command $\overline{NEXT}$, which notifies a car that it is to be the next car to leave the main floor, may be sent in scan slot 03.

The floor related signals $\overline{PKFL}$, $\overline{UPIN}$ and $\overline{DNIN}$ may be sent during any scan slot associated with a floor which the elevator car is enabled to serve. A true signal $\overline{PKFL}$ is sent to a car when the system control 22 gives the car a command to park at a specific floor, with the signal appearing in the second quarter of the scan slot associated with the floor at which the car is to park. A true signal $\overline{UPIN}$ is sent to the floor selector of a car for those floors which the elevator car is capable of providing up service from, but which the system control wishes to block up hall calls registered therefrom from being considered by the car. In like manner, a true signal $\overline{DNIN}$ is sent to a car for those floors which the elevator car is capable of providing down service from, but which the system control wishes to block down hall calls registered therefrom from being considered by the car. Thus, to assign a down call from floor 6 to car 0, for example, the supervisory system control 22 would send true $\overline{DNIN}$ signals to cars 1, 2 and 3 in the fourth quarter of scan slot 05, which is associated with floor position 6.

When input MODE of shift register 210 is high, the recirculating input REC is enabled, and the output Q is clocked back into the shift register 210.

The system control 22 could directly control the MODE input of shift register 210, but this would require another conductor from the supervisory system control 22 to each car, as well as adding to the strategy program, increasing the demands on a memory which is of limited capacity. Further, the system processor 22 is relatively slow, and the requirement of sending a serial data word along with a separate signal which must precisely load the word into the dynamic memory without interrupting the serial output of the memory, and without losing any bits of the transmission, may be too severe.

The arrangement of FIG. 8A solves the problem of precisely loading the data word from the system control 22 into the shift register 210, using only one conductor from the supervisory system control 22 to each car, and without danger of losing data bits, by using the format of the data word to control the mode control function.

More specifically, the mode control function is performed by first and second J-K flip-flops 214 and 216, respectively, such as RCA's CD4027, a dual input NAND gate 218, and inverters 220, 222 and 224. Input terminal $\overline{COM0}$ is connected to the set input of the first J-K flip-flop 214, via inverter 220. The J, C and K inputs of flip-flop 214 are connected to a source of unidirectional potential at terminal 226. Timing signal $\overline{S300}$, shown in FIG. 3, which is true only during a portion of the third quarter of scan slot 00, is connected to a input of NAND gate 218 via inverter 222. The output of NAND gate 218 is connected to the reset input of flip-flop 214 via inverter 224.

The set input of the second J-K flip-flop 216 is connected to ground. The J and K inputs of flip-flop 216 are connected to a source of unidirectional potential at terminal 228. The clock input is connected to receive timing signal $\overline{S100}$, which is true only during a portion of the first quarter of scan slot 00. The reset input of flip-flop 216 is connected to the $\overline{Q}$ output of flip-flop 214. The $\overline{Q}$ output of flip-flop 216 is connected to the remaining input of NAND gate 218, and also to the input MODE of the shift register 210.

In the operation of the mode control, it will be assumed that the $\overline{Q}$ output of flip-flop 216 is at the logic one level, which places shift register 210 in the recirculating mode. The high $\overline{Q}$ output from flip-flop 216 enables NAND gate 218, and timing signal $\overline{S300}$ resets flip-flop 214. Thus, the $\overline{Q}$ output of flip-flop 214 is maintained high, which in turn insures that the $\overline{Q}$ output of flip-flop 216 remains high to keep the shift register 210 in the recirculate mode.

When the supervisory system control 22 wishes to send a data word to the cars, it detects the negative going transition of timing signal $\overline{MXCT}$ (see FIG. 2), and sends a leading zero to each car during $\overline{MXCT}$, followed by the data word. The leading zero on the data stream is inverted to a logic one by inverter 220, setting flip-flop 214 to provide a low $\overline{Q}$ output. Flip-flop 216 now has a low signal at its reset input, which "unlocks" this flip-flop. Timing signal $\overline{S100}$, which occurs in the central portion of the first quarter of scan slot 00 triggers flip-flop 216 into its opposite state, and thus its $\overline{Q}$ output goes low enabling the data input D of shift register 210, and blocking NAND gate 218 from passing timing signal $\overline{S300}$. Clock KO8 thus clocks the four bits of data in each of the 16 scan slots into the 64 stage shift register 210. On the positive going transition of the next timing signal $\overline{S100}$, flip-flop 216 is triggered into its opposite state, driving its $\overline{Q}$ output high. This high output enables the recirculate mode of shift register 210 before the end of the first quarter of scan slot 00, to recirculate the new data word until the next data word is received. The high $\overline{Q}$ output of flip-flop 216 also enables NAND gate 218 so the timing signal $\overline{S300}$ resets flip-flop 214, applying a logic one to the reset input of flip-flop 216 to prevent subsequent timing signals $\overline{S100}$ from triggering flip-flop 216 until the next command data word is received from the system control 22.

In order to remove each car from indefinite control by the system processor's last command word, should the system processor fail to provide further signals, and to remove each car from control by an erratic system processor which is not providing command words within a preset time interval, the command words are monitored by timing means 230. Timing means 230 may include a multivibrator 232, such as RCA's CD4047A, connected such that is Q output remains high as long as the input pulse period is shorter than the timing period determined by the RC components of timing means 234.

The input pulse which triggers the multivibrator 232, and retriggers it to keep the CL output high is the leading zero on the serial signal $\overline{COM0}$. Input terminal $\overline{COM0}$ is connected to the trigger and retrigger inputs TRIG and RETRIG, respectively of multivibrator 232 via an inverter 236 and an A.C. coupler 238. The A.C. coupler prevents multivibrator 232 from having its input stuck in the high state. The high Q output of multivibrator 232 enables command signals to be sent from the supervisory system control 22 to the cars. Should the multivibrator 232 time out before receiving a command data word, the Q output goes low to inhibit all signals from the supervisor system control 22 to the cars, and the cars then operate independently according to their individual car control strategy, with each car being enabled for all hall calls.

The serial command word from the supervisory system control 22 appearing at the Q output of shift register 210 is connected to an input of a three input NAND gate 240, to an input of a three input NAND gate 242 via an inverter 244, and to the D inputs of D-type flip-flops 246, 248, 250, 252 and 254, such as RCA's CD4013. The Q output of flip-flop 246 is connected to an input of a three input NAND gate 256. The $\overline{Q}$ outputs of flip-flops 248, 250, 252 and 254 are connected to an input of dual input NAND gates 258, 260, 262 and 264, respectively. The Q output of multivibrator 232 is connected to an input of each of the NAND gates 240, 242, 256, 258, 260, 262 and 264, enabling these gates as long as the supervisory system control 22 is operating in a timely manner.

Strobe STA, which occurs during the second quarter of each scan slot, is connected to the remaining input of NAND gate 242. The output of NAND gate 242 is connected to output terminal $\overline{PKFL}$, providing a true signal $\overline{PKFL}$ in the second quarter of those scan slots which contain a true parking command from the system control 22.

Assignments from the system control 22 are low true in serial signal $\overline{COM0}$, and since the inhibit signals $\overline{UPIN}$ and $\overline{DNIN}$ are low when a car is inhibited from seeing a hall call at the associated floor, the system control 22 makes assignments of floors to a car with high signals $\overline{UPIN}$ and $\overline{DNIN}$. Thus, a low true assignment signal in $\overline{COM0}$ must provide a high $\overline{UPIN}$ or $\overline{DNIN}$ signal.

More specifically, strobe STB, which occurs during the last quarter of each scan slot, is connected to the remaining input of NAND gate 240. The output of NAND gate 240 is connected to output terminal $\overline{DNIN}$, providing a high down inhibit signal $\overline{DNIN}$ in the last quarter of those scan slots which contain a true (low) assignment signal from the system control 22. Floors which are not assigned to the car will have a high signal in the last quarter of their associated scan slots, providing true inhibit signals $\overline{DNIN}$ for those floors.

Timing signal $\overline{KO8}$ and strobe STD are connected to the two inputs of a of a dual input NAND gate 266, and the output of NAND gate 266 is connected to the clock input C of flip-flop 246. The output of NAND gate 266 will be low for the first portion of the third quarter of each scan slot, clocking the data appearing at the D input during the positive going transition of the clock pulse to the Q output. If the up service direction from the floor associated with a scan slot is not assigned to the car associated with signal $\overline{COM0}$, the D input of flip-flop 246 will be high during the third quarter of the scan slot and the Q output of flip-flop 246 will be driven high. If the up service direction from the floor associated with a scan slot is assigned to this car, the D input of flip-flop 246 will be low during the third quarter and the Q output of flip-flop 246 will be low. Flip-flop 246 is used to store the up inhibit or assignment so it can be presented to the floor selector 26 simultaneously with down inhibit or assignment for each scan slot. Since the down assignment was strobed with strobe STB, NAND gate 256, which provides up assignments, is also strobed with STB. If the floor of the associated scan slot is not assigned to this car the Q output of flip-flop 246 will be high when the fourth quarter of the scan slot starts, to drive the output of NAND gate 256 low and provide a true up inhibit signal UPIN during the fourth quarter of the associated scan slot. If the floor of the associated scan slot is assigned to this car, the Q output of flip-flop 246 will be low at the start of the fourth quarter of the associated scan slot and the output of NAND gate 256 will be driven high, enabling the car to see an up hall call at this floor.

The remaining commands $\overline{SUT}$, $\overline{SDT}$, $\overline{DOPN}$ and $\overline{NEXT}$ from the system control 22 are not floor related and are inserted into the first quarter of scan slots 00, 01, 02 and 03, respectively. Further, once one of these commands is received it should persist until the command is again received one full cycle later, and not just during the scan slot in which the command was sent.

The first command, $\overline{SUT}$, which requests that the floor selector 26 be set for up travel, is picked out of the first quarter of scan slot 00 by flip-flop 248 and by timing means which includes a three input NAND gate 270, an inverter 272 and a dual input NAND gate 274. Timing signals KO8S and SEC0 and strobe STC are applied to the three inputs of NAND gate 270. These signals will all be high during the central portions of scan slots 00 through O7 driving the output of NAND gate 270 low during this time, which low signal is converted to a high signal by inverter 272. Scan slot 00 is picked out of scan slots 00 through 07 by timing signal DEC0 which is high only during scan slots 00 and 08 of each scan cycle. The output of inverter 272 and timing signal DEC0 are applied to the two inputs of NAND gate 274, and the output of NAND gate 274 is connected to the clock input C of flip-flop 248. If the system control 22 is requesting that the floor selector 26 be set for up travel, the first quarter of scan slot 00 will be low, and thus the D input of flip-flop 248 will be low during this time. This low signal is clocked to output Q. Thus, output Q, which is connected to an input of NAND gate 258, will be driven high, causing the output of NAND gate 258 to be driven low, providing a true signal $\overline{SUT}$. Since flip-flop 248 will not be clocked again until the next scan slot 00, the signal appearing at output terminal $\overline{SUT}$ will presist until the logic level in the first quarter of scan slot 00 is again examined.

The command $\overline{SDT}$ from the system control 22 requesting that the floor selector 26 be set for down travel is picked from the first quarter of scan slot 01 by a dual input NAND gate 276 having one input connected to the output of inverter 272 and an input connected to timing signal DEC1. The output of NAND gate 276 is connected to the clock input C of flip-flop 250, the $\overline{Q}$ output of flip-flop 250 is connected to an input of NAND gate 260, and the output of NAND gate 260 provides command $\overline{SDT}$.

The command $\overline{DOPN}$ from the system control 22 requesting that the doors of the car be open, is picked from the first quarter of scan slot 02 by a dual input command gate 278 having one input connected to the output of inverter 272, and an input connected to timing signal DEC2. The output of NAND gate 278 is connected to the clock input C of flip-flop 252, the $\overline{Q}$ output of flip-flop 252 is connected to an input of NAND gate 262, and the output of NAND gate 262 provides command $\overline{DOPN}$.

The command $\overline{NEXT}$ from the system control 22, designating the car as the next car to leave the main floor, is picked from the first quarter of scan slot 03 by a dual input NAND gate 280 having an input connected to the output of inverter 272 and an input connected to timing signal DEC3. The output NAND gate 280 is connected to the clock input C of flip-flop 254, the $\overline{Q}$ output of flip-flop 254 is connected to an input of NAND gate 264, and the output of NAND gate 264 provides signal $\overline{NEXT}$.

Figure 8B:
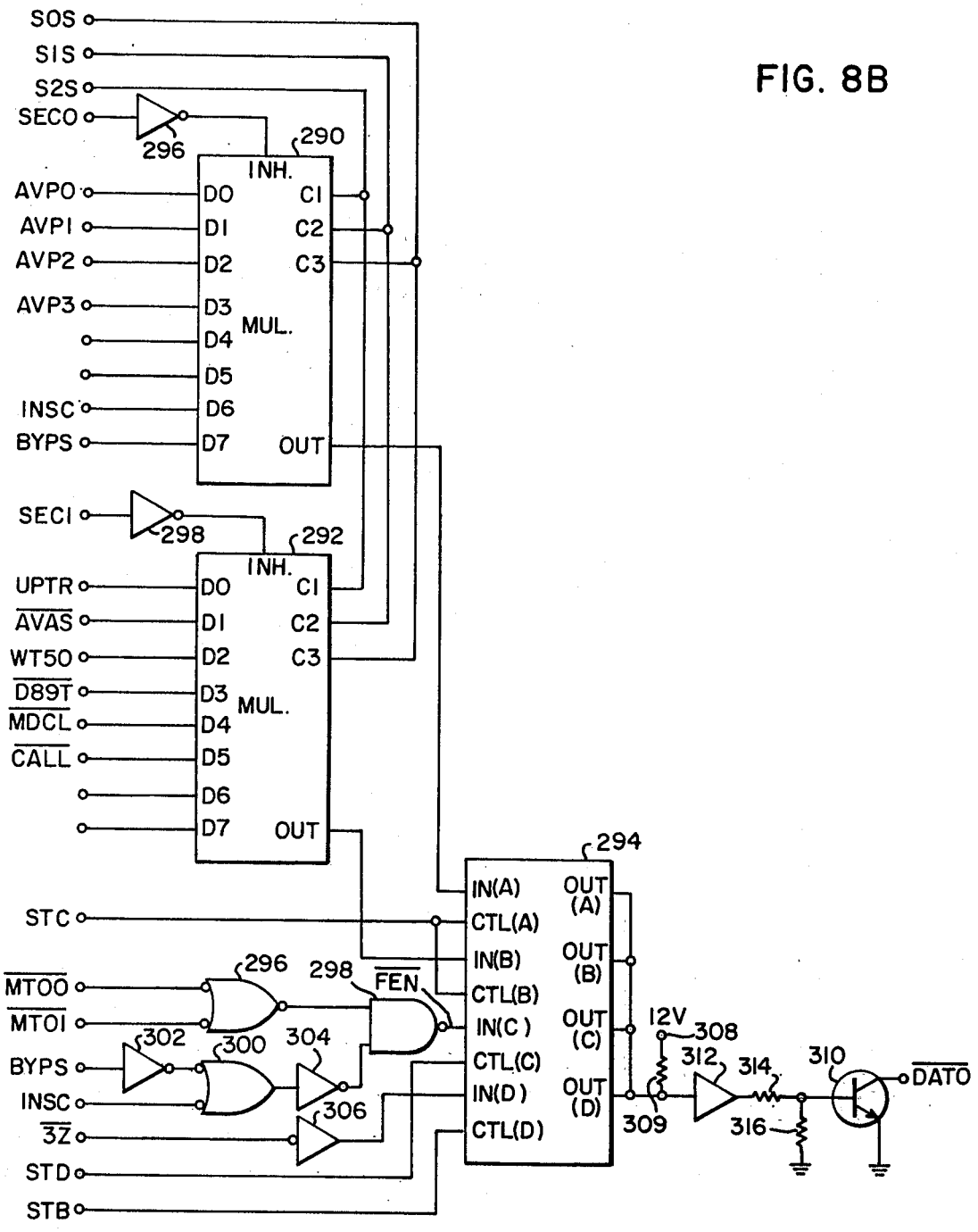

The portion of interface 28 which relates to information flow from the floor selector 26 to the system control 22 is shown in FIG. 8B. The floor selector 26 provides status signals AVP0–AVP3, INSC, BYPS, UPTR, $\overline{AVAS}$, WT50, $\overline{D89T}$, $\overline{MDCL}$, and $\overline{CALL}$, which, when received by the system control, are stored in RAMO shown in FIG. 5. The floor enable signals $\overline{FEN}$ and car calls $\overline{3Z}$, are stored in RAM2 and RAM3, respectively, shown in FIG. 5. Signals AVP0–AVP3 provide the binary address of the floor at which a stationary car is standing, and when the car is moving it provides the binary address of the closest floor at which the car could make a normal stop. Signal INSC is true when the car is in-service with the system control 22. Signal BYPS is true when the car is set to bypass hall calls. For example, when a down travelling car becomes loaded, it will bypass hall calls on its way to the main floor. Also, when a car at the main floor becomes loaded, it will bypass up hall calls. In both situations, the car will issue a true BYPS signal. Signal UPTR is high or true when the car is set for up travel, and low when the car is set for down travel. Signal $\overline{AVAS}$ is true when the car is in-service, it has answered all of its calls, and is standing at a floor with its doors closed. Thus, the NEXT car, which normally stands at the main floor with its door open and up hall lantern lit, is not considered an AVAS car. Signal WT50 is true when the weight of the load in the elevator car exceeds 50% of its rated load. Signal $\overline{D89T}$ is true when the motor generator set which provides electrical power for the elevator drive motor is shut down. Signal $\overline{MDCL}$ is true when the car doors are closed, and signal $\overline{CALL}$ is true when the elevator car has a car call registered.

System control 22 may be applied to any structure without requiring the system control to be specifically tailored to the building configuration, or to be initially designed with the knowledge of which cars are capable of serving the various floors. All of this information is applied to the system control 22 in the form of signals from the car control 14. This is an important feature which adds significantly to the universality aspect of the system control 22. Signals $\overline{MTO0}$ and $\overline{MTO1}$ are serial signals which may be provided by a read-only memory track in the car control 14, and they are true in the scan slots associated with floors which the car is enabled to serve calls for service in the up and down directions, respectively. Signal $\overline{3Z}$ is a serial, floor related signal which is true during the scan slots associated with floors for which the car has a registered car call.

Multiplexers 290 and 292, such as RCA's CD4051A, and a quad switch 294, such as RCA's CD4016Ad used as a gate, are used to provide the serial signal $\overline{DATO}$. Multiplexers 290 and 292 are used to insert the non-serial signals into scan slots, while the quad bilateral switch 294 multiplexes the serial outputs of the multiplexers 290 and 292 with the already serialized floor enable signal $\overline{FEN}$ and car call signal $\overline{3Z}$.

Multiplexer 290 is enabled for the first 8 scan slots of the 16 scan slot cycle by connected timing signal SEC0 to the inhibit input via an inverter 296, and multiplexer 292 is enabled for the last 8 scan slots of a scan cycle by connecting timing signal SEC1 to the inhibit input of multiplexer 292 via an inverter 298. The data inputs D0 through D7 of multiplexers 290 and 292 are connected to receive the signals to be multiplexed, and their control inputs C1, C2 and C3 are connected to the timing signals S0S, S1S and S2S. As the binary address applied to the control inputs changes, a different one of the data inputs is connected to the output OUT. As illustrated in FIG. 8B, the advanced car position signals AVP-0–AVP3, the in-service signal INSC and the by-pass signal BYPS are connected to data inputs of multiplexer 290, and the travel direction signal UPTR, the availability signal $\overline{AVAS}$, the car load signal WT50, the motor-generator shut down signal $\overline{D89T}$, the door signal $\overline{MDCL}$, and the car call signal $\overline{CALL}$ are connected to to data inputs of multiplexer 292. The output of multiplexer 290 is connected to the input associated with switch A of the quad bilateral switch 294, and the output of multiplexer 292 is connected to the input associated with switch B of quad bilateral switch 294. The control inputs for switches A and B are connected to strobe STC, to place the status signals into the first quarter of their associated scan slots, as shown in FIG. 7.

The floor enable signals $\overline{MTO0}$ and $\overline{MTO1}$ are combined to provide a master floor enable signal $\overline{FEN}$, which also takes into consideration whether the car is in-service (INSC) with the system control 22, and whether or not the car is by-passing halls (BYPS). These signals are combined by NAND gates 296, 298 and 300, and inverters 302 and 304. Signals $\overline{MTO0}$ and $\overline{MTO1}$ are connected to the inputs of NAND gate 296 which is a dual input gate, and the output of NAND gate 296 is connected to an input of NAND gate 298, which is also a dual input NAND gate. The output of NAND gate 298, which provides signal $\overline{FEN}$, is connected to the input of quad bilateral switch 294 for switch C. Signal INSC is connected to an input of NAND gate 300, which is a dual input NAND gate, and signal BYPS is connected to the other input of NAND gate 300 via inverter 302. The output of NAND gate 300 is connected to the remaining input of NAND gate 298 via inverter 304. The output of NAND gate 298 will be low if the car is an in-service car which is not by-passing hall calls and is enabled to serve hall calls for at least one service direction from the floor associated with the scan slot being considered. Strobe STD is connected to the control input for switch C, causing the master floor enable signal $\overline{FEN}$ to be inserted into the third quarter of each scan slot.

Serial car calls $\overline{3Z}$ are connected to the data input for switch D of quad bilateral switch 294, via inverter 306, and the control input for switch D is connected to strobe STB, which inserts the car call calls into the fourth quarter of the scan slots.

The outputs of switches A, B, C and D of quad bilateral switch 294 are connected in common, and the common output connection is connected to a source of unidirectional potential at terminal 308, via a resistor 309. The common output connection is also connected to the base of an NPN transistor 310 via a non-inverting buffer 312, such as RCA's CD4050AD and a resistor 314. The base of transistor 310 is also connected to ground via a resistor 316. The emitter of transistor 310 is connected to ground, and the collector is connected to output terminal $\overline{DAT0}$, which provides the serial data signal for the processor interface 72.

FIG. 9

Figure 9:
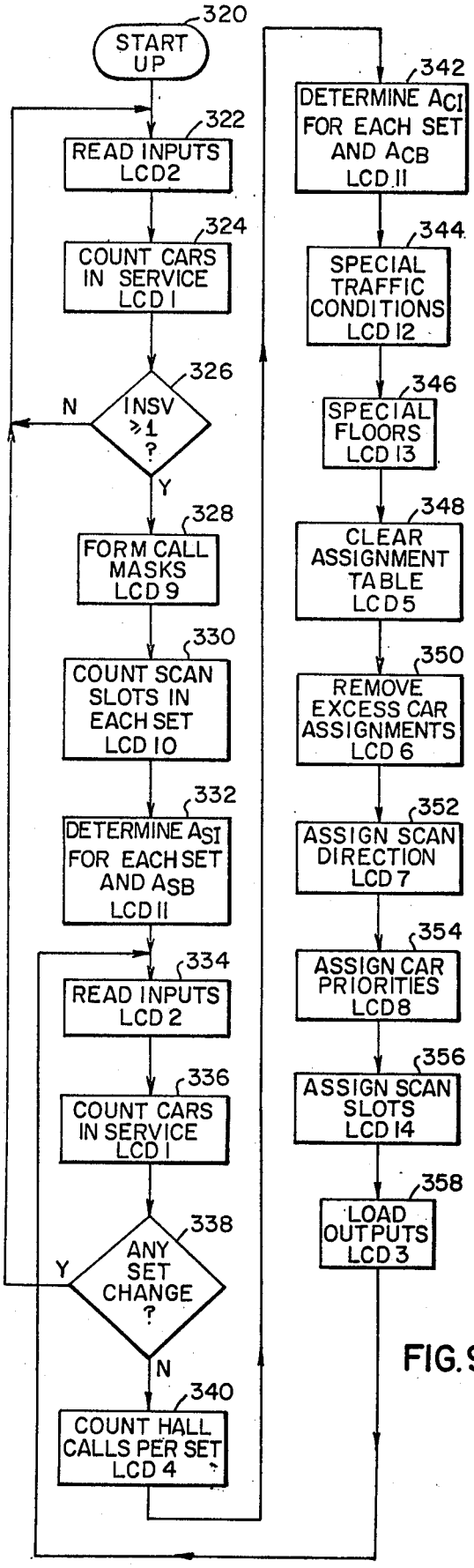
FIG. 9 is a flow chart which illustrates group supervisory strategy for controlling a plurality of elevator cars.

FIG. 9 is a block diagram which broadly sets forth new and improved group supervisory strategy for controlling the bank of elevator cars to answer calls for elevator service according to the teachings of the invention. The system shown in FIG. 9 outlines a program for implementing the strategy of the invention, with each of the blocks shown in FIG. 9 being fully developed in the flow charts of FIGS. 11 through 23. The flow charts of FIGS. 11 through 23 are programmers flow charts, which, when taken with the remaining figures, the specification, and a user's manual for a microprocessor, provide sufficient detail for a programmer of ordinary skill to write the necessary instructions to program the microprocessor. However, a program listing illustrative of a specific embodiment of the invention is included in the concurrently filed co-pending application Ser. No. 574,829, filed May 5, 1975. This program listing is hereby incorporated into this application by reference. The blocks of FIG. 9 also include an LCD identification number which refers to sub-programs shown in the flow charts of FIGS. 11 through 23.

In general the new and improved group supervisory strategy is universal in character, enabling it to be applied without significant modification to any building. The system processor is completely dependent upon information from the various car controllers as to what each car is capable of doing. The system processor uses this information to set up the specific building configuration which presently exists, i.e., which cars are in service and which floors and service directions therefrom these in-service cars are enabled to serve. The system processor then applies its universal strategy to this configuration.

The universal strategy attempts to evenly distribute, among all in-service cars, the actual work load, as well as the work load which may arise between assignments. The distribution of this actual and possible work load is based upon certain dynamic averages calculated just prior to the making of assignments.

The assignments are primarily "hall button" oriented, rather than "hall call" oriented, at least until the hall calls "assigned" to a car because of the assignment of hall buttons meets one of the applicable dynamic averages. Each hall call button is effectively assigned a scan slot, and these scan slots are assigned to the cars according to the universal strategy. The elevator system is a serial, time multiplexed arrangement in which the scan slots for the floors are taken in turn.

The assignment of scan slots to the various cars is not made on the basis of an inflexible block of adjacent floors, normally associated with the zone concept, it is not made on the basis of a flexible block of adjacent floors normally associated with the floating zone concept between action cars, and it is not a random operation. The assignment of scan slots is built into a predetermined priority structure which includes:

(1) the clearing of certain scan slot assignments before each assignment process;

(2) the assignment of scan slots in a general order based upon the floors served by the same combination of cars, with each such group being called a "set";

(3) the assignment of the scan slots of the sets in a plurality of assignment passes, changing the limitations applied and controlling dynamic averages on each pass, with the limitations and dynamic averages including those which are set oriented, as well as building oriented;

(4) the assignment of scan slots to the cars enabled for each set according to a dynamic car priority order, calculated prior to each assignment process on the basis of actual work load, as well as considering such factors as whether or not the car has the NEXT assignment, and if the motor-generator set associated with a car is shut down due to a predetermined period of inactivity;

(5) the assignment of scan slots to the cars, starting from the cars in a predetermined direction, with the predetermined direction for a busy car being its travel direction and with the predetermined direction for an available car being based upon the currently existing traffic condition and the assignment directions for the busy cars;

(6) the assignment of scan slots to busy cars with the limitation that the associated floors are within a predetermined travel distance from the car, as opposed to physical separation; and (7) assigning scan slots to in-service idle cars without the travel distance limitation of (6).

The description of the assignment process refers to the assignment of scan slots to the cars. The scan slots are each associated with a different hall call pushbutton, and the hall call pushbuttons are related to directions from the floors that traffic located at the floors desires to travel. Thus, the assignment of scan slots to the cars may be considered to be the assignment of landings, and service directions therefrom, to the cars, or briefly, the assignment of service directions from landings to the cars. It should be noted that the term "service direction", when applied to landings in the assignment process, refers to the direction from the floor that traffic at the floor desires to travel, and is not related to the setting of the service directions for the various elevator cars.

More specifically, start-up of the elevator system 10 shown in FIG. 1 is indicated at terminal 320. Step 322 reads the input signals $\overline{IN0}$ through $\overline{IN3}$ applied to the input port of the control memory 82 (FIG. 4) from the various cars, and stores the signals in the data storage memory 86. Step 324 counts the number of elevator cars which are in-service with the system control 22 ($N_{SC}$), and step 326 determines if there are at least two cars under the control of the system control 22. If not, there is no need for group supervisory control and the program loops back to step 322. The program remains in this loop until at least two cars are in-service with the system control 22. Without group supervisory control, the cars are enabled to see all hall calls and they will answer calls for elevator service according to the strategy built into their individual car controllers, as hereinbefore described.

If step 326 finds there are least two or more cars in-service with the system control 22, the program advances to step 328 which forms down and up call masks. The down and up call masks are stored in the main memory of RAMS 9 and 10, respectively, of the data storage memory 86. When RAMS 0–15 are referred to, it will be helpful to check the RAM number in the RAM map of FIG. 5. RAMS 9 and 10 essentially display the up and down floor enable signals MT01 and MT00, respectively, indicating, for each car, the floors and directions therefrom which may be served by the car. Thus, if the binary word of RAM 10, which corresponds to floor level 15 is 0111, for example, it would indicate that only cars 0, 1 and 2 are able to serve an up hall call from floor level 15. It will be noted that this arrangement preserves the universality of the program, making it applicable to any building configuration, as the program obtains the information as to the building configuration from the cars, and then stores the building configuration for reference until a change occurs.

Step 330 counts the scan slots in each set as well as the total number of scan slots in the building and stores these sums for future references. Each hall call pushbutton is assigned a scan slot. Thus, in a building with 16 levels, the first and sixteenth levels would have 1 scan slot, and the intervening 14 floors or levels would each have 2 scan slots, making a total of 30 scan slots. A set refers to a group of floors served by the same combination of cars. With four cars, for example, there may be as many as 16 different sets, with the set 0000 being an invalid set. If all cars serve all floors, there would only be 1 valid set. In the average building configuration, there would usually only be a few sets, but the program will handle the maximum number of sets possible.

Step 332 determines the average number of scan slots per set, $A_{SI}$, by dividing the scan slots in each set, determined in step 330, by the number of in-service cars capable of serving the set ($N_{SCI}$). Step 332 also determines $A_{SB}$, the average number of scan slots in the building per in-service elevator car, by dividing the total number of scan slots in the building by $N_{SC}$, the number of cars in-service.

Steps 334 and 336 then repeat steps 322 and 324, respectively, reading the input port of ROM 1 of control memory 82, and counting the cars in-service. Step 338 determines if there has been a change in the building configuration since the last reading of the input port. For example, step 338 determines if the number of in-service cars has changed. If there has been a change, the program returns to step 322, as the floor enable masks and scan slot averages previously formulated may no longer be valid, and thus should be updated using the lastest building configuration.

If step 338 finds that there has been no change which invalidates $N_{SC}$, $A_{SB}$, or $A_{SI}$ for any set, the program advances to step 340. Step 340 counts the number of hall calls per set, as well as the total number of hall calls in the building, and stores these sums for future reference.

Step 342 determines the average number of registered hall calls per set, $A_{CI}$, by dividing the number of hall calls in each set by the number of in-service cars serving the set. The average number of registered hall calls per car in the building, $A_{CB}$, is determined by dividing the total number of hall calls in the building by $N_{SC}$, the number of in-service elevator cars.

Step 344 checks for special traffic conditions, such as those which initiate up peak and down peak features. If a condition is detected which initiates a peak traffic condition, step 344 implements the strategy associated with the specific peak detected.

Step 346 checks for special floor features, such as main and convention floor features. If a request for one or more special floor features is present, step 346 implements the strategy associated with the special floor features selected.

Step 348 clears the up and down assignment tables, stored in RAMS 6 and 7, respectively, of all scan slot assignments except those previously assigned scan slots which have a registered hall call associated therewith, and those scan slots from a one car set.

Step 350 removes any excess scan slot assignments. For example, if the number of calls from a one car set assigned to the car equals or exceeds the hall call per car building average $A_{CB}$, all other assignments to this car are cleared. If the calls assigned to a car from a one car set do not exceed $A_{CB}$, but all calls assigned to the car equals or exceeds $A_{CB}$, step 350 counts the scan slots assigned to the car which have a registered hall call, starting at the scan slot associated with the position of the car and proceeding in the travel direction of the car, and once the building call average per car $A_{CB}$ is met, all further scan slots assigned to this car are cleared.

Step 352 assigns the direction from an in-service idle car in which the assignment of scan slots are to be made to the car. If a car is busy, the scan direction for assigning scan slots to the car is the car's travel direction. The assigned scan directions of the busy cars are considered, along with the present traffic conditions, in deciding the scan direction to be assigned to an in-service idle car. In certain instances, hereinafter explained, it is also suitable to use the last travel direction of an in-service idle car.

Step 354 assigns the order in which the cars are to be considered when assigning scan slots to them, with the car having the fewest combined car and hall calls being considered first, etc.

Step 356 assigns the scan slots of each set to the cars, in the car order determined by step 354. The sets are considered in the order of increasing number of cars per set. The assignment of the scan slots to the cars associated with each set are made in a plurality of passes, such as three. The first assignment pass is a specific assignment pass which takes care of pre-identified situations and priorities. For example, scan slots associated with floors for which the cars have a car call are assigned to the appropriate cars; the up and down scan slots associated with a floor at which an in-service idle car is standing, are assigned to that car; if there is car with a NEXT assignment, this car is assigned the scan slot associated with the main floor up service direction; and, if there is a car with a convention floor assignment CONV, this car is assigned both scan slots associated with the convention floor. The second pass is a general assignment which assigns scan slots to the cars of the sets subject to predetermined dynamic limiting averages and a distance limitation. A third pass may be used to try to assign any unassigned scan slots, which may remain after the first two passes. The third pass removes certain limitations used during the second pass.

Step 358 reads RAMS 4, 5, 6 and 7 to the output port of the data storage memory 86, where the information from these RAMS appears as serial output signals $\overline{OUT0}$, $\overline{OUT1}$, $\overline{OUT2}$ and $\overline{OUT3}$ for cars 0, 1, 2 and 3, respectively.

After outputting the assignments to the cars, the program returns to step 334, hereinbefore described.

FIG. 10

Figure 10:
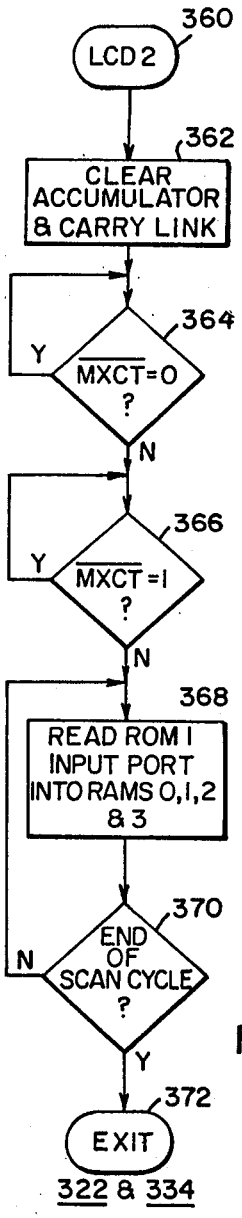

FIG. 10 is a flow chart of the subprogram LCD2 which may be used to read the serial input signals $\overline{IN0}$–$\overline{IN3}$ from the cars, which signals appear at the input port of ROM1, and to store these signals in RAMS 0, 1, 2 and 3. As illustrated in FIG. 5, the status signals from each of the cars, which appear in the first quarter of a scan slot, are stored in RAM 0, the up and down hall calls $\overline{1Z}$ and $\overline{2Z}$, respectively, which appear in the second quarter of signals $\overline{IN0}$ and $\overline{IN1}$, are stored in RAM 1, the floor enable signals $\overline{FEN}$, which appear in the third quarter, are stored in RAM 2, and the car calls $\overline{3Z}$ are stored in RAM 3. As will be hereinafter described, the floor enable signals $\overline{FEN}$ are only temporarily stored in RAM 2, and will be later transferred to another RAM storage location when the up and down call masks are formed.

More specifically, sub-program LCD2 is entered at terminal 360, and step 362 clears the accumulator and carry link CY of CPU 80 shown in FIG. 4, as all input transfers are made through the accumulator. As hereinbefore explained, the signal $\overline{MXCT}$, graphically shown in FIG. 2 and developed by hardware in FIG. 6, is used by CPU 80 to determine the start of a scan cycle. Signal $\overline{MXCT}$ is low during the last scan slot, and CPU 80 synchronizes itself with the scan cycle on the negative going transition of $\overline{MXCT}$. Step 364 loops back on itself when $\overline{MXCT}$ is zero, as it has missed the negative going transition. When $\overline{MXCT}$ is a logic one, the program advances to step 366, which determines if $\overline{MXCT}$ is a logic one. As long $\overline{MXCT}$ remains a logic one, step 366 is repeated. As soon as $\overline{MXCT}$ becomes a logic zero, the program advances to step 368. Step 368 reads the ROM 1 input port into RAMS 0, 1, 2 and 3, a scan slot at a time. After each scan slot, step 370 checks to see if the scan cycle has ended, and if it has not, step 368 is repeated to read and store the next scan slot. When all scan slots have been read and stored, step 370 advances to the sub-program exit terminal 372.

FIG. 11

FIG. 11 is a flow chart of a sub-program LCD1 which may be used to count the cars in-service with the system control 22, and thus may be used to perform the functions referred to in blocks 324 and 336 of FIG. 9. Since all of the elevator cars will be considered, step 382 prepares the car loop by initilizing the car number or count to car 0. Step 382 also clears the binary counter which will contain the number of in-service cars $N_{SC}$.

Steps 384 and 386 read the 4-bit words INSC and BYPS, respectively, which are located in RAM 0 (FIG. 5), and the words are stored in a temporary location where the bits may be examined. Step 388 examines the bit of the BYPS word associated with car 0, and if it is a logic one, the car is by-passing hall calls and it will not be counted as in-service car. The program then advances to step 396 which increments the car number so car 1 may be checked. If the car is not by-passing, step 388 advances to step 390 which checks the bit of the word INSC associated with car 0, to determine if the car is in-service with the system processor according to the car controller of car 0. If this bit is a logic zero, the car is not counted, and the program advances to step 396. If the INSC bit is a logic one, the program advances to step 392 which increments $N_{SC}$, the binary count of in-service cars, from the system control viewpoint. Step 394 enables the bit of word INSV for car 0. Word INSV will be a 4-bit word, one for each car, which indicates whether or not each car is in-service according to the system control 22.

Step 394 advances to step 396 which increments the car number, and step 398 checks to see if all cars have been considered. If they have not, step 398 returns to step 388 to check the BYPS and INSC bits for this car. When all cars have been considered, a new 4-bit word INSV had been formed, and step 400 loads this word into the status character memory of RAM 0. Step 402 loads the $N_{SC}$ count into the status character memory of RAM 0, and the program exits at terminal 404.

FIG. 12

FIG. 12 is a flow chart of a sub-program LCD9 which may be used to form the up and down call masks, specified in block 328 of FIG. 9. Sub-program LCD9 is entered at terminal 410 and step 412 clears the up and down call masks in RAMS 10 and 9, respectively, it initializes the floor count to scan slot 00, it initializes the car count to car 0, and it sets a test flag to zero for each car.

Step 414 reads the 4-bit binary floor enable word from slot 00 of the main memory of RAM 2, and writes this word in slot 00 of the main memory of RAMS 9, 10 and 11. RAM 11 will be the new location for the floor enable when all floors have been considered, leaving RAM 2 available for storing other signals, and RAMS 9 and 10, when all floors have been considered, will indicate the floor each car can serve down and up hall calls from, respectively.

The down call masks of RAM 9 will be similar to the RAM map of floor enable in RAM 11, except the floor enable bit for the lowest floor a car is enabled to serve will be deleted. The up call masks of RAM 10 will be similar to the RAM map of the floor enable in RAM 11, except the floor enable bit for the highest floor a car is enable to serve will be deleted. The program of FIG. 12 performs the function of deleting these bits to form the up and down call masks.

For purposes of example, it will be assumed that there are 16 floors in the building and all cars are enabled to serve all floors, and thus the bits of slot 00 of the main memory of RAM 9 should all be a logic zero, while the remaining bits of the main memory of RAM 9 will be a logic one, and the bits of slot 15 of the main memory of RAM 10 should all be a logic zero, while the remaining bits of the main memory of RAM 10 will be a logic one.

More specifically, after the floor enable word for slot 00 has been written into RAMS 9, 10, and 11, step 416 checks this word while it is in the accumulator of CPU 80. If this scan slot had not been assigned to a floor, such as when there are more scan slots than floor levels, the word will be all zeros, and step 416 would advance to step 436 which increments the floor count. In the example, the first word will all be ones, and since the word is not all zeros, the program advance to step 418 which shifts the accumulator right to place the bit associated with car 0 in the accumulator carry CY. Step 420 checks the carry, and if it is a zero, indicating this car is not enabled for this floor, the program advances to step 428 which increments the car count. In the example, all cars are enabled for all floors, so the carry will be a one and the program advances to step 422, which loads the address of this floor in the up delete register for this car, ie., an index register in CPU 80. Each time this car is found to be enabled for a higher floor, the address of this higher floor will be written over the address of the lower floor. Therefore, when all floors have been considered, the address in the up delete register, is the address of the highest floor the car is enabled to serve, and the bit for this floor, for this car, will be deleted in RAM 10, the up call mask.

Step 424 then checks the test flag for this car. If it is a zero, it indicates the down mask bit for the lowest floor this car can serve has not yet been deleted, and step 426 clears the carry to delete this bit, and the test flag for this car is set to 1, to indicate the next time step 424 is encountered that step 426 should be skipped. Step 428 increments the car number, and step 430 checks to see if all cars have been considered. If not, the program loops back to step 418, to check the bit of the floor enable word for the next car.

When all cars have been considered relative to the floor enable word for this floor, step 432 shifts the accumulator right to return the floor enable word to its original location, and step 434 loads this word into the associated slot of RAM 9, the down call mask. Since the bits of the lowest floors the cars are enabled to serve are eliminated from the word in step 426, the correct down mask is created simply by writing the word held in the accumulator over the word of the same slot in the down mask, RAM 9.

Step 436 increments the floor count, and step 438 checks to see if all floors have been considered. If not, the program loops back to step 414, which reads the floor enable word from RAM 2 for this floor into RAMS 9, 10 and 11. The steps will then be performed as before, except now the test flag will be a one for all cars, skipping step 426, as no further bits are to be removed from the word before loading it into RAM 9.

When step 438 finds that all floors have been considered, the up delete register for each car will contain the address of the highest floor each car is enabled to serve, and step 440 initializes the car count and loads this up delete address for car 0 into the accumulator. Step 442, using this address, deletes the bit for this car and floor in RAM 10, the up call mask. Step 444 increments the car count, and step 446 checks to see if all cars have been considered. If not, the program loops back to step 440. When all cars have been considered, the up mask is completed, and since the down mask was completed when step 438 advanced to step 440, the program exits at terminal 448.

FIG. 13

Figure 13:
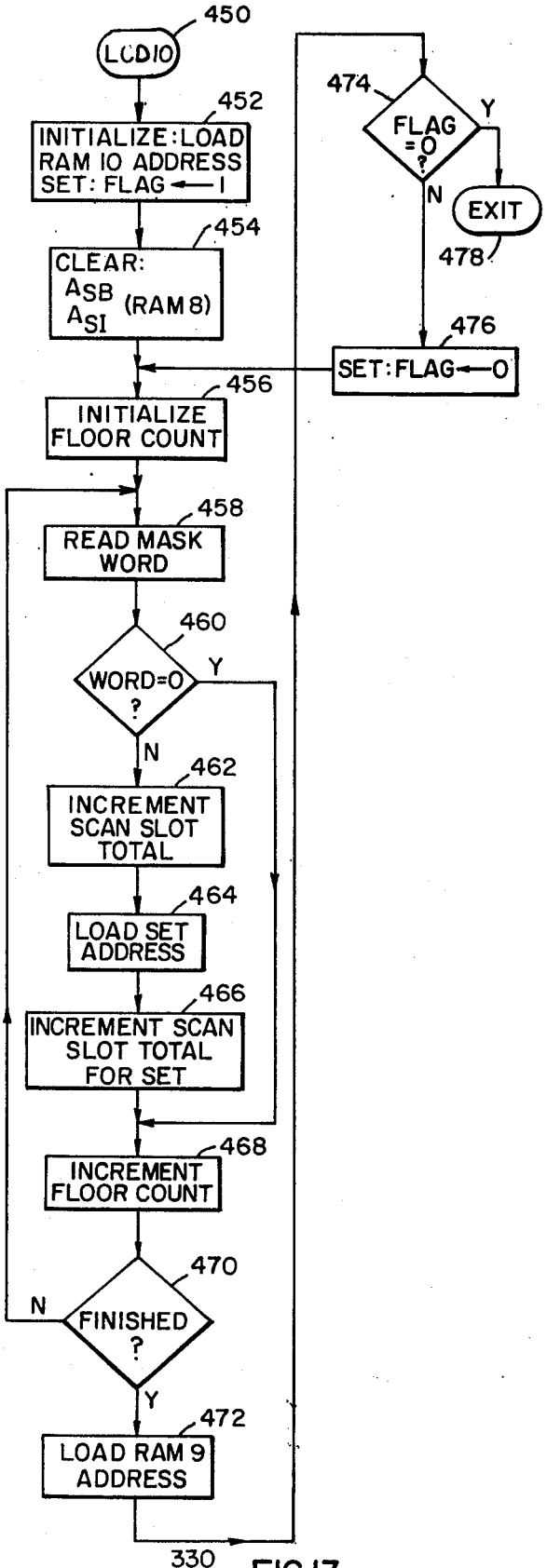

FIG. 13 is a flow chart of a sub-program LCD10 which may be used to count the total number of scan slots in the building, as well as the number of scan slots in each set, which corresponds to the block function 330 in FIG. 9. Sub-program LCD-10 is entered at terminal 450 and step 452 loads the address of RAM 10, the up call mask, into the accumulator, and sets a flag to 1. Step 454 clears word $A_{SB}$, the average number of scan slots per in-service car in the building, which word is located in the status character memory of RAM 8, and it also clears the main memory of RAM 8, which is where the $A_{SI}$ words for the sets are stored. Word $A_{SI}$ is the average number of scan slots for a set, per in-service car capable of serving the set.

In RAM 8, the rows refer to set numbers, and not scan slots or floor levels. The universality of the supervisory control is enhanced by giving each of the sixteen possible sets, counting the invalid set where no cars serve a scan slot, a different binary number 0000 through 1111. Information relative to a set is stored in the main memory of a RAM according to the binary number of the set. Information relative to set 0001, for example, is stored in row 1, and information relative to set 1111 is stored in row 15. The mask word for a floor, from both the up and down masks, is used as the set number. Therefore, it is not necessary for CPU 80 to determine how many sets there are, or what they are. For example, if an up or down mask word for a floor is 1111, indicating all cars are enabled to serve the floor and direction therefrom associated with this scan slot, this scan slot belongs to set 1111 and information relative to this set is stored in row 15 of the main memory of a RAM. If the mask word is 1100, indicating that only cars 2 and 3 are enabled to serve the floor and direction therefrom associated with this scan slot, this scan slot would belong to set 1100, which would be stored in row 12. If these are the only valid sets, only rows 12 and 15 would be used to store information relative to the sets, and the remaining rows would all contain zeros.

More specifically, step 454 advances to step 456 which initializes the floor count, and step 458 reads the up mask word for scan slot 00. Step 460 checks to determine if the scan slot is associated with a floor. If the mask word is zero, it is not associated with a floor and the program advances to step 468, which increments the floor count. If the word is not zero, step 462 increments the scan slot total, stored in a scratch pad memory, such as the main memory of one of RAMS 12, 13, 14 or 15.

Step 464 loads the set address which this scan slot belongs to, which, as hereinbefore described is the same as the mask word being considered, and step 466 increments the scan slot total for this set. Thus, if the mask word was 1111, address 1111, which is row 15 of the main memory of a RAM, would be incremented by one.

Step 468 increments the floor count and step 470 determines if all of the scan slots have been considered. If not, the program loops back to step 458 to read the mask word for the next scan slot. When step 470 finds all scan slots have been completed, step 472 loads the address of RAM 9, the down call mask, into the accumulator, and step 474 checks the flag. If the flag is one, it indicates the down call masks have not yet been processed, step 476 sets the flag to zero, and the program returns to step 456 to process the down call masks. When step 474 finds the flag equal to zero, both the up and down call masks have been processed, and the program exists at terminal 478.

FIG. 14

Figure 14:
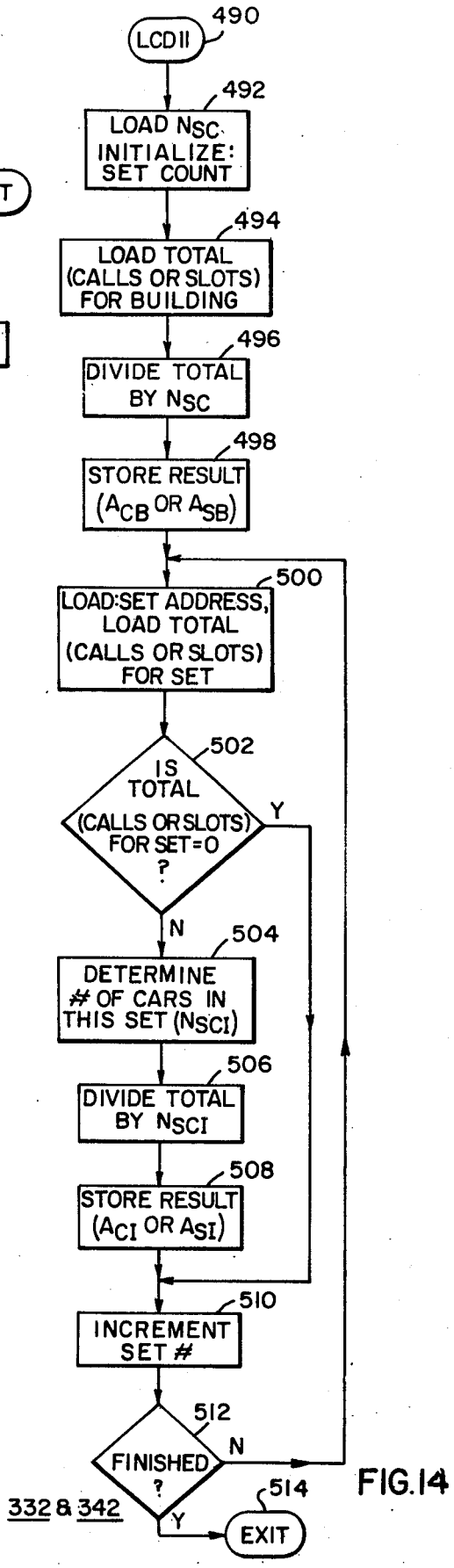

FIG. 14 is a flow chart of a sub-program LCD11 which may be used for both block functions 332 and 342 of FIG. 9. Function 332 determines the averages $A_{SB}$ and $A_{SI}$, and function 342 determines the averages $A_{CB}$ and $A_{CI}$. If all cars are not enabled for the same floors and service directions, there will be more than one set, and each set will have its own $A_{SI}$ and $A_{CI}$ averages. The building averages $A_{SB}$ and $A_{CB}$ bear no relationship to the set averages. If all cars are enabled for all floors, there is only one set. In this instance the average $A_{SI}$ for this one set will be the same as the building average $A_{SB}$, and the average $A_{CI}$ for this one set will be the same as the average $A_{CB}$. In describing FIG. 14, it will assumed that it is function 332. To obtain the description of function of 342, it is only necessary to substitute "hall calls" for "scan slots", RAM 2 for RAM 8, $A_{CB}$ for $A_{SB}$, and $A_{CI}$ for $A_{SI}$.

More specifically, sub-program LCD11 is entered at terminal 490, and in step 492 word $N_{SC}$, the number of cars in-service according to the system control 22, stored in the status character memory of RAM 0, is loaded into the accumulator, and the set count is initialized so the sets can be examined in the order of the set numbers.

Step 494 loads the total number of scan slots in the building, which was stored in a temporary location by step 462 in FIG. 13. Step 494 divides the total number of scan slots in the building by $N_{SC}$ and stores the result, a binary word $A_{SB}$, in the status character memory of RAM 8.

Step 500 loads the address of the first set and the total slots in this set. The total slots for this set address were determined in step 466 of FIG. 13. Step 502 determines if there is an actual set by checking to see if the number of scan slots in the set is zero. If it is zero, the program advances to step 510, which increments the set number. If the total slots are not zero, step 504 determines the number of in-service cars enabled to serve the set, $N_{SCI}$, which is determined by counting the "ones" in the set number, and step 506 divides the total number of scan slots by $N_{SCI}$ for this set. The quotient is the $A_{SI}$ of this set, ie., the average number of scan slots per in-service car, and step 508 stores this number, a binary number, in the main memory of RAM 8, in the row corresponding to the address of this set.

Step 510 increments the set number, and step 512 determines if all sets have been considered. If not, the program loops back to step 500. If all the sets have been considered, step 512 advances to the exit 514.

FIG. 15

Figure 15:
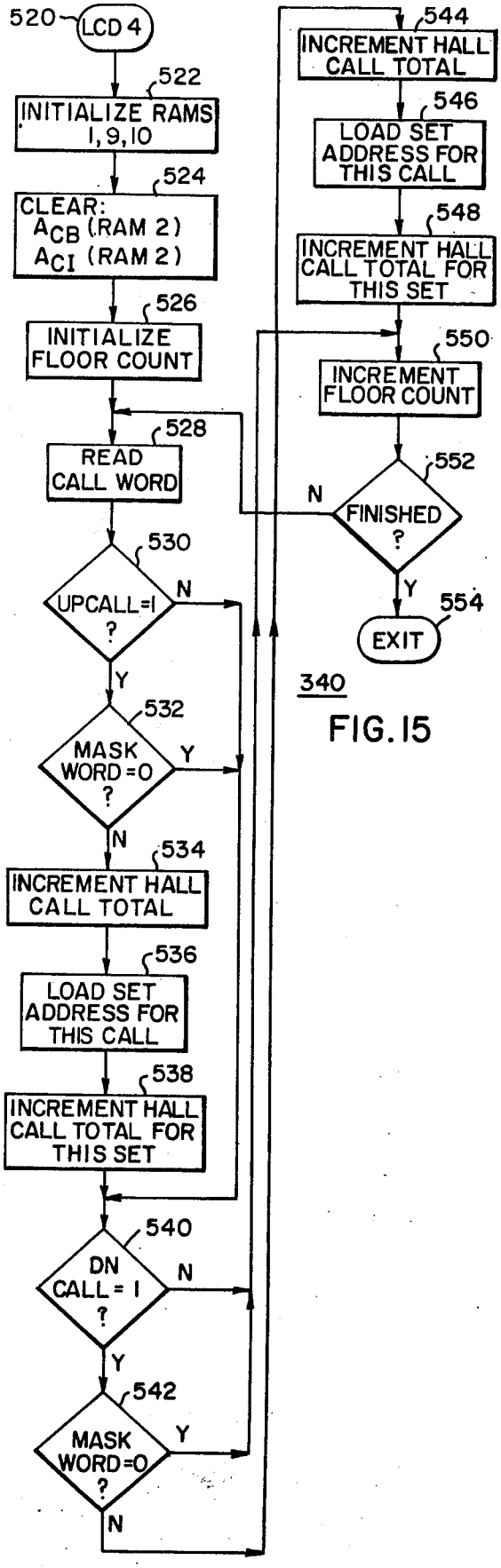

FIG. 15 is a flow chart of a sub-program LCD4 which may be used for the block function 340 shown in FIG. 9, to count the total number of hall calls, as well as the number of hall calls in each of the sets.

Sub-program LCD4 is entered at terminal 520, and step 522 loads the addresses of RAMS 1, 9 and 10 which contain the up and down hall calls, the down call mask words, and up call mask words, respectively. Step 524 clears $A_{CB}$, the average number of hall calls per in-service car in the building, stored in the status character memory of RAM 2, and it clears $A_{CI}$ for each set, the average number of hall calls in a set per in-service car enabled to serve the set, stored in the main memory of RAM 2. Step 526 initializes the floor count, and step 528 reads the call word from row 00 of RAM 1. Step 530 checks the first bit of this call word for an up call. If the first bit is zero, the program advances to step 540 to check for a down call. If the first bit is a one, step 532 checks the up call mask word for this scan slot, stored in RAM 10. If the mask word is zero, no cars are enabled for this scan slot and the "one" detected by step 530 was invalid. Therefore, the program advances to step 540. If step 532 finds the mask word is not all zeros, step 534 increments the hall call total for the building, stored in a temporary location, and step 536 loads the set address for this call. The set address is the up call mask word just checked in step 532, and step 538 increments the hall call total for this set, which totals are stored in a temporary location.

Step 538 advances to step 540 which checks the second bit of the call word from RAM 1. If this bit is zero, the program advances to step 550, which increments the floor count. If the second bit is a one, the program checks the down call mask word from RAM 9 for this scan slot. If the mask word is zero, the detected call by step 540 is invalid, and the program advances to step 550. If the mask word is non-zero, step 544 increments the hall call total for the building. Step 546 loads the set address for the call, ie., the down call mask word for this scan slot, and step 548 increments the hall call total for this set.

Step 550 increments the floor count, and step 552 checks to see if all floors (scan slots) have been considered. If they have not, the program loops back to step 528. If they have, the program exits at terminal 554.

The information necessary to run function 342 of FIG. 9 is now available, and subprogram LCD11 prepares the averages $A_{CI}$ for each set, and $A_{CB}$ for the building, in a manner similar to that hereinbefore described relative to the preparation of averages $A_{SI}$ and $A_{SB}$ (FIG. 14).

FIG. 16

Figure 16:
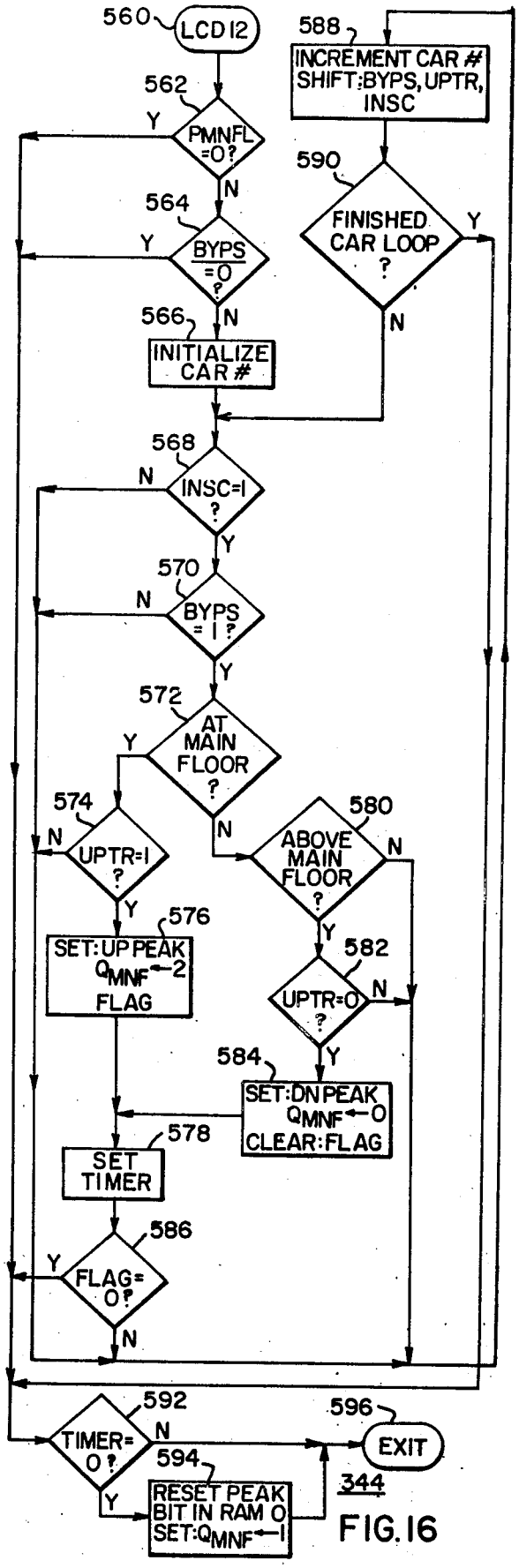

FIG. 16 is a flow chart of a sub-program LCD12 which may be used for the block function 344 of FIG. 9, related to special traffic features. The subprogram LCD12 detects predetermined traffic conditions, and in response thereto takes a predetermined course of action. For example, a peak traffic condition in the down direction may be detected by a car above the main floor, set for down travel, by-passing hall calls. This may be detected by checking the 4-bit word BYPS stored in row 07 of RAM 0. A peak traffic condition in the up direction may be detected by a loaded car leaving the main floor. It may also be detected by a car at the main floor, set for up travel, set to by-pass hall calls. Again, the 4-bit word BYPS may be checked.

If both the up peak and down peak events occur simultaneously, the down peak takes precedence.

The predetermined course of action taken by subprogram LCD12 in response to a peak condition determines the quota of cars to be maintained at the main floor, $Q_{MFL}$, and actuates a peak timer. The peak timer maintains the peak related strategy for a predetermined period of time after the occurrence of each event which is used to indicate the peak is occurring.

More specifically, subprogram LCD12 is entered at terminal 560 and step 562 checks input signal $\overline{IN5}$ of CPU 80 to determine if the main floor feature is true, indicated by a true signal $\overline{PMNFL}$ (FIG. 6), which may be controlled by a manual switch. If the main floor feature is not active, the program advances to step 592. If the main floor feature is active, step 564 checks the 4-bit word BYPS stored in RAM 0 to see if any car is by-passing hall calls. As hereinbefore stated, this test may be used to detect peaks for both traffic directions. If the word BYPS is zero, the program advances to step 592. If the word BYPS is not all zeros, step 566 initializes the car count and step 568 checks the first bit of word INSC, stored in RAM 0, which bit is associated with car 0. If this bit is zero, indicating this car is not in-service with the system control 22, the program advances to step 588. If the car is in-service, step 570 checks the bit of word BYPS, stored in RAM 0, associated with car 0. If this bit is zero, the car is not by-passing and the program advances to step 588. If the BYPS bit is a one, the car is by-passing and step 572 determines if the by-passing is associated with up or down traffic by checking to see if the car is at the main floor. If the car is at the main floor, step 574 checks the bit of word UPTR, stored in RAM 0, to see if the car is set for up travel. If it is not, the program advances to step 588. If it is, step 576 sets a peak bit in the status character mamory of RAM 0, it sets a peak identifier bit in the same RAM to indicate up peak, it sets the quota of cars to be maintained at the main floor ($Q_{MNF}$), to some predetermined number, such as 2 for a 4 car bank, and it sets a flag to indicate the up peak bit has been set. Step 578 sets a peak timer, which will keep the system on up peak for a predetermined period of time.

If step 572 found that the by-passing car was not at the main floor, step 580 checks to see if the car is above the main floor. If it is not, the program advances to step 588. If the car is above the main floor, its travel direction is checked in step 582 by checking the bit of word UPTR stored in RAM 0 associated with this car. If the car is set for up travel the bit will be a "one", and the program advances to step 588. If the car is set for down travel, the UPTR bit will be a zero and step 584 sets the bits in the status character memory of RAM 0 to indicate a down peak, the main floor quota $Q_{MNF}$ is set to some predetermined number, such as zero for a 4 car bank, and it clears a flag to indicate the down peak bit has been set.

If either the up peak or down peak bit is set, the program reaches step 578 which sets the peak timer, and step 586 checks the flag to see if the system has been set for up or down peak. If the flag is zero, indicating a down peak, no further cars need be checked, since down peak takes precedence over up peak. If the flag is a one, indicating an up peak, the remaining cars must be checked to determined if any will trigger the down peak feature, since down peak takes precedence. If step 586 finds the flag is set, step 588 increments the car count and the words BYPS, INSC and UPTR are shifted to look at the bits of these words which are associated with the new car. Step 590 checks to see if all cars have been considered, and if not, the program loops back to step 568.

When step 590 finds that all of the cars have been considered, or as soon as the down peak is activated, or if PMNFL or the word BYPS was zero, step 592 is reached which checks the peak timer. If the peak timer is active, the program exits at terminal 596. If the peak timer has timed out, step 594 resets the peak bit in the status character memory of RAM 0, and sets the main floor quota, $Q_{MNF}$ to some predetermined number, such as 1 for a 4 car bank, and then the program exits at terminal 596.

FIG. 7

Figure 17:
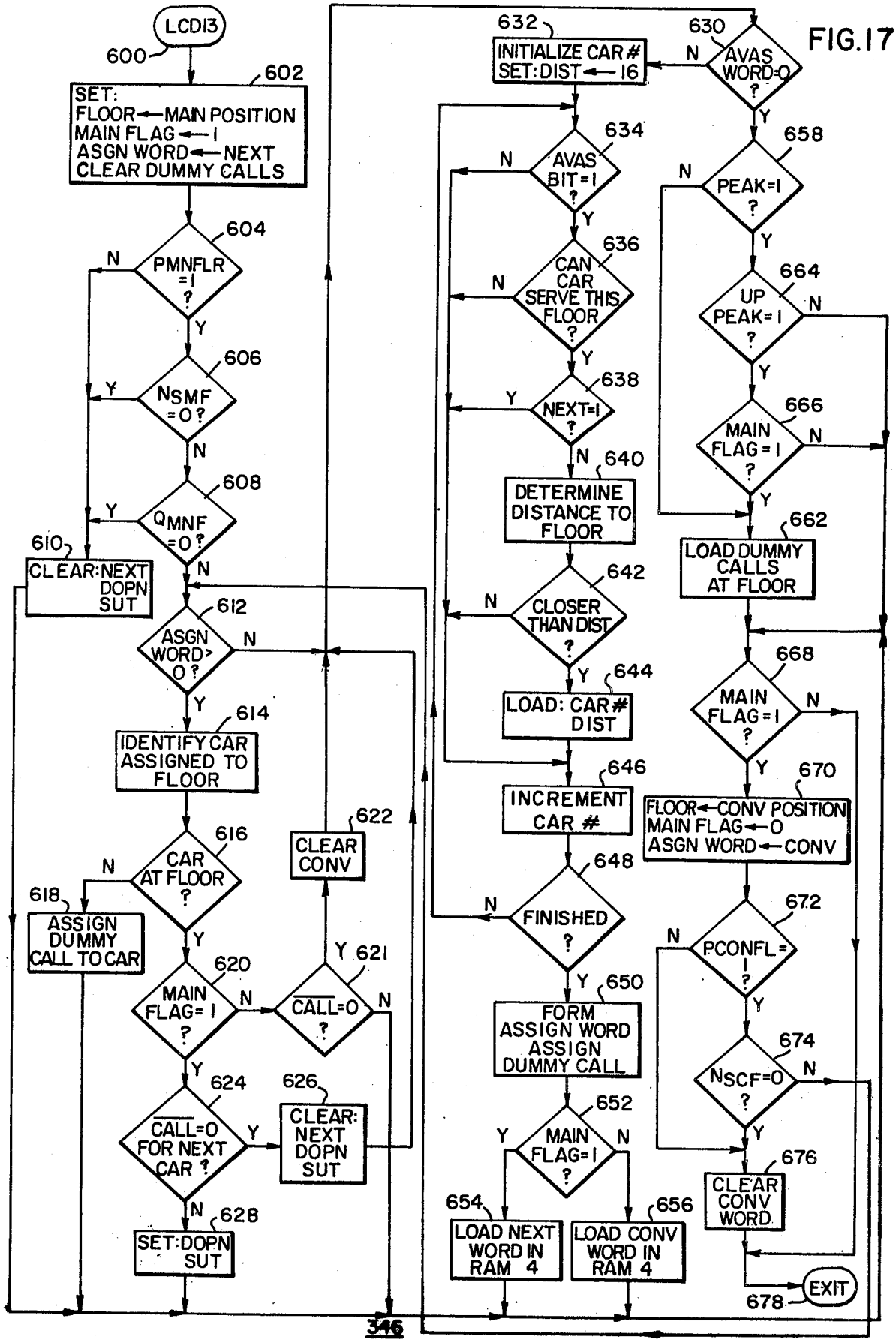

FIG. 17 is a flow chart of a sub-program LCD13 which may be used to perform the block function 346 of FIG. 9 associated with special floor features. As hereinbefore described relative to FIG. 6, the present invention has provision for a main floor feature and a convention floor feature, but other special floor features, such as a restuarant floor, and the like may be added in the manner previously described relative to FIG. 6, and to be described relative to FIG. 17. It will be recalled that the main floor feature is activated by a switch which drives terminal $\overline{PMNFL}$ of FIG. 6 true. The main floor may be selected to be any floor in the building, and may be changed, if desired. The binary address of the floor selected as the main floor is applied to terminals $\overline{PMNFL0}$ through $\overline{PMNFL3}$ of FIG. 6, such as by a plurality of switches, and thus to change the location of the main floor it is only necessary to apply the associated binary address of the new floor to these terminals.

In like manner terminal $\overline{PCONFL}$ of FIG. 6 activates the convention floor feature, and terminals $\overline{PCFL0}$ through $\overline{PCFL3}$ select the address of the floor, which again may be any floor of the building.

The main floor feature, when activated, attempts to maintain the quota of cars set by $Q_{MNF}$ in sub-program LCD12 (FIG. 16), by presenting dummy calls for the main floor, and it provides a NEXT car feature whereby a car is designated as the next car to leave the main floor, which car waits at the main floor, preferably with its doors open and the up hall call lantern lit, until a car call is registered in the car. The NEXT car is treated differently when assigning scan slots to the car, as will be hereinafter explained relative to the sub-program which assigns scan slots.

When the convention floor feature is activated, and there are no cars at the selected convention floor, dummy calls are used to bring a car to the floor. A car parked at the convention floor does so with its doors closed until a hall call at the convention floor is registered.

More specifically, sub-program LCD13 is entered at terminal 600, and step 602 initializes by clearing all dummy calls ($\overline{PKFL}$), by setting a word FLOOR in an index register of CPU 80 to the floor indicated by the address $\overline{PMNFL0}$–$\overline{PMNFL3}$, by setting a main floor flag to 1, which indicates the main floor feature is being processed, and by setting the temporary word ASGN to the 4-bit word NEXT stored in the main memory of RAM 4.

Step 604 checks PMNFLR to see if the main floor feature has been activated. If it is not active PMNFLR will be zero, and the program advances to step 610. Step 610 clears the words NEXT, DOPN and SUT, which are stored in RAM 4, since these assignments by CPU 80 are made only when the main floor feature is active.

If PMNFLR is a one, step 606, as a program check, determines if a word $N_{SMF}$, which contains the number of cars enabled to serve the selected main floor, is equal to zero. If the main floor address selects a scan slot for which no cars are enabled, the main floor feature is invalid and the program advances to step 610. If word $N_{SMF}$ is not 0, a valid scan slot has been selected and step 608 checks the main floor quota $Q_{MNF}$ set in LCD12 (FIG. 16). If $Q_{MNF}$ is zero the program advances to step 610 to clear the word NEXT, DOPN, and SUT. If the main floor quota is not zero, the program advances to step 612. On this loop through step 612, the word ASGN is the word NEXT, set in step 602, so step 612 checks the word ASGN to see if there is a car designated as the next car to leave the main floor. If the word ASGN is zero, there is no car designated as the NEXT car to leave the main floor and the program advances to step 630. If there is a NEXT car, step 614 identifies the NEXT car. Step 616 checks to see if the car is at the floor, which on this loop through the program is referring to the main floor since the main floor flag is a one. If the car is not at the main floor, step 618 assigns a dummy call PKFL to this car for the main floor.

If the car is at the floor, step 620 checks the main floor flag. On this loop through 620 the main floor flag is a one, and the program advances to step 624. Step 624 checks for a call by testing the bit of the word $\overline{CALL}$ in RAM 0 associated with the car identified as NEXT. If this $\overline{CALL}$ bit is a 0, indicating the NEXT car has a call, step 626 clears the assignment words NEXT, DOPN and SUT, to allow the car to serve the call. If this bit of $\overline{CALL}$ is a one, indicating no call, step 628 sets the door open bit DOPN for the car, and also sets the up travel bit SUT for the car.

After the NEXT car at the main floor receives its door and travel direction assignments in step 628, the program advances to step 668 which checks the main floor flag. If it is a one, it indicates the convention floor feature has not been checked, and step 670 sets the word FLOOR to the address of the convention floor selected by $\overline{PCFL0}$–$\overline{PCFL3}$, it sets the main floor flag to zero, and it sets the word ASGN to the word CONV, which word is stored in RAM 4.

Step 672 checks PCONFL to see if the convention floor feature is active. If it is not active, step 676 clears the word CONV stored in RAM 4, and the program exits at terminal 678. If the convention floor feature is active, step 674 determines if the number of cars enabled to serve the convention floor $N_{SCF}$ is 0. If so, the convention floor address has selected an invalid scan slot and step 676 clears the convention floor word CONV. If $N_{SCF}$ is not zero, the program loops back to step 612.

Step 612 checks to see if the assignment word ASGN is greater than zero, which, on this loop, is checking the word CONV to see if some car has been given the convention floor assignment. If a car has been given a convention floor assignment, step 614 identifies the car and step 616 checks to see if the car is at the convention floor. If it is not at the convention floor, step 618 gives a dummy parking call $\overline{PKFL}$ to this car for the convention floor. If it is at the floor, step 620 checks the main floor flag, and on this loop it is zero, directing the program to step 621 which checks to see if this car at the convention floor has a call. If it does not, the bit $\overline{CALL}$ will be a one, and the program advances to step 668 which finds the main floor flag is a zero, and the program exits as terminal 678. If it does have a call the program advances to step 622 which clears the assignment word CONV.

If the word ASGN was found to be zero when checking either the loop for the main floor feature or the loop for the convention floor feature, it would mean that the feature presently being checked by the loop has been activated but no car presently has an assignment, ie., a NEXT assignment for the main floor loop, or a CONV assignment for the convention floor loop. In this event, the program advances to step 630 which begins the portion of the program which locates a suitable car for such an assignment. The program also advances to step 630 from step 626 during the main floor loop when the NEXT car at the main floor has a call and another car must thus be found for the NEXT assignment. In like manner, the program advances to step 630 from step 622 when in the convention floor loop the car at the convention floor with the present CONV assignment has a car call, as this car will be leaving the convention floor and an other car must be found for the CONV floor assignment.

Step 630 checks the 4-bit word AVAS to see if there are any cars idle or available, according to the floor selectors of the various cars. This word is stored in RAM 0. If there is an available car, the word AVAS will not be zero, and the program advances to step 632, which starts the process of finding the closest AVAS car to the floor in question. Step 632 initializes the car count and sets a variable DIST to a number which is larger than the longest travel distance in the building. For example, with sixteen floors, DIST may be set to 16.

Step 634 checks the AVAS bit of RAM 0 for the first car in the car loop. If this car is not AVAS, the program advances to step 646, which increments the car number, and if the car loop has not been completed, as tested by step 648, the program loops back to step 634.

If step 634 finds the car is AVAS, step 636 determines if the car is enabled to serve this floor by checking the floor enable in RAM 11. If the car is not enabled for this floor, the program advances to step 646. If the car is enabled, step 638 checks the bit of word NEXT associated with this car, to see if it has been given the NEXT assignment. If it has, the program advances to step 646. If it is not NEXT, step 640 determines the distance from the car to the floor in question by obtaining the absolute difference between the numbers of the floors. Step 642 checks to see if this distance is closer than DIST, and since this is the first AVAS car found it will be closer than DIST, since DIST was arbitrarily set to a number larger than the longest travel distance. Step 644 loads the car number into a temporary location and changes the word DIST to the distance from this car to the floor in question.

Step 646 increments the car number and 648 determines if all the cars have been processed. If not, the program loops back to step 634. When all cars have been processed, the car number stored in the temporary location is the closest AVAS car to the floor in question, and step 650 forms the assignment word NEXT, or CONV, depending upon which loop the program is in, as well as sending a dummy call $\overline{PKFL}$ to the car for the floor in question.

Step 652 checks the main floor flag, and if it is a one, the word NEXT is loaded into RAM 4, and if it is a zero, step 656 loads the word CONV into RAM 4. The program advances to step 668, which checks the main flag. If it is a one, the convention floor feature hasn't been checked, and the program advances to step 670, hereinbefore described. It is a zero, the program exits at terminal 678.

If step 630 did not find any cars available, the program advances to step 658. Step 658 checks the peak bit in the status character memory of RAM 0. If it is a one, there is an up or down peak condition, and if it is a zero, there is no peak. If step 658 finds no peak traffic condition step 658 advances to step 662, which gives all cars a dummy call for the main or convention floor, depending upon which feature is being processed. Step 662 advances to step 668.

If there is a peak, step 658 advances to step 664 which checks for the type of peak. If it is a down peak, no dummy calls for the main floor are assigned, as in a down peak the NEXT car is dispatched immediately, and it is therefore not necessary to give a NEXT assignment. Also, no busy cars are given a convention floor assignment during a down peak.

If the system is in an up peak, step 666 checks the main floor flag. If it is a zero, the program advances to step 668, as no convention floor assignments are made to busy cars during an up peak. If the main floor flag is one, step 662 gives a dummy call $\overline{PKFL}$ to all cars for the main floor.

FIG. 18

Figure 18:
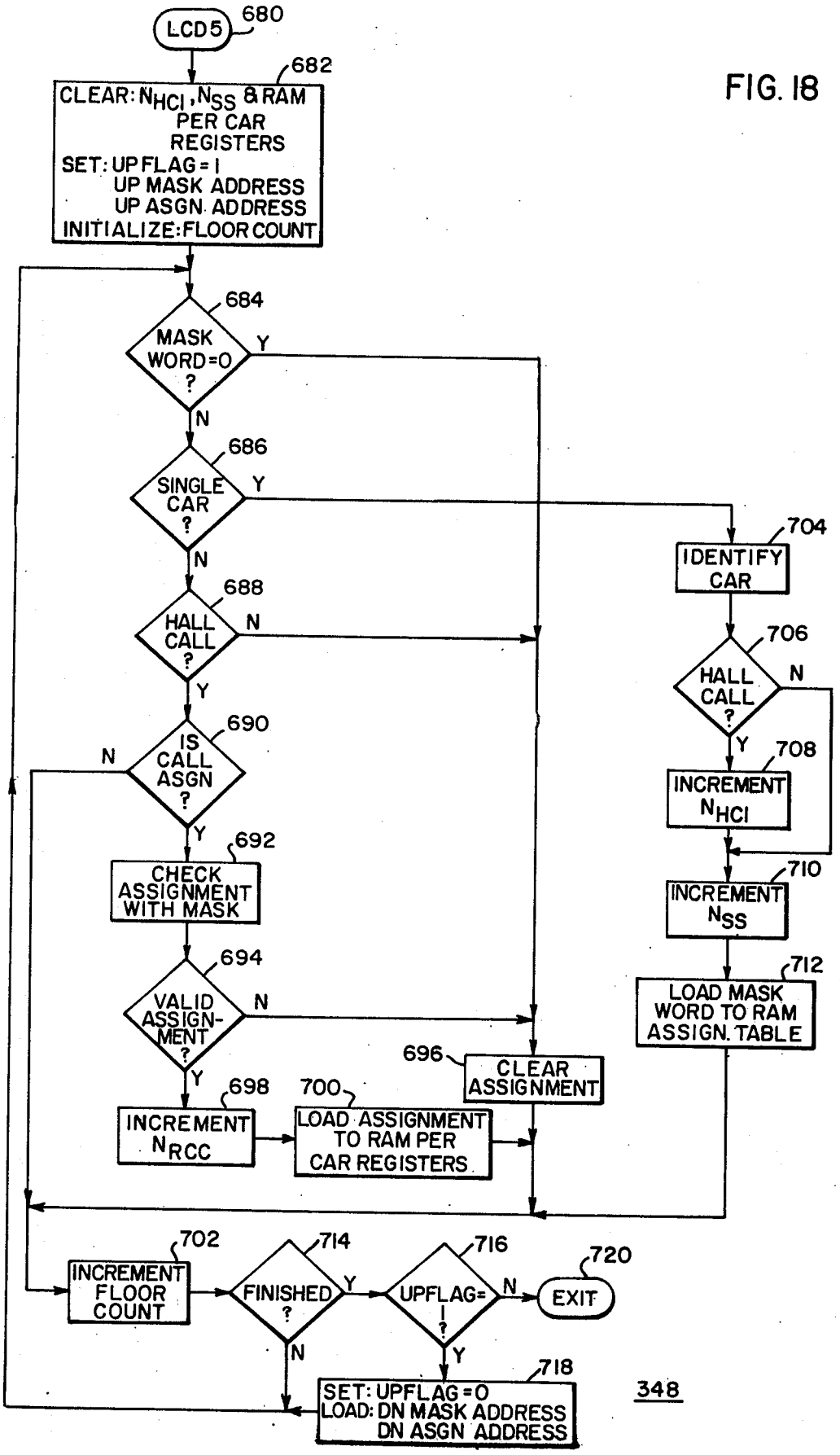

FIG. 18 is a flow chart of a sub-program LCD5 which may be used to perform the block function 348 of FIG. 9, which function clears the up and down assignment tables stored in the main memories of RAMS 6 and 7, respectively, of all scan slots, with predetermined exceptions. For example, scan slots for which only a single car is enabled to serve, are retained by LCD5. Also, scan slots which have a registered hall call are retained.

More specifically, sub-program LCD5 is entered at terminal 680, and step 682 initializes the floor count, it clears, $N_{HCl}$ a variable for counting the number of hall calls assigned to a car from a 1 car set, ie., a set for which only one car is enabled, it clears $N_{SS}$, a variable for counting the total number of scan slots assigned to a car so far, it clears the per car registers, RAMS 12, 13, 14 and 15, it sets an up flag to 1, and it loads the up call mask address (RAM 10), and the up assignment address (RAM 6).

Step 684 checks the up call mask word from slot 00 of RAM 10 to see if it is zero. If so, no cars are enabled for this scan slot, step 696 clears any assignment (RAM 6) for the scan slot, and the program advances to step 702 which increments the floor count.

If the up call mask word is not zero, it is a valid scan slot and step 686 determines, from the mask word, if only one car is enabled to serve the scan slot. If so, step 704 identifies the car, and step 706 checks RAM 1 to see if there is a hall call associated with this scan slot. If there is a hall call, step 708 increments the variable $N_{HCl}$ for this car to count the number of hall calls assigned to this car from a 1 car set, and step 710 increments the variable $N_{SS}$ for this car, to count the total number of scan slots assigned to this car so far. If there was no hall call, step 706 advances directly to step 710.

Since no other cars serve this scan slot, the car may be immediately given the scan slot assignment, and step 712 loads the up call mask word to RAM 6, since the up call mask word for a single car set is the same as the up assignment word. Step 712 then proceeds to step 702.

If step 686 found that the scan slot is served by more than 1 car, step 688 checks RAM 1 to see if there is an up hall call (1Z) associated with the scan slot. If not, step 696 clears the scan slot assignment in RAM 6 and advances to step 702. If there is a hall call, step 690 checks to see if the scan slot associated with the call has been previously assigned. If not, the program advances to step 702. If it was previously assigned, step 692 checks the assignment (RAM 6) with the up call mask (RAM 10) and step 694 determines if the assignment is valid, ie., the hall call is assigned to a car enabled for the scan slot of the call. If the assignment is not valid, step 696 clears the assignment. If the assignment is valid, step 698 increments the variable $N_{RCC}$ for the car, ie., the number of registered hall calls assigned to the car from a set enabled for more than one car. The variables $N_{RCC}$, for cars 0, 1, 2 and 3, during LCD5, are stored in the status character memories of RAMS 12, 13, 14 and 15, respectively.

Step 700 loads the assignment to the main memory of one of the RAMS 12, 13, 14 or 15 depending upon which car is assigned the scan slot. The only assignments which will appear in the per car registers (RAMS 12, 13, 14 and 15) when LCD5 is complete will be for those sets enabled for more than one car. The scan slots for one car sets are directly assigned in step 712.

Step 702 increments the floor count, step 714 checks to see if the floor loop has been completed, looping back to step 684 if it hasn't and advancing to step 716 if it has.

Step 716 checks the up flag. If it is still a one, step 718 sets the up flag to a zero and loads the down call mask address (RAM 9) and the down assignment address (RAM 7), and returns to step 684 to process the down scan slot assignments.

After the down scan slot assignments have been processed, step 716 will find the up flag is zero, and the program exits at terminal 720.

FIG. 19

Figure 19:
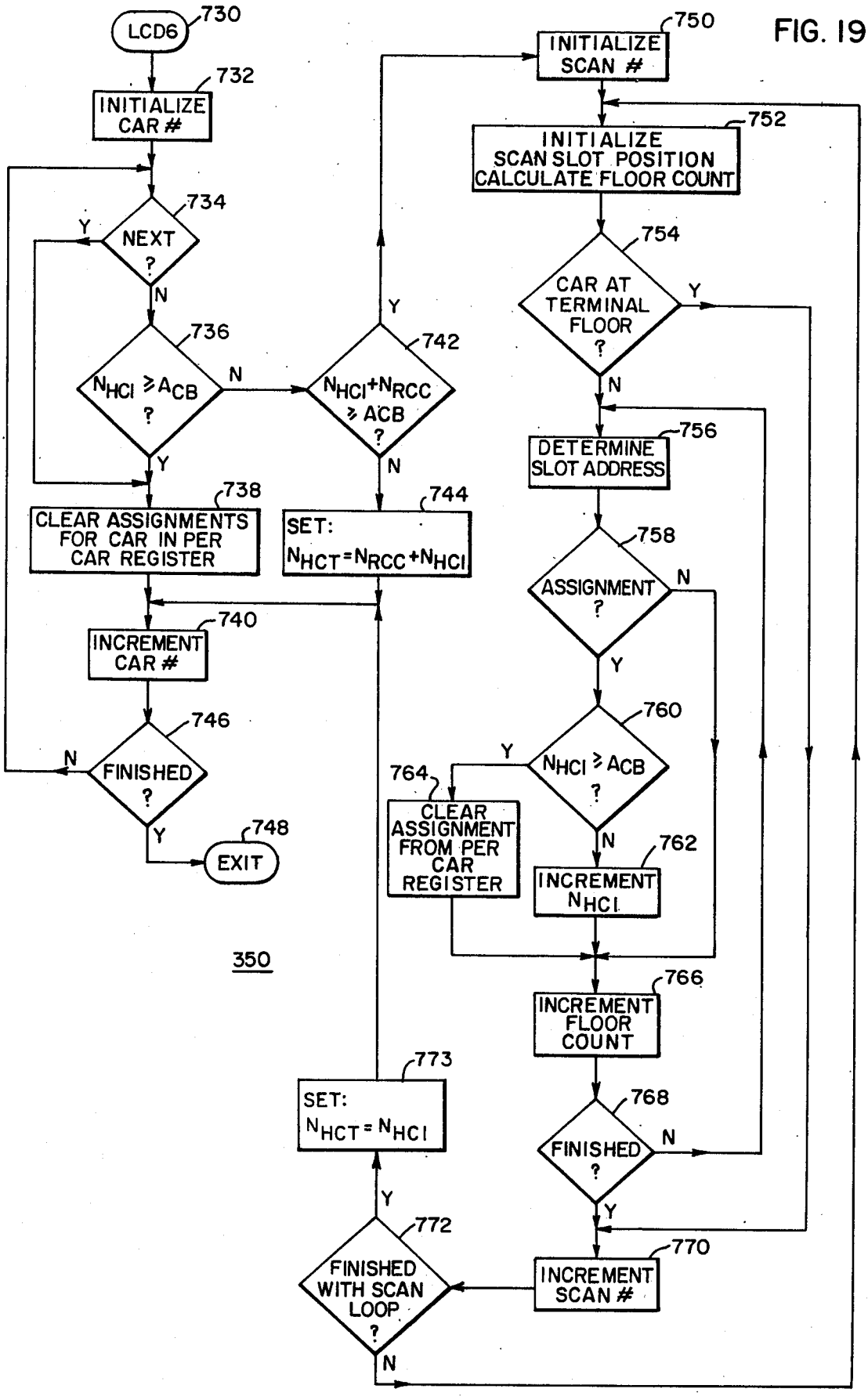

FIG. 19 is a flow chart of a sub-program LCD6 which may be used to perform the block function 350 in FIG. 9, which function removes excess scan slot assignments from the cars, if any, using the average number of calls per car in the building, $A_{CB}$, as the guide.

Sub-program LCD6 is entered at terminal 730 and step 732 initializes the car count. Step 734 checks the bit of the word NEXT associated with this car, stored in RAM 4, and if this car has the NEXT assignment, step 738 clears the assignments for this car which were placed in the per car register associated with this car, ie., one of the RAMS 12–15. It will be recalled that LCD5 (FIG. 18) only placed assignments in the per car registers for sets served by more than one car. Thus, the floors assigned in the per car register are served by other cars and will be reassigned in LCD14 if the assignment is removed in LCD6. The assignments for the one car sets were placed directly in RAMS 6 and 7 and are thus not disturbed by step 738. Step 740 increments the car count.

If step 734 finds the car is not NEXT, step 736 determines if the hall calls assigned to this car from a one car set, totaled in $N_{HCl}$ for the car in LCD5, is equal to, or greater than $A_{CB}$. If so, this car has all it can handle from floors only served by this car, and step 738 removes any scan slot assignments to this car which are in the per car registers.

If step 736 finds the number of hall calls assigned to the car from a one car set, $N_{HCl}$, does not equal or exceed the average $A_{CB}$, step 742 totals the hall calls assigned to the car by adding $N_{HCl}$ to $N_{RCC}$. The count $N_{RCC}$, developed in step 698 of FIG. 18, is the number of hall calls assigned to the car from sets served by more than one car. If this total does not equal or exceed the building call average per car $A_{CB}$, step 744 sets the variable $N_{HCT}$ for the car to the sum of $N_{RCC}$ and $N_{HCl}$, and the program advances to step 740.

If the sum of $N_{HCl}$ and $N_{RCC}$ equal or exceeds $A_{CB}$, the program starts at the scan slot of the car and, proceeding from the car in the selected scan direction, as checked by a bit in the word UPSCAN, it counts the scan slots assigned to the car. All scan slots assigned to the cars in the per car registers have a hall call associated therewith. Thus, once a count equal to $A_{CB}$ is reached, any further scan slots which are encountered assigned to this car are removed from the per car registers.

The different portions of the scan cycle which examine the scan slots, starting at the car, are given scan numbers according to the following code:

Scan 1: The scan which starts at the location of the car and proceeds to one end of the scan cycle.

Scan 2: The scan which reverses direction at the end of scan 1 and proceeds to the other end of the scan cycle.

Scan 3: The scan which reverses direction at the end of Scan 2 and proceeds back to the scan slot of the car.

Returning now to FIG. 19, when the sum of $N_{HCl}$ plus $N_{RCC}$ is equal to or greater than $A_{CB}$, the program advances to step 750 which initializes the scan number to scan 1. Step 752 initializes the scan slot position and calculates the floor count to determine the floor position of the car. Step 754 checks to see if the car is at a terminal floor. If so, there will only be 2 scans, instead of 3, and the program advances to step 770 to increment the scan count number. If the car is not at a terminal floor, step 756 determines the scan slot address (floor level of the car minus one) of the first scan slot to be considered and step 758 determines if it is assigned to the car being considered. If it is not, step 766 increments the floor count. If it is, step 760 determines if $N_{HCl}$, the number of calls assigned to this car from a 1 car set, is equal to or greater than $A_{CB}$. If it is not, step 762 increments $N_{HCl}$ and step 766 increments the floor count. If $N_{HCl}$ is equal to or greater than $A_{CB}$, step 764 clears the assignment of this scan slot to this car from the per car register, and step 766 increments the floor count.

Step 768 checks to see if all of the scan slots in the present scan direction have been examined. If not, the program loops back to step 756. If the present scan is completed, step 770 increments the scan number and changes the scan direction. Step 772 checks to see if the scan loop has been completed. If not, the program loops back to step 752. If all the scans have been processed, step 772 advances to step 773 which sets $N_{HCT}$ equal to the present value of $N_{HCl}$ for this car, and step 773 advances to step 740 which increments the car number. Step 746 checks to see if all the cars have been considered. If not, the program loops back to step 734. If all of the cars have been considered, the program exits at terminal 748.

FIG. 20

Figure 20:
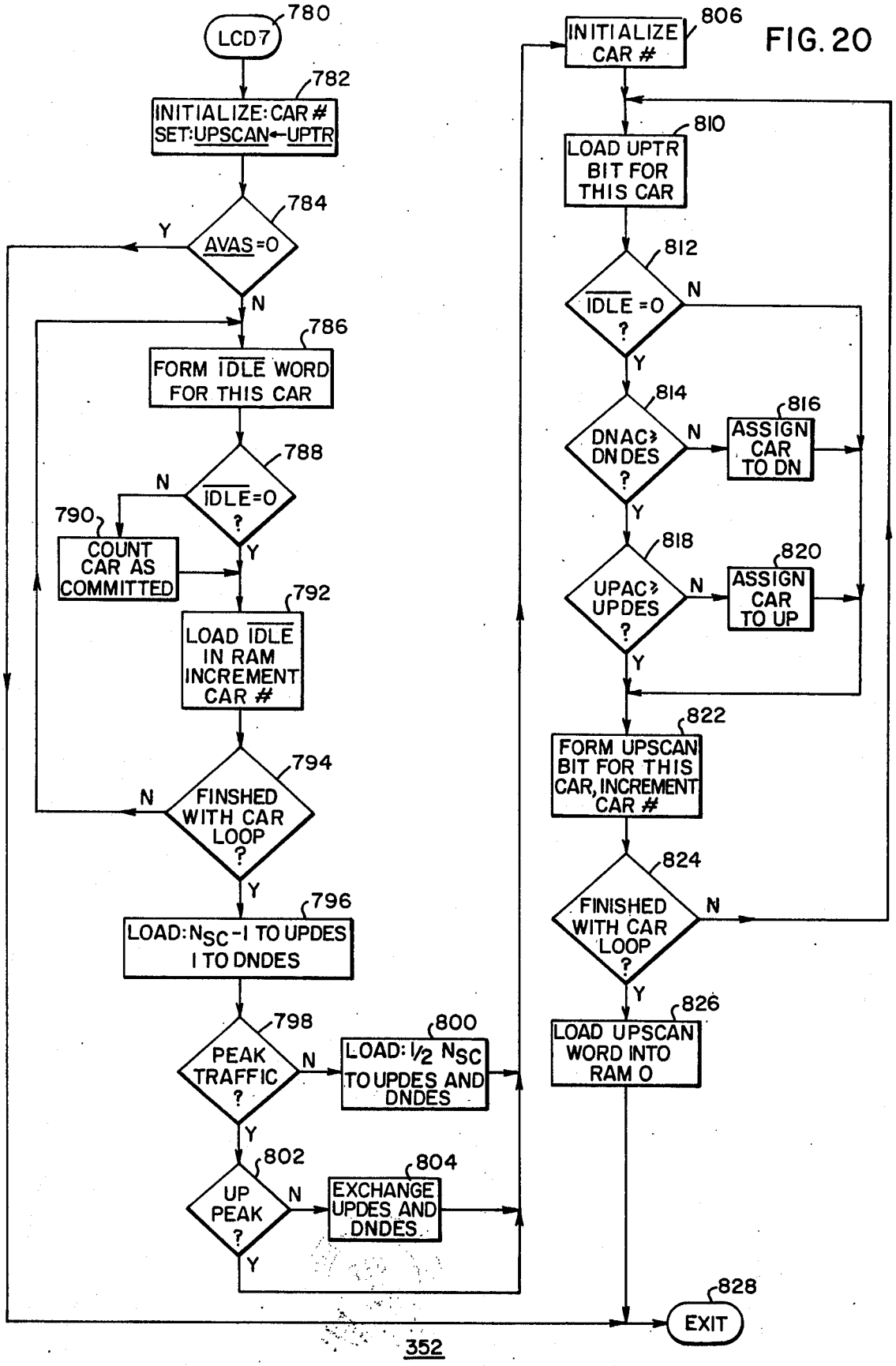
Figure 22:
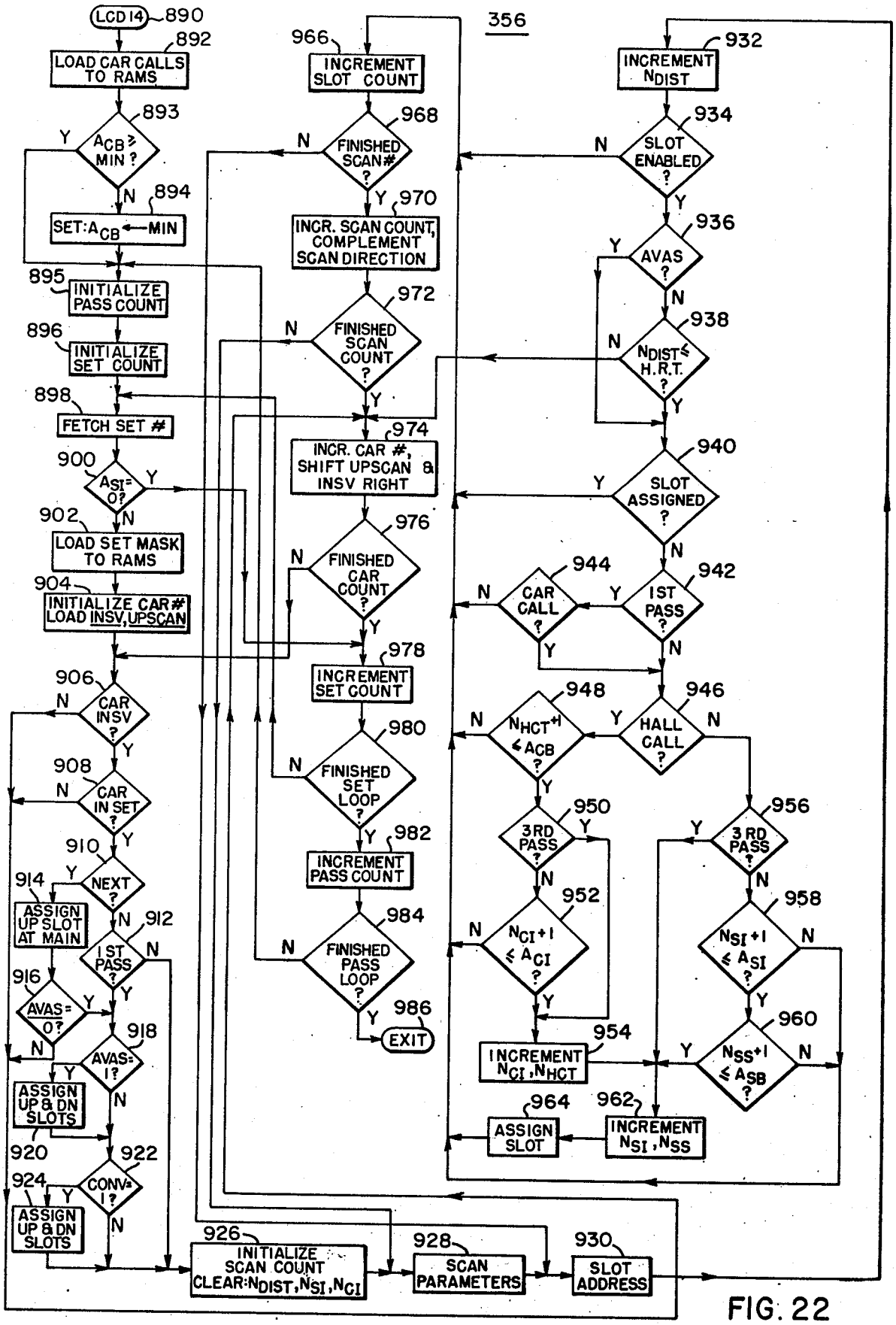

FIG. 20 is a flow chart of a sub-program LCD7 which may be used to perform the block function 352 of FIG. 9, which function assigns scan directions for in-service, idle cars, to be used when assigning scan slots to the cars in function 356 of FIG. 9, detailed in LCD14 of FIG. 22.

When a travel distance limitation from the car to the assigned landing service direction is applied to all in-service cars whether busy or idle, it is important to select an initial assignment direction from an in-service idle car which takes into account the travel directions of the busy cars, as well as the currently existing traffic conditions. If the travel distance limitation is only applied to busy cars, the importance of selecting the assignment direction dynamically is lessened. In the latter case the last travel direction of an in-service idle car may be used. For purposes of example, it will be assumed that LCD7 is used.

Scan slots will be assigned to the cars in LCD14 using the same scan loop hereinbefore described relative to FIG. 19. Busy cars, ie., cars which have a car call ahead, a dummy call ahead, or an assigned hall call ahead, are assigned the same scan direction as their travel direction. An inservice car with no car calls, dummy calls, or assigned calls ahead, is assigned a scan direction which will best satisfy the following distribution, assuming a 4 car bank:

(1) Up peak condition: One car only to serve down traffic (2) Down peak condition: One car only to serve up traffic (3) Normal (no peak): One half of the cars for each service direction.

Sub-program LCD7 is entered at terminal 780 and step 782 initalizes the car count and sets the 4-bit word UPSCAN, stored in the status character memory of RAM 0, to the word UPTR. The word UPTR is stored in the main memory of RAM 0. Step 784 checks to see if there are any in-service, idle cars by checking the word AVAS stored in the main memory of RAM 0. If the word AVAS is zero, there are no AVAS cars and the program exits at terminal 828. It should be noted that the word "available", as normally used to mean "available for assignment", is not applicable at the processor level, as all in-service cars are given floor assignments. If the floor assignments do not have a hall call, and the car has no car calls, and no parking call, the car is idle or inactive, but it is not "available".

If word AVAS is non-zero, there is at least one available car according to the floor selector, and step 786 makes its own determination of whether the car is in-service and truly inactive or idle by forming a word $\overline{\text{IDLE}}$ from the $\overline{\text{INSC}}$, NEXT, and $\overline{\text{AVAS}}$ bits associated with this car. Step 788 checks to see if this word $\overline{\text{IDLE}}$ is zero. If so, it indicates that car is in-service, it does not have the NEXT assignment, and it is available according to the floor selector of this car. If it is non-zero, step 790 counts the car as being committed, ie., a busy car, and proceeds to step 792.

If word $\overline{\text{IDLE}}$ is zero, the program proceeds directly to step 792 from step 788. Step 792 loads the word $\overline{\text{IDLE}}$ into the main memory of the per car register associated with the car, ie., RAM 12 for car 0, and the car count is incremented. Step 794 determines if all cars have been considered, and if not, the program loops back to step 786. If all cars have been considered, step 796 provides an arbitrary distribution of scan directions by setting a variable UPDES to the number of in-service cars $N_{SC}$ minus 1, and a variable DNDES is set to 1. When the sub-program is further advanced, variables UPDES and DNDES will contain the desired number of cars which should be set for up and down scan directions, respectively.

Step 798 checks the peak traffic bit in the status character memory of RAM 0, and if it is not set step 800 loads $\frac{1}{2}$ $N_{SC}$ to UPDES and $\frac{1}{2}$ $N_{SC}$ to DNDES. If the peak traffic bit is set, step 802 checks the bit in the status character memory of RAM 0 which identifies whether the system is on up peak or down peak. If the system is on up peak, nothing further is done to UPDES and DNDES, as the arbitrary setting of these variables in step 796 set them for up peak. If the system is on down peak, step 804 exchanges UPDES and DNDES, setting UPDES to 1 and DNDES to $N_{SC}$-1.

The program then advances to step 806 which initializes the car count and step 810 loads the UPTR bit for this car into the accumulator. Step 812 checks the $\overline{\text{IDLE}}$ stored in the per car register for this car, to see if it is available according to the system control's definition. If it is not available, the program advances to step 822. If it is available, step 814 determines if the actual number of cars set for down travel DNAC is equal to or greater than the desired number of cars set for down travel DNDES. If the answer is no, step 816 assigns the car to down, step 822 sets the bit in the word UPSCAN associated with this car to a zero to indicate the car assignment scan will be in the down direction, and the car count is incremented.

If the actual number of cars set for down scan is equal to or greater than the desired number, step 818 determines if the actual number of cars set for up travel, UPAC, is equal to or greater than the desired number UPDES. If the answer is no, step 820 assigns the car to the up scan direction, and step 822 sets the bit of UPSCAN related to this car to a one, to indicate that it has been assigned the up scan direction, and increments the car count.

If step 818 finds UPAC equal to or greater than UPDES, the program advances to step 822, the UPSCAN bit is undisturbed, and the car count is incremented.

Step 824 checks to see if all cars have been considered. If not, the program loops back to step 810. If all cars have been considered, step 826 loads the word UPSCAN into the status character memory of RAM 0, and the program exits at terminal 828.

FIG. 21

Figure 21:
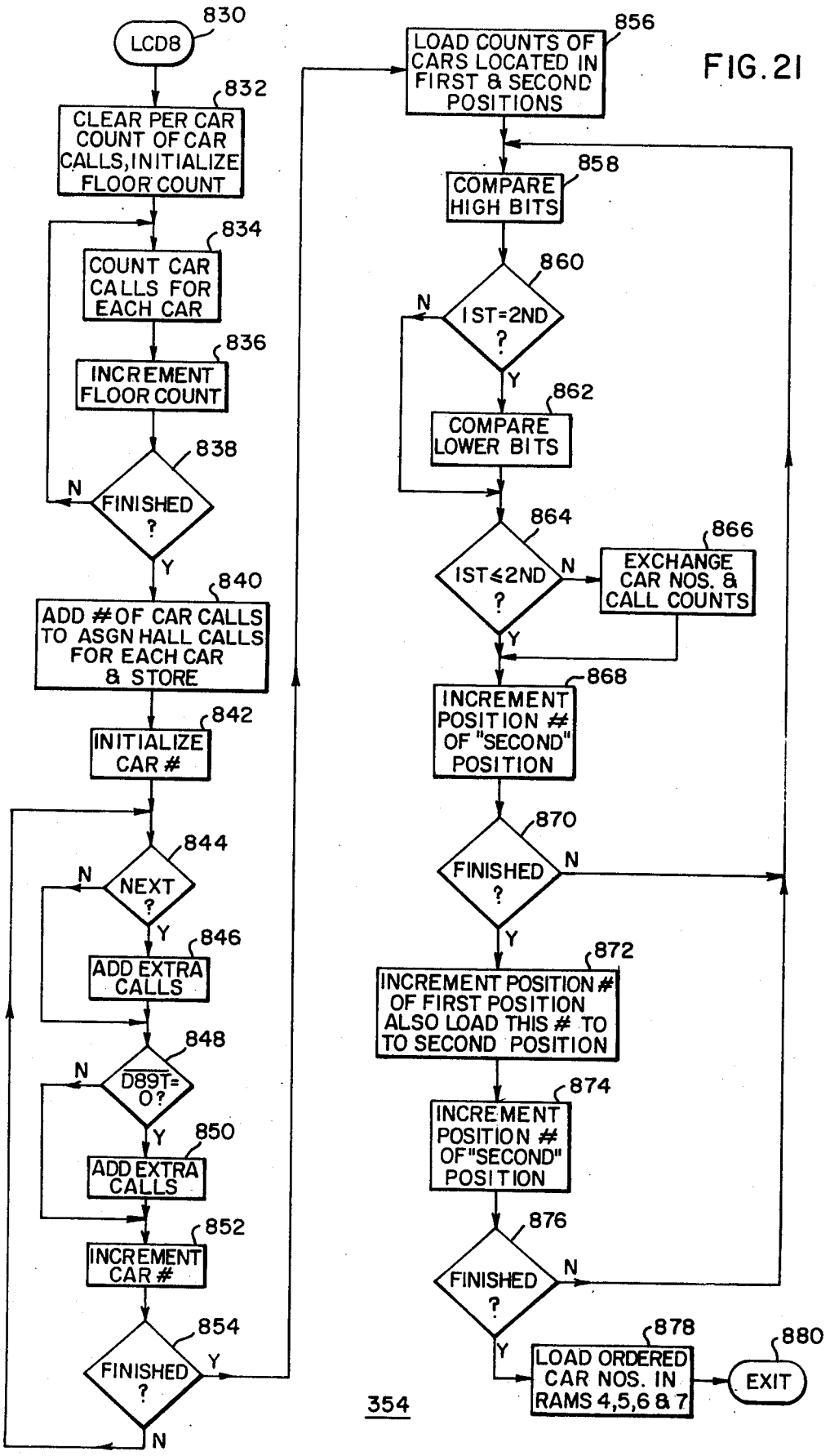

FIG. 21 is a flow chart of a sub-program LCD8 which may be used for function 354 in FIG. 9, which function assigns the order in which the cars are considered when scan slots are assigned thereto in step 356 of FIG. 9.

Sub-program LCD8 is entered at terminal 830 and step 832 clears the status character memories of RAMS 4, 5, 6 and 7 of the car call counts stored therein. Step 832 also initializes the floor count. Step 834 checks for car calls for the cars in the first scan slot, using the first 4-bit word from the main memory of RAM 3, in which the car calls 3Z are stored. If a car call is detected for a car, it is added to the car call count for the car. Step 836 increments the floor count and step 838 checks to see if all floors have been considered. If not, the program loops back to step 834. If they have all been considered, step 840 adds the number of car calls each car has to the number of hall calls assigned to the car, and the sums are stored in a temporary location.

Step 842 then initializes the car count, and step 844 determines if the car has the NEXT assignment by examining the bit of word NEXT in the main memory of RAM 4 which is associated with this car. If the car is NEXT, step 846 adds to the car and hall call total associated with this car an arbitrary number of calls, with the arbitrary number being of sufficient magnitude to assure that the NEXT car has a larger number than any other car could possibly have.

Step 848 checks to see if the motor-generator set associated with the drive motor of the elevator car has been shut down. This is accomplished by checking the bit of word $\overline{\text{D89T}}$ stored in the main memory of RAM 0. If the $\overline{\text{D89T}}$ bit is zero, indicating the motor-generator set is shut down, step 850 adds extra calls to the car and hall call sum for that car, with the magnitude of the extra calls being selected such that the car will have the largest number if there is no car with the NEXT assignment, and the second largest number in the event there is a car with the NEXT assignment.

Step 852 increments the car count and step 854 checks to see if all cars have been considered. If not, the program loops back to step 844. If all the cars have been considered, the program advances to step 856.

Steps 856 through 876 order the cars according to the magnitudes of the numbers just prepared for the cars in the earlier part of LCD8, with the first car in the order having the least number of calls, etc. Any sorting or ordering technique may be used. The technique illustrated in FIG. 21 starts with the cars in a predetermined order, such as the order 0, 1, 2 and 3, using car numbers, and compares the cars a pair at a time, exchanging the positions of the cars whenever the number of calls associated with a car to the right of the other car is smaller.

There are four positions for the cars, for a four car bank, and these four positions will be given the numbers 1, 2, 3 and 4 starting from the left hand position, and it should be noted that the position number is not related to the number of the car. Using the position numbers, the comparison sequence for a four car bank would be as shown in Table I:

TABLE I

| STEPS | COMPARISON POSITION | POSITION |
|---|---|---|
| 1 | 1 | 2 |
| 2 | 1 | 3 |
| 3 | 1 | 4 |
| 4 | 2 | 3 |
| 5 | 2 | 4 |
| 6 | 3 | 4 |

The technique of Table I is implemented, starting with step 856. Step 856 loads the call counts of the cars located in the first and second positions, to begin step 1 of the table. Step 858 compares the most significant bits of the call counts and step 860 checks to see if they are equal. If not, no further comparison is necessary and the program proceeds to step 864 which asks if the first call count is equal to or less than the second call count. If step 860 finds the most significants bits are equal, step 862 compares the lower bits and then proceeds to step 864.

If step 864 finds that the first count is not less than or equal to the second count, step 866 exchanges the car numbers and their call counts, moving the number of the car in the second position to the first position, and the number of the car in the first position to the second position. If the first call count is equal to or less than the second, the car numbers are in the correct order, as far as this pair is concerned, and step 864 proceeds to step 868, which is where step 866 proceeds after exchanging car numbers.

Step 868 increments the position number of the second position, which is step 2 of Table I, to compare the call count of the car in position 1 with the call count of the car in position 3. Step 870 checks to see if the car in the first position has been compared with all of the other cars, and if not the program loops back to step 858. Thus, the program loops back to perform steps 2 and 3 of Table I, and then step 870 would find that the loop is complete and the program advances to step 872.

Step 872 increments the position number of the first position, ie., changes the 1 to a 2, and also loads this number (2) to the second position. Step 874 then increments the number of the second position, to provide the number 3. Thus, after step 874, the call counts of cars in positions 2 and 3 are compared, which is step 4 of the table.

Step 876 checks to see if this second phase of the comparison has been completed, and since it has not, the program loops back to step 858 to make the comparison of step 4 of Table I. Upon reaching step 868, the second position would be incremented to compare the cars in positions 2 and 4, which is step 5 of Table I, and the program would loop back from step 870 to step 858 to make this comparison.

Step 870 would then find that the second phase of the comparison has been completed, step 872 would increment the position number of the first position, to advance it to a 3, and the number 3 would be loaded to the second position. Step 874 increments the number of the second position to make it a 4, and thus the cars in positions 3 and 4 are ready to be compared, which is step 6 of Table I. The program loops back to step 858 to make this comparison, and would proceed through the "yes" branches of steps 870 and 876 since there is only one comparison in the third phase.

Step 878 loads the ordered car numbers into the status character memories of RAMS 4, 5, 6 and 7.

Table II contains an example of the hereinbefore described sorting technique, with car 0 having a call count of 4, car 1 a count of 9, car 2 a count of 7 and car 3 a count of 3.

TABLE II

| POSITIONS | 1 | 2 | 3 | 4 |
|---|---|---|---|---|
| Starting order of cars (car #) | 0 | 1 | 2 | 3 |
| Step 1 (1–2) | 0 | 1 | 2 | 3 |
| Step 2 (1–3) | 0 | 1 | 2 | 3 |
| Step 3 (1–4) | 3 | 1 | 2 | 0 |
| Step 4 (2–3) | 3 | 2 | 1 | 0 |
| Step 5 (2–4) | 3 | 0 | 1 | 2 |
| Step 6 (3–4) | 3 | 0 | 2 | 1 |

FIG. 22

FIG. 22 is a flow chart of a sub-program LCD14 which may be used for function 356 shown in FIG. 9, which function assigns scan slots to the cars. The scan slots are assigned in three passes for each set, with each pass processing all of the sets before starting the next pass. The sets are handled in the order of increasing number of cars per set, and the selection of cars to be scanned in each set is that order determined in LCD8 (FIG. 21).

Sub-program LCD14 is entered at terminal 890 and step 892 loads the car calls from RAM 3 to the main memories of the per car registers (RAMS 12–15). Step 893 checks to see if $A_{CB}$, the average number of hall calls per in-service car in the building, is equal to or greater than a predetermined minimum number. The size of this number determines when idle (IDLE) cars will be placed in service as traffic starts to build up in the building. If it is desired that two hall calls should start two cars, the minimum number may be set to 0. Setting the minimum number to 2 will require 3 hall calls to be seen by the same car before a second car will be started, etc.

If $A_{CB}$ is not equal to or greater than the minimum number, step 894 sets it equal to this minimum number and the program advances to step 895. If $A_{CB}$ is equal to or larger than the minimum, step 893 advances to step 895.

Step 895 initializes the assignment pass count, to start with assignment pass 1. Step 896 initialzes the set count so the sets are taken in the order of increasing number of cars per set. As hereinbefore stated, the set numbers are binary numbers produced in the up and down masks, RAMS 10 and 9, respectively, by logic ones in each row associated with a floor level for each car enabled to serve the floor level. If the car is not enabled, its bit location for the floor has a logic zero. Step 898 calls the first set to be considered with a fetch instruction which accesses a look-up table in control memory 82 of FIG. 4. A binary counter set to count from 4 through 15 will call up to 12 sets, with this counter being incremented to call the next set. Sub-program LCD5 (FIG. 18) already made the assignments to the 1 car sets in step 712 thereof, which reduces the maximum number of sets to be considered in LCD14 from 16 to 12.

Step 900 checks to see if the set called is a valid set, since all possible multiple car set numbers will be examined. This is accomplished by checking to see if $A_{SI}$, the average number of scan slots in the set per in-service car enabled for the set, is zero. If so, it is an invalid set and the program advances to step 978 to advance the set count. If it is a valid set, $A_{SI}$ will be non-zero and step 902 loads the mask for this set to the main memory of the per car registers (RAMS 12–15). The mask for the set exposes the floors of the set, ie., a logic one is located at each floor of the set corresponding to each car which can serve the set, and all other bit locations will be a logic zero.

Step 904 initializes the car count and loads the 4-bit words INSV and UPSCAN, stored in RAM 0, to a temporary location. Step 906 checks the INSV bit for the first car considered, and if the car is not in-service, the program advances to step 974, which increments the car count. If the car is in-service, step 908 checks to see if the car is enabled for this set. If it is not, the mask in the per car register will have a zero for this car, and the program advances to step 974.

If the car is in the set, the program starts the first assignment pass with step 910. Step 910 checks to see if this car has been given the NEXT assignment. If it has, step 914 gives this car the main floor up scan slot assignment, and if there are any available cars according to the floor selectors, checked in step 916, not counting cars with NEXT or CONV assignments, the NEXT car is not given any additional assignments, and the program advances to step 974. If the word AVAS is zero, indicating no available cars according to the floor selectors, the NEXT car may be given additional assignments, and the program advances to step 918.

If the car was not NEXT, step 912 determines if this is the first assignment pass. If it is, the AVAS bit for the car is checked, in step 918 to see if the car is available according to its floor selector. If it is available, step 920 assigns this car the up and down scan slots associated with the floor at which the car is located, and the program advances to step 922. If the car is not available the program advances directly to step 922.

Step 922 determines if the car has been given a convention floor assignment by checking the appropriate bit of the word CONV. If this bit is a one, step 924 assigns the up and down scan slots associated with the convention floor to this car. If the CONV bit is not a one, the program advances to step 926 which initializes the scan count and clears the variables $N_{DIST}$, $N_{SI}$ and $N_{CI}$. The scan counts, relative to the three scans, scan 1, scan 2 and scan 3, were hereinbefore described relative to LCD6 (FIG. 19). The variable $N_{DIST}$ is used to count the valid scan slots the counting and assignment sequence has progressed from the car, so far in the assignment routine. The variable $N_{SI}$ is used to count the number of scan slots assigned to the car so far in the set being considered. The variable $N_{CI}$ is used to count the number of hall calls assigned to a car so far in the set being considered.

Step 928 determines the parameters for the scan, ie., the number to be subtracted from the floor level of the car for an up or down traveling car so the slot address may be determined, and step 930 subtracts the parameter from the scan to determine the slot address. The three slot addresses for an up traveling car, which start the scans for scanning ahead of the car, scanning in the direction opposite to the car travel direction, and scanning behind the car, are $N_{CP-1}$, $\overline{N_{CP-1}}$ and $N_{CP}-\overline{N}_{POS+1}$, respectively, where $N_{CP}$ is a counter initialized such that the count will be 15 when the counter is incremented by one for each floor from the car position to the terminal in the direction of the scan, and $N_{POS}$ is the scan slot number which corresponds to the position of the car. The three scan slot addresses for a down traveling car, which start the scans for scanning ahead of the car, scanning in the direction opposite to the car travel direction, and scanning behind the car, are $\overline{N_{CP-1}}$, $N_{CP-1}$ and $\overline{N_{CP-}(N_{POS+1})}$.

The program assigns scan slots to AVAS cars without limitation as to the travel distance from the car to the floor associated with the assigned scan slot. The program does, however, restrict the assignment of scan slots to the busy cars, based on the travel distance from the car to the floor and service direction of the scan slot, using the present travel distance direction of the car rather than the physical separation of the car from the floor associated with the scan slot. For example, in a 16 floor building an up traveling car at the 3rd floor is the equivalent of 27 floors from a down call at the second floor while the physical separation is 1 floor. For purposes of example the distance limitation applied to the assigning of scan slots is one-half of a round trip for a car. This is conveniently figured by subtracting the level of the lowest floor the car is enabled to serve from the highest.

More specifically, step 932 increments $N_{DIST}$ and step 934 determines if the scan slot is enabled by checking the set mask. Step 936 checks the AVAS bit for the car in RAM 0. If the car is available the AVAS bit will be a one, and the car is not subject to the ½ round trip limitation. If the car is not available, step 938 determines if $N_{DIST}$ is less than or equal to a half round trip for the car. As hereinbefore stated, a half round trip for a car is determined by subtracting the lowest floor level which the car is enabled to serve from the highest floor level the car is enabled to serve. If the building has 16 levels and the car is enabled for all floors, a half round trip would be 15 floors. If step 938 finds that $N_{DIST}$ is greater than a half round trip, the program advances to step 974. If $N_{DIST}$ is equal to or less than a half round trip, step 940 checks to see if the scan slot has already been assigned. If it has, the program advances to step 966, which increments the slot count. If the scan slot has not been assigned, step 942 determines if this is the first pass. If it is, step 944 checks to see if the car has a registered car call. If it does not, the program advances to step 966, to increment the slot count. If the assignment routine is in the first pass and the car has a car call, or if the assignment routine is not in the first pass, the program advances to step 946, which checks to see if there is a registered hall call for the scan slot. If there is, step 948 determines if $N_{HCT}$, the total number of hall calls assigned to this car so far, plus one, is less than or equal to $A_{CB}$, the hall call average per car in the building. If $N_{HCT}$ plus one is greater than $A_{CB}$, the program advances to step 966. If $N_{HCT}$ plus one is equal to or less than $A_{CB}$, step 950 checks to see if the scan is in the third pass. If it is not, step 952 checks to see if $N_{CI}$ plus one is less than or equal to $A_{CI}$, where $N_{CI}$ is the number of hall calls assigned to the car so far in the set being considered, and $A_{CI}$ is the average number of calls per in-service car for the set being considered. If $N_{CI}$ plus 1 is greater than $A_{CI}$, the program advances to step 966. If $N_{CI}$ plus one is equal to or less than $A_{CI}$, the program advances to step 954. If step 950 determines the assignment is in the third pass, the limitation of step 952 is skipped, and the program goes directly to step 954. Step 954 increments $N_{CI}$ and $N_{HCT}$ and advances to step 962. Step 962 increments the variables $N_{SI}$ and $N_{SS}$, and step 964 assigns the scan slot to the car.

If step 946 determines there is no hall call in the slot, the program advances to step 956. Step 956 checks to see if the assignment is in the third pass. If it is not, the program advances to step 958 which determines if $N_{SI}$ plus one is equal to or less than $A_{SI}$. The variable $N_{SI}$ is the number of scan slots assigned to the car so far from the set being considered, and $A_{SI}$ is the average number of scan slots per in-service car for the set being considered. If $N_{SI}$ plus one is greater than $A_{SI}$, the program advances to step 966. If the $N_{SI}$ plus 1 is equal to or less than $A_{SI}$, step 960 checks to see if $N_{SS}$ plus 1 is less than or equal to $A_{SB}$. The variable $N_{SS}$ is equal to the total number of scan slots assigned to the car so far, and $A_{SB}$ is the average number of scan slots per in-service car for the building. If $N_{SS}$ plus 1 is greater than $A_{SB}$ the program advances to step 966. If it is equal to, or less than $A_{SB}$, the program advances to step 962, which increments $N_{SI}$ and $N_{SS}$, and step 964 assigns the scan slot to the car. If step 956 finds that the assignment is in the third pass, the limitations of steps 958 and 960 are skipped, and the program advances directly to step 962.

The program advances to step 966, which increments the scan slot count. Step 968 checks to see if the scan number has been completed. If it has not, the program loops back to step 930. If all the scan slots associated with the scan number have been completed, step 970 increments the scan count and the scan direction is reversed. Step 972 checks to see if all 3 phases (scan 1, scan 2 and scan 3) of the scan count have been completed. If the scan count hasn't been completed, the program loops back to step 928. If the scan count has been completed, the program advances to step 974 which increments the car count and shifts the UPSCAN and INSV words to expose the bits associated with the next car to be considered. Step 976 determines if the car count has been completed. If it has not, the program loops back to step 906. If it has been completed, the program advances to step 978 which increments the set count, to call the next set. Step 980 checks to see if all of the sets have been considered. If not, the program loops back to step 898. If all sets have been considered, the program advances to step 982 which increments the assignment pass count. Step 984 checks to see if the pass loop has been completed. If not, the program loops back to step 895. If the pass loop has been completed, the program exits at terminal 986.

The three assignment passes may be summarized as follows:

FIRST PASS

The NEXT car is given the main floor up assignment (step 914). AVAS and CONV cars are assigned the up and down scan slots associated with the floor at which the AVAS car is located, and the convention floor, respectively (steps 920 and 924). If the car has a car call for the floor associated with the scan slot being considered, the scan slot is associated to the car, subject to predetermined limitations. Step 938 introduces the ½ round trip limitation for busy cars, and step 946 selects the remaining limitations to be applied, depending upon whether or not the scan slot being considered has a hall call associated therewith. If it does not have a hall call, the averages $A_{SI}$ (step 958) and $A_{SB}$ (step 960) are applied as limitations. If it does have a hall call the averages $A_{CB}$ (step 948) and $A_{CI}$ (step 952) are applied as limitations. If the car does not have a car call for the scan slot being considered, the scan slot is not assigned on this pass.

SECOND PASS

The NEXT car is given the main floor up assignment (step 914). This step is repeated even though it was included in the first pass to enable step 916 to be checked on all three passes, as it is desirable to remove the NEXT car from the assignment routine as soon as there is an available car in the system.

Steps 918, 920, 922 and 924, which relate to AVAS and CONV cars, are omitted on the second pass, since they were carried out on the first pass.

The second pass also skips step 944, which was active on the first pass, as the second pass considers unassigned scan slots without regard as to whether or not the car has a car call for the floor of the scan slot. The ½ round trip limitation for busy cars, and the average $A_{SI}$, $A_{SB}$, $A_{CB}$ and $A_{CI}$ are applied as described relative to the first pass.

THIRD PASS

The NEXT car is again given the main floor up assignment, for the reasons pointed out relative to the second pass. Also similar to the second pass, steps 918, 920, 922, 924 and 944 are skipped.

On the third pass, unassigned (free) and empty (no hall call) scan slots are assigned to cars subject only to the ½ round trip limitation for busy cars, as the $A_{SI}$ and $A_{SB}$ limitations, active in steps 958 and 960, respectively, are skipped.

If the scan slot is unassigned but it has a hall call, the third pass is subject only to the ½ round trip limitation for busy cars and the $A_{CB}$ limitation, as the $A_{CI}$ limitation, active in step 952, is skipped.

Thus, if there are any in-service idle cars, all scan slots associated with floors will be assigned. If there are no in-service idle cars, it is possible that on a given run through the program that one or more scan slots associated with floors may not be assigned, due to the travel distance limitation in the assignment of scan slots. These scan slots will be assigned, as soon as some car moves to a position which satisfies the requirements of the program for assigning scan slots. Since no car is suitably located for promptly answering a call associated with an unassigned scan slot, it would do no good to assign the scan slot, or scan slots, until it is determined which car should be assigned scan slots according to the strategy of the program.

FIG. 23

Figure 23:
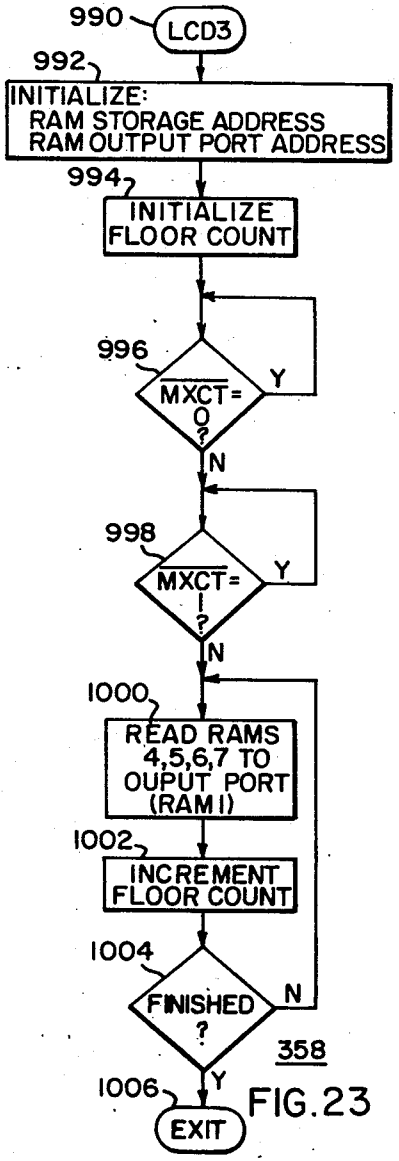

FIG. 23 is a flow chart of a subprogram LCD3 which may be used for function 358 shown in FIG. 9, which function loads the information stored in RAMS 4, 5, 6 and 7 (FIG. 5) to the output port of RAM 1 (FIG. 4), to send scan slot assignments and commands to the cars. Subprogram LCD3 is entered at terminal 990, step 992 initializes the RAM storage address and RAM output port address, and step 994 initializes the floor count. Steps 996 and 998 synchronize with the start of a scan cycle, using signal $\overline{MXCT}$, as hereinbefore described relative to steps 364 and 366 in FIG. 10. Step 1000 reads RAMS 4, 5, 6 and 7 to the output port of RAM 1, one floor at a time, with steps 1002 and 1004 returning the program to step 1000 to read the information relative to the next floor. When all floors have been completed, step 1004 advances to the exit terminal 1006.

FIGS. 24 AND 25

Figure 25:
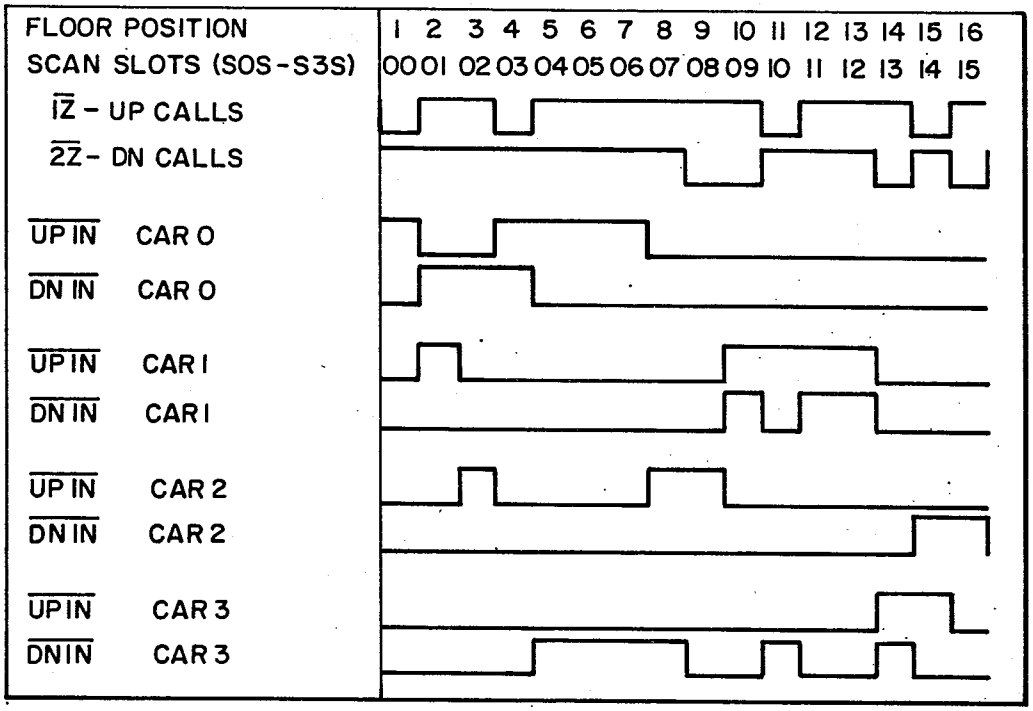
FIG. 25 is a timing diagram which illustrates the inhibit signals developed by the supervisory system control relative to the specific example shown in the chart of FIG. 24.

FIGS. 24 and 25 are charts used to illustrate the strategy of the invention relative to a specific example. As illustrated in FIG. 24, the building has 16 floors, served by four cars 0, 1, 2 and 3. The building has a main floor 1, two basements B1 and B2, and two top extensions TE1 and TE2. Car 0 is enabled for both basements B1 and B2 and floors 1 through 12. Car 1 is enabled for basement B1 and floors 1 through 12. Cars 2 and 3 are enabled for floors 1 through 12 and both top extensions TE1 and TE2. The valid sets are determined from the down and up call masks, RAMS 9 and 10. There are two scan slots in the one car set 0001. There are two scan slots in the two car set 0011. There are four scan slots in the two car set 1100, and there are 22 scan slots in the 4 car set 1111. There are 2 scan slots in the invalid set 0000. All other sets are empty. Table III tabulates the sets and the number of scan slots associated with each set, and also tabulates the $A_{SI}$ and $A_{CI}$ for each set. The average $A_{CI}$ is calculated using the number of hall calls listed in the Table.

TABLE III

| SETS | HALL CALLS | SCAN SLOTS | $A_{SI}$ | $A_{CI}$ |
|---|---|---|---|---|
| 0001 | 1 | 2 | 2 | 1 |
| 0011 | 0 | 2 | 1 | 0 |
| 1100 | 3 | 4 | 2 | 2 |
| 1111 | 4 | 22 | 6 | 1 |
| 0000 | X | 2 (invalid) | X | X |
| | | 32 TOTAL | | |

The cars are in the positions shown by the circles, with car 2 having the NEXT assignment at the main floor. The car calls are indicated with "CC". The hall calls are indicated with a "diamond" under the heading "Hall Calls". Function 332 of FIG. 9, detailed in LCD11, of FIG. 14, determines the average $A_{SB}$ for the building, and the averages $A_{SI}$ for the sets. The average $A_{SB}$ is 8, ie., 30 valid slots divided by 4 in-service cars. The averages $A_{SI}$ are determined by dividing the number of scan slots in a set by the number of in-service cars enabled for the set. They are listed in Table III and are stored in the proper set location in RAM 8 of FIG. 24. It will be noted that when the quotient is a fraction the next higher whole number is used.

Function 342 of FIG. 9 detailed in LCD11, FIG. 14, determines the average $A_{CB}$ for the building and the averages $A_{CI}$ of the sets. The average $A_{CB}$ is 2, 8 hall calls divided by 4 in-service cars. The averages $A_{CI}$ are determined by dividing the hall calls in a set by the number of in-service cars enabled to serve the set. They are also listed in Table III and are stored in the proper set location in RAM 2 of FIG. 24.

Table IV will aid in remembering the averages and limitations which apply to the three assignment passes.

TABLE IV

| ASSIGNMENT PASS | $A_{SB}$ | $A_{SI}$ | $A_{CB}$ | $A_{CI}$ | HALF ROUND TRIP LIMITATION |
|---|---|---|---|---|---|
| 1 | Yes | Yes | Yes | Yes | Yes |
| 2 | Yes | Yes | Yes | Yes | Yes |
| 3 | No | No | Yes | No | Yes |

On the first assignment pass, car 2, which has the NEXT assignment is given the main floor up assignment, indicated by an "X" in the up assignment table of FIG. 24. It will be assumed that there are no AVAS cars, so the NEXT car will be considered for further assignments, but it will be last in the priority order. It will also be assumed the convention floor feature is not active. It will be assumed that the car priority order, determined by LCD8 in FIG. 21 is 1, 3, 0, 2. Step 944 of LCD14 (FIG. 22) singles out the scan slots for which the cars have registered car calls. Car 1 has a car call for the 9th floor, and since it is set for up travel, it will be assigned scan slot 10-UP, associated with the 9th floor. The 9th floor has an up hall call registered, so this assignment automatically takes car of this coincident call.

Car 3 has a car for the 12th floor, and since it is set for up travel, car 3 will be assigned scan slot 13-UP, associated with the 12th floor.

Car 0 has a car for the main floor, and since it is set for down travel and is enabled to travel below the main floor, it will be assigned scan slot 02-DN, associated with the main floor. The main floor-down is part of set 0011 which has an $A_{SI}$ of 1. Therefore, this assignment to car 0 meets the $A_{SI}$ for set 0011 for car 0.

Car 2 has no car calls and receives no further assignments during the first pass. Thus, the first pass is completed, assigning the main floor up scan slot to the NEXT car, and the scan slots associated with registered car calls and the travel directions of the cars having the car calls. It will be remembered that LCD14 only assigns scan slots for those sets which are enabled for more than one car, as LCD5, FIG. 18 has already assigned the one car sets to their associated cars, ie., slot 00-UP and 01-DN were previously assigned to car 0.

On the second pass, the car priority order will still be 1, 3, 0, 2. Since there are no AVAS cars, the scan direction for assigning scan slots from the cars is the same as the car travel direction.

Pass 2 first takes set 0011. Scan slot 02-DN has already been assigned to car 0, so scan slot 01-UP is assigned to car 1. This completes the assignment of the two scan slots in set 0011.

Set 1100 is now taken, and car 3, which was assigned scan slot 13-UP on the first pass, is now assigned scan slot 14-UP, which meets the set average $A_{SI}$ of 2 and car 2, the other car enabled for this two car set, is assigned scan slots 15-DN and 14-DN. The assignment of scan slot 14-UP to car 3 takes care of the up hall call at TE1, and the assignment of scan slot 15-DN to car 2 takes care of the down hall call at TE2.

Set 1111 is now taken and car 1 is assigned scan slots 09-UP, 11-UP, 12-UP, 12-DN and 11-DN. The previous 10-UP assignment to car 1 has a hall call, which meets the set call average $A_{CI}$ of 1 for set 1111. Thus, slot 13-DN is not assigned to car 1, as it has a hall call registered. The assignment stops at scan slot 11-DN, as this meets the set average $A_{SI}$ of 6.

Car 3 is now assigned, starting from the car in an upwardly direction. Scan slot 12-UP was previously assigned to car 1. Thus, the first scan slot assigned to car 3, in this set, is 13-DN. Since this slot has a hall call, this meets the average, $A_{CI}$ of 1, and the average $A_{CB}$ of 2 and only scan slots without calls will be assigned to this car during the remainder of the second pass. Slots 12-DN and 11-DN were previously assigned to car 1, so the next slot assigned to car 3 is 10-DN. Scan slots 09-DN and 08-DN are skipped, since they have hall calls, and scan slots 07-DN, 06-DN, 05-DN and 04-DN are assigned to car 3. This meets the average $A_{SI}$ of six for this set, and the average $A_{SB}$ of 8. All of these scan slots are located within the ½ round trip limitation.

Car 0 is now assigned, starting at the car in a downward direction. Scan slot 04-DN has already been assigned to car 3 so scan slot 03-DN is the first to be assigned. The next scan slot assigned to car 0 is 03-UP. Since slot 03-UP has a hall call associated therewith, this meets the set call average $A_{CI}$ of 1 for car 0, and the average $A_{CB}$ of 2, and only scan slots without hall calls will now be assigned car 0 from this set on this pass.

Thus, scan slots 04-UP, 05-UP, and 06-UP are assigned to car 0, meeting the building slot average $A_{SB}$ of 8, and the set slot average $A_{SI}$ of 6, and the assignments are within the ½ round trip limitation.

Car 2 is now assigned scan slots from set 1111, starting from the car and proceeding upwardly. The first free (unassigned) scan slot up in this set is 07-UP, and thus scan slots 07-UP and 08-UP are assigned to car 2. The next free scan slot is 09-DN, but this is beyond the ½ round trip limitation and will not be assigned to car 2. This completes the second pass, and all scan slots have been assigned except 09-DN and 08-DN, and both have a hall call registered.

The third pass assigns free scan slots, removing all restrictions imposed in the second pass except the building call average $A_{CB}$ and the ½ round trip limitation. The cars are taken in the same order, starting with car 1. Car 1 has only one call assigned thereto, so it will be assigned scan slot 09-DN. This scan slot is within the ½ round trip limitation, and it meets the building call average $A_{CB}$ of 2 for this car. Therefore, this car cannot be assigned scan slot 08-DN. Car 3 is then considered. Car 3 already has two hall calls assigned thereto, meeting the $A_{CB}$ of 2, and thus is not assigned slot 08-DN.

Car 0 also has two hall calls assigned thereto, meeting the $A_{CB}$ of 2, and thus this car will not be assigned to scan slot 08-DN.

Car 2 is the last to be considered, and since scan slot 08-DN is beyond its ½ round trip limitation, it will not be assigned to car 2. Thus, scan slot 08-DN will not be assigned on this running of the program.

FIG. 25 is a chart which illustrates the inhibit signals which would be provided by the system control 22 for the specific example of FIG. 24.

While the foregoing description sets forth the preferred embodiment of the invention, it is to be understood that certain alternative arrangements may be used, and that they fall within the scope of the invention. For example, the preferred embodiment uses "loop" scanning in assigning the scan slots to the cars, which includes the three assignment passes. This loop scanning, which starts at the car in the direction of travel and returns to the car position is preferred because it enables like numbered sets to be grouped regardless of which service direction the binary word for a floor is associated with. However, it would also be suitable to maintain the service direction distinction, and have "up" sets and "down" sets. Loop scanning would not be used in this instance, as the "up" sets would be assigned by scanning upwardly, and the "down" sets would be assigned by scanning downwardly.

Further, in the preferred embodiment, the general assignment assigns scan slots to a selected car until meeting one of the dynamic limiting averages $A_{SI}$ or $A_{SB}$, or the travel distance limitation for a busy car. It would also be suitable to assign one scan slot to one car at a time, proceeding from car to car, until each car reaches a dynamic limiting average, or the travel distance limitation.

We claim as our invention:

1. An elevator system for a structure having a plurality of landings, comprising:

a plurality of elevator cars, means mounting said plurality of elevator cars for movement relative to the landings, call registering means for registering calls for elevator service from at least certain of the landings, car control means for each of said plurality of elevator cars, each of said car control means being independently operable, in the absence of overriding synchronized control signals, to move its associated elevator car in response to calls for elevator service, system control means responsive to said call registering means for preparing data words according to a predetermined call answering strategy, said data words having a predetermined format, interface means connected between each of said car control means and said system control means, said system control means intermittently providing one of said data words for each of said interface means, each of said interface means including means keyed by the predetermined format of the data word for storing the data word received from said system control means, and means for repetitively and serially reading out the stored data word to its associated car control means, to provide the overriding synchronized control signals required by the car control means to place the elevator cars under control of the system control means.

2. The elevator system of claim 1 wherein the system control means includes means for serially sending the data words to each of the interface means.

3. The elevator system of claim 1 wherein each interface means includes a serially accessed memory for storing and repetitively reading out the latest data word received from the system control means.

4. The elevator system of claim 3 wherein the serially accessed memory is a shift register.

5. An elevator system for a structure having a plurality of landings, comprising:

a plurality of elevator cars, means mounting said plurality of elevator cars for movement relative to the landings, call registering means for registering calls for elevator service from at least certain of the landings, car control means for each of said plurality of elevator cars, each of said car control means being operable to move its associated elevator car in response to calls for elevator service, system control means, interface means connected between each of said car control means and said system control means, each of said interface means including a shift register having a data input connected to the system control means, an output, and a recirculating input connected to the output, said system control means intermittently providing a data word for each of said interface means, each of said interface means including means keyed by the format of the data word for storing the data word received from said system control means, with said format responsive means enabling the data input and disabling the recirculating input of said shift register upon receipt of the data word, and enabling the recirculating input and disabling the data input upon termination of the data word, and means for repetitively and serially reading out the stored data word to its associated car control means, said data words being developed by said system control means to cause the plurality of elevator cars to answer calls for elevator service according to a predetermined strategy.

6. An elevator system for a structure having a plurality of landings, comprising:

a plurality of elevator cars, means mounting said plurality of elevator cars for movement relative to the landings, call registering means for registering calls for elevator service from at least certain of the landings, car control means for each of said plurality of elevator cars, each of said car control means being operable to move its associated elevator car in response to calls for elevator service, system control means, timing means, interface means connected between each of said car control means and said system control means, said system control means intermittently providing a serial data word, synchronized with said timing means, for each of said interface means, each of said interface means including first and second memory means, with said first memory means having a first mode which receives and stores a new data word from said system control means, while simultaneously reading out a previously stored data word to its associated car control means, and a second mode which repetitively and serially reads out the stored data word to its associated car control means, and with said second memory means selecting the mode of said first memory means responsive to the format of said serial data word and said timing means, said system control means controlling the operation of said plurality of elevator cars with the data words, to cause the elevator cars to answer calls for elevator service according to a predetermined strategy.

7. The elevator system of claim 6 wherein the first memory means is a shift register which is continuously clocked by the timing means, said shift register having a data input connected to receive a data word from the system control means, an output connected to provide serial signals for the associated car control means, a recirculating input connected to the output, and a mode input for selectively enabling one of the inputs, said mode input being connected to the second memory means.

8. The elevator system of claim 6 wherein the second memory means includes first and second flip-flops, said first flip-flop being responsive to the format of a data word, enabling said second flip-flop to be switched from a first to a second state by the timing means during the first bit of the data word and back to the first state by the timing means when the data word has been stored in the first memory means, said second flip-flop selecting the first mode of the first memory means when it is in its second state, and the second mode when it is in its first state.

9. An elevator system for a structure having a plurality of landings, comprising:

a plurality of elevator cars, means mounting said plurality of elevator cars for movement relative to the landings, call registering means for registering calls for elevator service from at least certain of the landings, car control means for each elevator car, each of said car control means being independently operable, in the absence of overriding sychronized control signals, to cause its associated elevator car to respond to calls for elevator service registered on said call registering means, system control means responsive to said call registering means for preparing data words according to a predetermined call answering strategy, interface means connected between each of said car control means and said system control means, said system control means intermittently sending a new data word to each interface means, with each new word being sent within a predetermined time interval, said interface means including means for storing each new data word, and means for repetitively and serially reading out the latest stored word to its associated car control means, with the repetitive, serial signals provided by each interface means being the overriding synchronized control signals required by the car control means to place the elevator cars under control of the system control means.

10. The elevator system of claim 9 including means responsive to the failure of the system control means to provide a new data word within the predetermined time interval to place the car controller means on independent control, notwithstanding reception of repetitive serial signals from its associated interface means.

* * * * *